US005691675A

United States Patent [19]

Hatanaka

[11] Patent Number: 5,691,675

[45] Date of Patent: Nov. 25, 1997

[54] RESONATOR WITH EXTERNAL CONDUCTOR AS RESONANCE INDUCTANCE ELEMENT AND MULTIPLE RESONATOR FILTER

[75] Inventor: Hiroshi Hatanaka, Fujimi, Japan

[73] Assignee: Nihon Dengyo Kosaku Co., Ltd., Tokyo, Japan

[21] Appl. No.: 556,905

[22] PCT Filed: Mar. 31, 1995

[86] PCT No.: PCT/JP95/00629

§ 371 Date: Nov. 28, 1995

§ 102(e) Date: Nov. 28, 1995

[87] PCT Pub. No.: WO95/27318

PCT Pub. Date: Oct. 12, 1995

[30] Foreign Application Priority Data

| | | | |
|---|---|---|---|
| Mar. 31, 1994 | [JP] | Japan | 6-087807 |
| Oct. 25, 1994 | [JP] | Japan | 6-284124 |
| Feb. 15, 1995 | [JP] | Japan | 7-051971 |

[51] Int. Cl.[6] ..... H01P 1/20

[52] U.S. Cl. ..... 333/202; 333/206; 333/222; 333/224; 333/232

[58] Field of Search ..... 333/202, 206, 333/207, 222, 223, 224, 226, 227, 232

[56] References Cited

U.S. PATENT DOCUMENTS

| | | | |
|---|---|---|---|
| 4,268,809 | 5/1981 | Makimoto et al. | 333/224 |
| 4,568,985 | 2/1986 | Reed | 333/231 |
| 4,603,311 | 7/1986 | Mage | 333/202 |
| 4,613,838 | 9/1986 | Wada et al. | 333/226 |
| 4,614,925 | 9/1986 | Kane | 333/174 |
| 4,631,506 | 12/1986 | Makimoto et al. | 333/224 |
| 4,660,005 | 4/1987 | Hutchinson | 333/134 |

FOREIGN PATENT DOCUMENTS

| | | | |
|---|---|---|---|
| 55-2214 | 8/1981 | Japan . | |
| 58-79301 | 5/1983 | Japan | 333/222 |
| 58-105602 | 6/1983 | Japan . | |
| 1-103001 | 4/1989 | Japan . | |
| 16883256 | 10/1991 | U.S.S.R. | 333/232 |
| 1741200 | 6/1992 | U.S.S.R. | 333/222 |

*Primary Examiner*—Benny Lee
*Assistant Examiner*—Darius Gambino
*Attorney, Agent, or Firm*—Kanesaka & Takeuchi

[57] ABSTRACT

A resonator consists of an external conductor (1), a dielectric plate (2), a resonance capacity element, an input terminal (5), and an output terminal (6). The dielectric plate (2) is fixed at its upper and lower ends to the upper and lower walls, respectively, of the external conductor (1). The resonance capacity element is composed of electrodes of a metal thin layer or a metal plate provided on the front and back of the dielectric plate (2). The lower end of one of the electrodes is electrically connected to the lower wall of the external conductor (1), and a gap is formed between the upper end of the electrode and the upper wall of the external conductor (1), while the upper end of the other electrode is electrically connected to the upper wall of the external conductor (1), and a gap is formed between the lower end of the other electrode and the lower wall of the external conductor (1).

6 Claims, 55 Drawing Sheets

FIG. 1
PRIOR ART
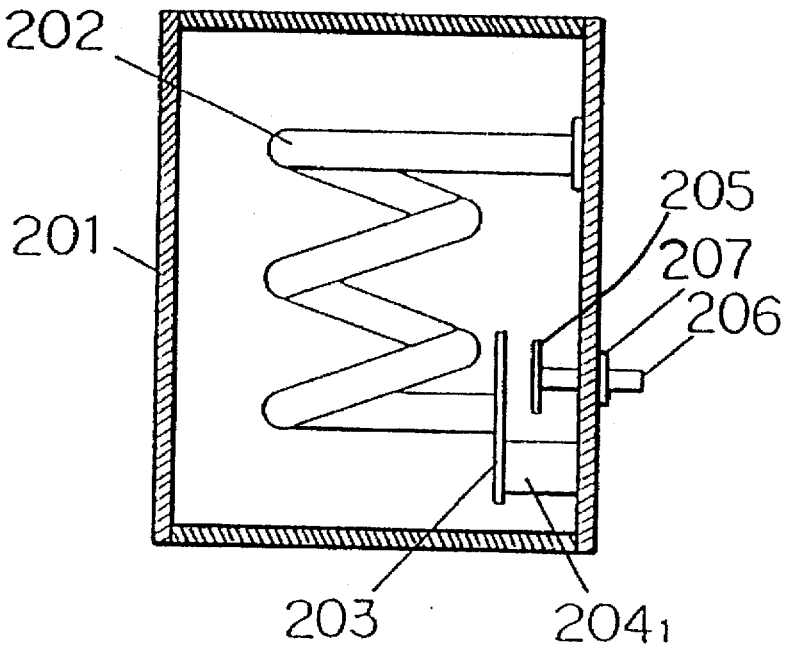
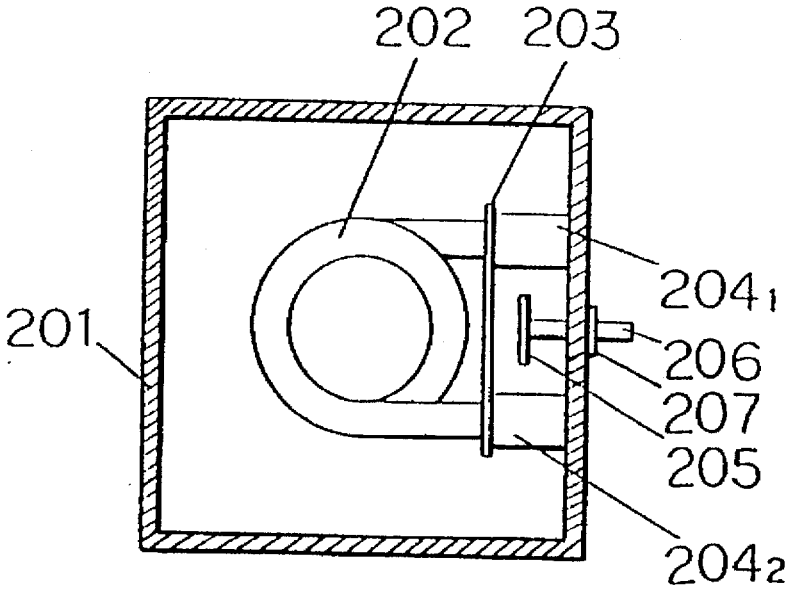
FIG. 2
PRIOR ART

FIG. 27
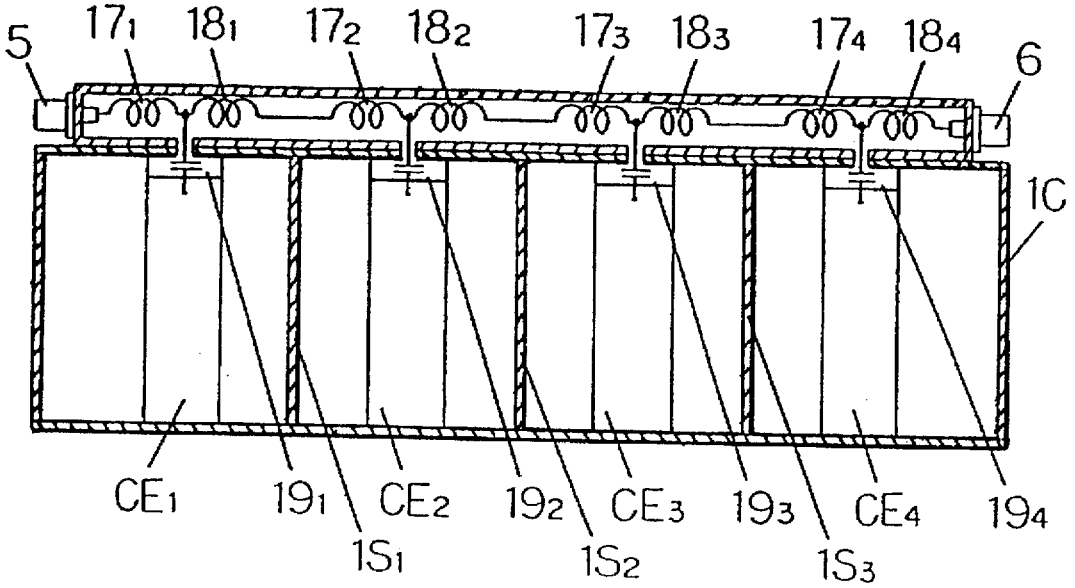
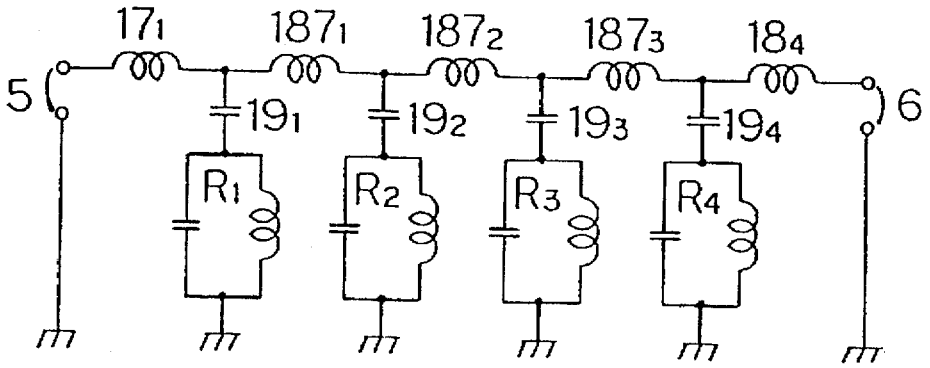
FIG. 28
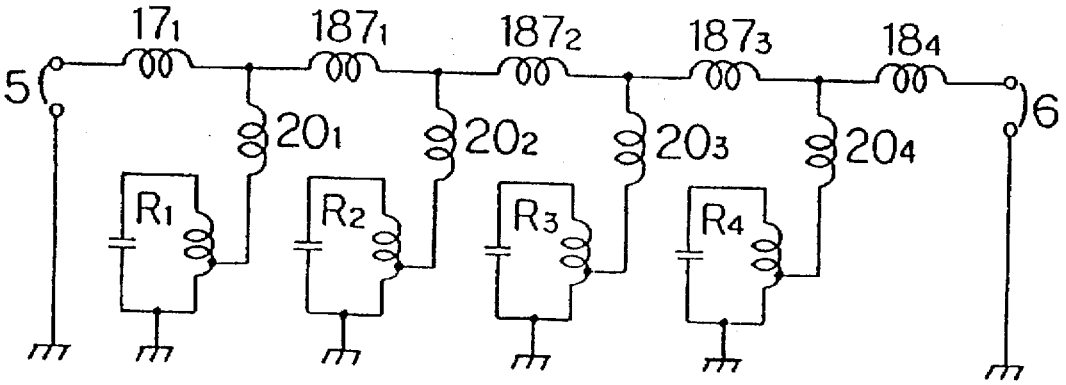
FIG. 29

FIG. 68
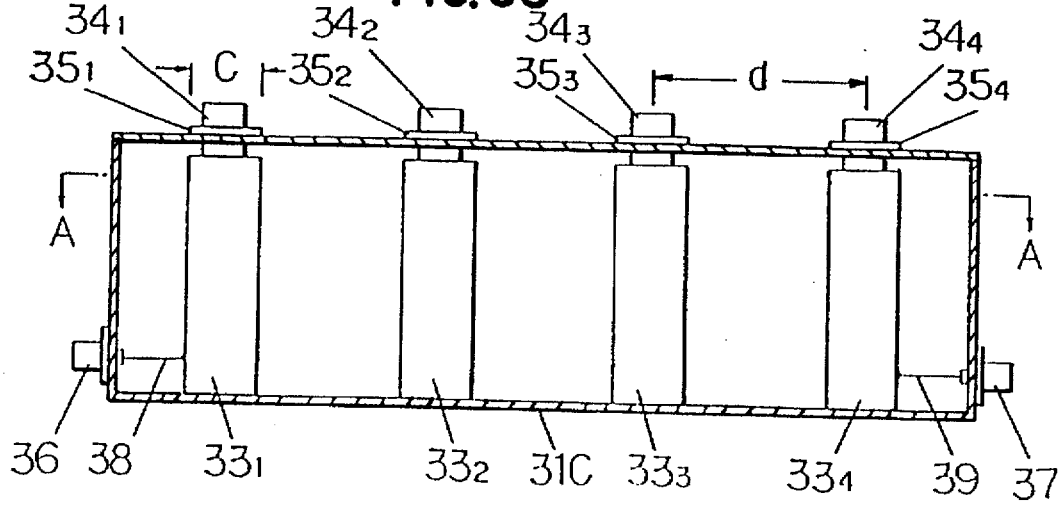
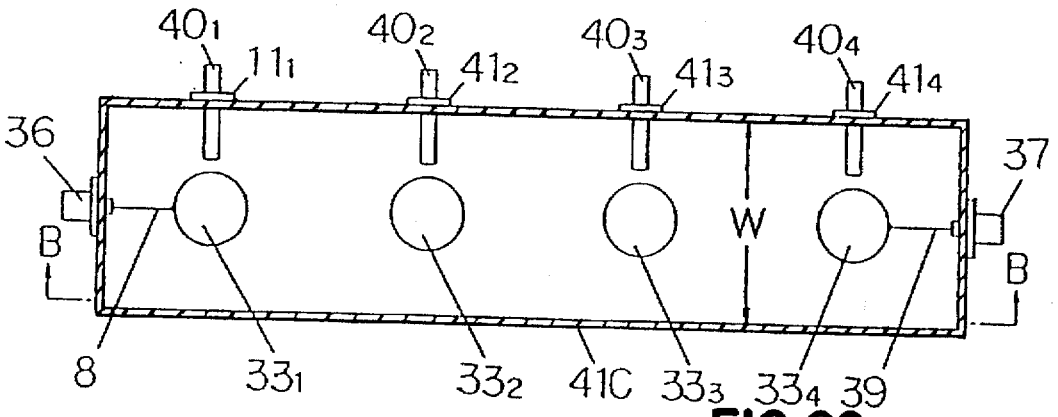
FIG. 69
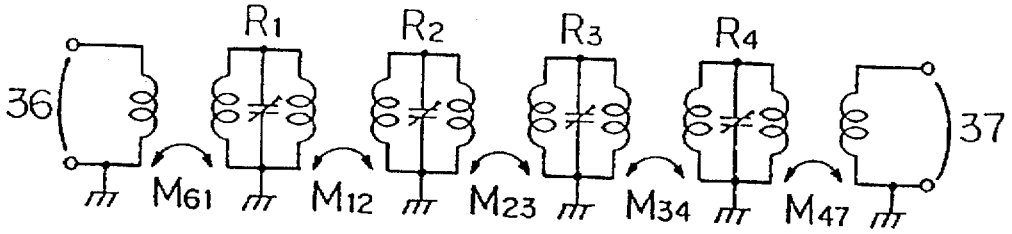
FIG. 70
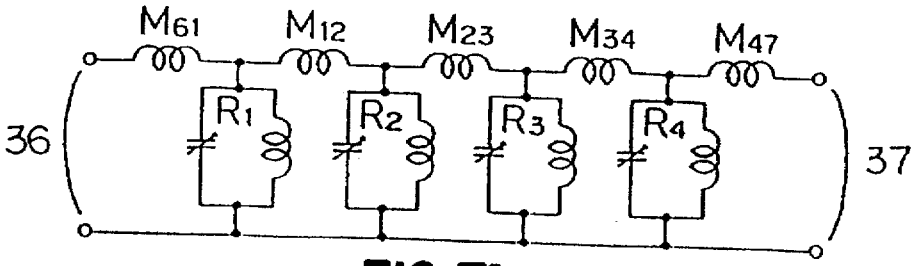
FIG. 71

FIG. 124
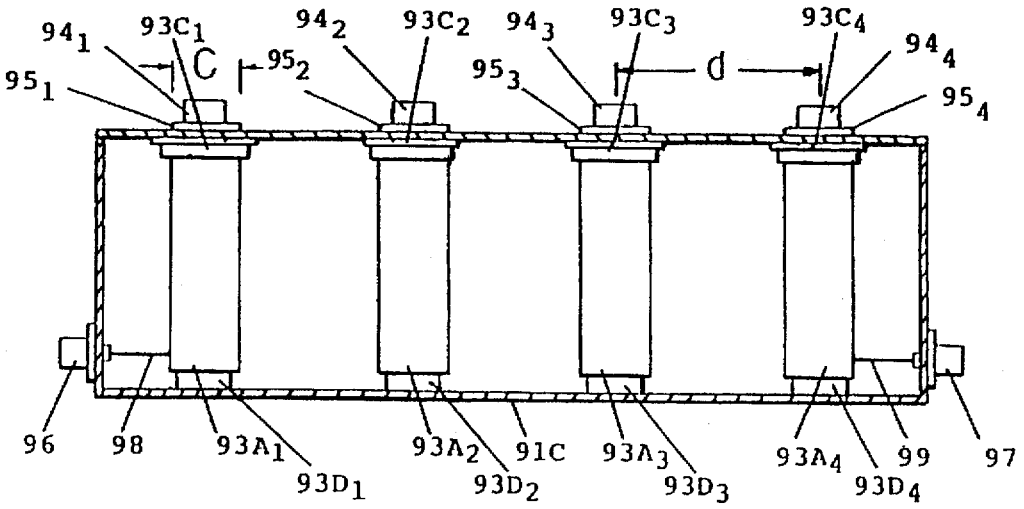
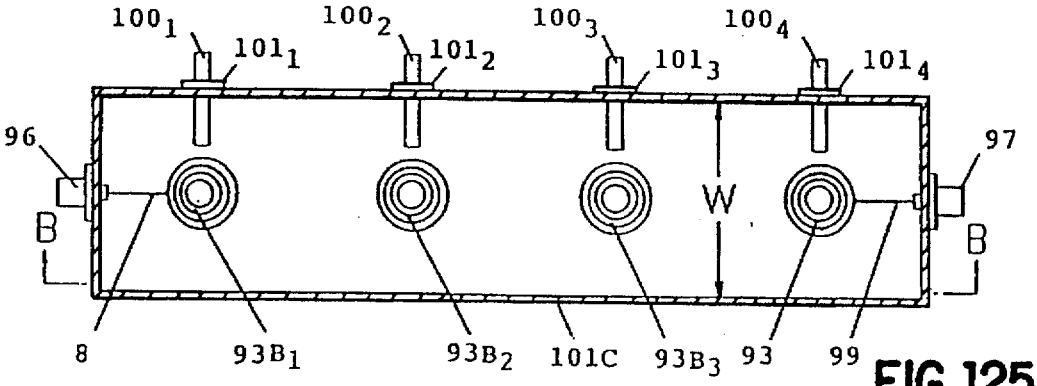
FIG. 125
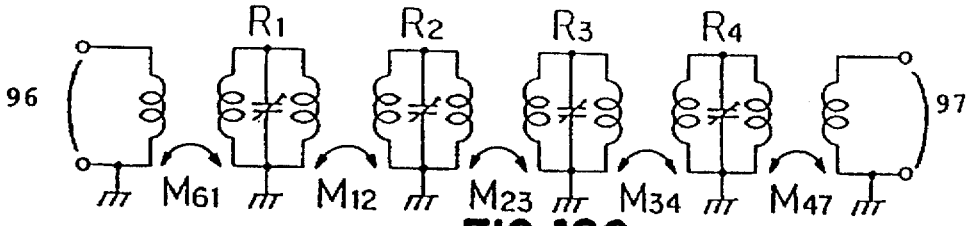
FIG. 126
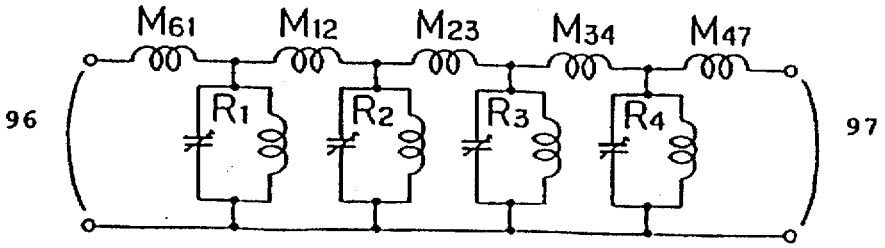
FIG. 127

RESONATOR WITH EXTERNAL CONDUCTOR AS RESONANCE INDUCTANCE ELEMENT AND MULTIPLE RESONATOR FILTER

TECHNICAL FIELD

The present invneiton relates to a resonator that is used for the elimination of noise, the splitting and synthesis of signals, etc., in radio communication devices, broadcast devices, and so on, and also relates to a filter comprising this resonator.

BACKGROUND ART

Resonators composed of capacitors and coils which are lumped-parameter circuit elements, or helical resonators have been conventionally used in relatively low frequency bands, such as short wave and ultrashort wave bands.

FIG. 1 is a vertical cross section of a conventional helical resonator, and FIG. 2 is a horizontal cross section thereof.

This helical resonator comprises an external conductor 201; a capacity formation electrode 203; insulators $\mathbf{204}_1$ and $\mathbf{204}_2$; a helical resonance element 202 at one end mechanically fixed to and electrically connected with the inside wall of the external conductor 201, wound coil-like in its middle portion, attached at the other end to the capacity formation electrode 203, and fixed to the inside wall of the external conductor 201 via the insulators $\mathbf{204}_1$ and $\mathbf{204}_2$; a movable electrode 205; a drive screw 206 to one end of which the movable electrode 205 is attached, and which passes through the external conductor 201; a lock nut 207 that is used to fix the drive screw 206 to the external conductor 201; and input/output coupling elements and input/output terminals (not shown).

With this helical resonance element, the resonance frequency can be finely tuned by rotating the drive screw 206 forward or backward to move the movable electrode 205 ahead or back so that the capacity of the electrode 203 can be varied.

The conventional resonator described above has the following drawbacks.

Since the helical resonance element 202 is formed by the winding of a metallic wire or a relatively thin rod-shaped conductor in the form of a coil, not only is the heat-radiating surface area of the helical resonance element 202 itself small, but the thermal conductivity into the external conductor 201 is poor, so the heat produced by power loss in the helical resonance element 202 is not effectively radiated from the helical resonance element 202 and the external conductor 201, and the resonance frequency fluctuates as a result of distortion due to the elevated temperature of the various constituent components of the resonator.

The ends of the helical resonance element 202 are directly or indirectly supported by and fixed to the inside wall of the external conductor 201, but the middle portion is not supported by any support, and is instead formed so that it maintains a coiled posture by its own rigidity, so vibration resistance is poor, fabrication is difficult, and the cost is high.

When the diameter of the wire or rod that forms the helical resonance element 202 is relatively large, distortion of the helical resonance element 202 itself due to the elevated temperature of the helical resonance element 202 repeatedly applies mechanical strain to the insulators $\mathbf{204}_1$ and $\mathbf{204}_2$ through the electrode 203, and in severe cases the insulators $\mathbf{204}_1$ and $\mathbf{204}_2$ would be broken.

Because of its high impedance, a helical resonance element has inferior withstand voltage characteristics.

When a filter is constructed from such a helical resonance element, the various above-mentioned drawbacks encountered with a helical resonance element appears as drawbacks directly in the filter.

DISCLOSURE OF THE INVENTION

It is object of the present invention to provide a resonator in which heat is effectively radiated away from the resonance capacity element and external conductor, the fluctuation in resonance frequency is extremely small, the vibration resistance is excellent, and the impedance is low, and to provide a filter in which this resonator is used.

A resonator according to the present invention comprises:

an external conductor;

a resonance capacity element comprising a dielectric plate fixed at the upper and lower ends to the upper and lower walls, respectively, of the external conductor, and electrodes made of a metal plate or a metal thin layer provided on the front and back sides of the dielectric plate, wherein the lower end of one of the electrodes is electrically connected to the lower wall of the external conductor, and a gap is formed between the upper end of the electrode and the upper wall of the external conductor, while the upper end of the other electrode is electrically connected to the upper wall of the external conductor, and a gap is formed between the lower end of the other electrode and the lower wall of the external conductor;

an input terminal;

an output terminal; and means for connecting one of the electrodes of the resonance capacity element to the input terminal and the output terminal in a high-frequency fashion.

Another resonator according to the present invention comprises:

an external conductor;

a resonance capacity element comprising a dielectric plate fixed at the upper and lower ends to the upper and lower walls, respectively, of the external conductor, and electrodes made of a metal plate or a metal thin layer provided on the front and back sides of the dielectric plate, wherein the lower end of one of the electrodes is electrically connected to the lower wall of the external conductor, and a gap is formed between the upper end of said one electrode and the upper wall of the external conductor, while the upper end of the other electrode is electrically connected to the upper wall of the external conductor, and a gap is formed between the lower end of said other electrode and the lower wall of the external conductor;

an input terminal;

an output terminal;

two inductance elements or two capacity elements for the compensation of transmission characteristics connected in series between the input terminal and the output terminal; and means for connecting one of the electrodes of the resonance capacity element to the connection point of the two inductance elements or the two capacity elements in a high-frequency fashion.

A filter according to the present invention comprises:

a common external conductor;

a plurality of resonance capacity elements connected in series in a high-frequency fashion and comprising a plurality of dielectric plates provided at suitable intervals in the external conductor and fixed at the upper and lower ends to the upper and lower walls, respectively, of the external conductor, and electrodes made of a metal plate or a metal thin layer provided on the front and back sides of each dielectric plate, wherein the lower end of one of the electrodes is electrically connected to the lower wall of the external conductor, and a gap is formed between the upper end of said one electrode and the upper wall of the external conductor, while the upper end of the other electrode is electrically connected to the upper wall of the external conductor, and a gap is formed between the lower end of the other electrode and the lower wall of the external conductor;

an input terminal;

an output terminal;

means for connecting one of the electrodes of the top resonance capacity element of the plurality of resonance capacity elements to the input terminal in a high-frequency fashion; and means for connecting one of the electrodes of the last resonance capacity element of the plurality of resonance capacity elements to the output terminal in a high-frequency fashion.

Another resonator according to the present invention comprises:

an external conductor;

a variable resonance capacity element comprising a hollow cylinder composed of a solid dielectric whose lower end portion is fixed to the lower wall of said external conductor and whose upper end portion faces the upper wall of the external conductor a suitable distance away, a fixed electrode composed of a metal thin layer that adheres around the outer surface of the hollow cylinder and whose lower end portion is electrically connected to the lower wall of the external conductor, and a hollow or solid cylindrical movable electrode that is coaxial with the fixed electrode and is attached to the upper wall of the external conductor so that the insertion length of the movable electrode into the hollow cylinder can be varied;

an input terminal;

an output terminal; and means for connecting the fixed electrode to the input terminal and the output terminal in a high-frequency fashion.

Another resonator according to the present invention comprises:

an external conductor;

a variable resonance capacity element comprising a hollow cylinder composed of a solid dielectric whose lower end portion is fixed to the lower wall of the external conductor and whose upper end portion faces the upper wall of the external conductor a suitable distance away, a fixed electrode composed of a metal thin layer that adheres around the outer surface of the hollow cylinder and whose lower end portion is electrically connected to the lower wall of the external conductor, and a hollow or solid cylindrical movable electrode that is coaxial with the fixed electrode and is attached to the upper wall of the external conductor so that the insertion length of the movable elctrode into the hollow cylinder can be varied;

an input terminal;

an output terminal;

two inductance elements or two capacity elements for the compensation of transmission characteristics connected in series between the input terminal and the output terminal; and means for connecting the fixed electrode to the connecting point of the two inductance elements or the two capacity elements in a high-frequency fashion.

Another filter according the present invention comprises:

an external conductor;

a plurality of variable resonance capacity elements connected in series in a high-frequency fashion and comprising a plurality of hollow cylinders provided at suitable intervals and composed of a solid dielectric whose lower end portion is fixed to the lower wall of the external conductor and whose upper end portion faces the upper wall of the external conductor a suitable distance away, a fixed electrode composed of a metal thin layer that is provided on each of the hollow cylinder, adheres around the outer surface of the hollow cylinders, and whose lower end portion is electrically connected to the lower wall of the external conductor, and a hollow or solid cylindrical movable electrode that is coaxial with the fixed electrode and is attached to the upper wall of the external conductor so that the insertion length of the movable electrode into the hollow cylinder can be varied;

an input terminal;

an output terminal;

means for connecting the top resonance capacity element of the plurality of resonance capacity elements to the input terminal in a high-frequency fashion; and means for connecting the last resonance capacity element of the plurality of resonance capacity elements to the output terminal in a high-frequency fashion.

A resonator according to the present invention comprises:

an external conductor;

a variable resonance capacity element comprising of a fixed electrode composed of a hollow cylindrical conductor whose lower end portion is fixed to the lower wall of the external conductor and whose upper end portion faces the upper wall of the external conductor a suitable distance away and a movable electrode composed of a hollow or solid cylindrical conductor that is coaxial with the fixed electrode and is attached to the upper wall of the external conductor so that the insertion length of the movable electrode into the fixed electrode can be varied;

an input terminal;

an output terminal; and means for connecting the fixed electrode to the input terminal and the output terminal in a high-frequency fashion.

Another filter according to the present invention comprises:

an external conductor;

a plurality of variable resonance capacity elements connected in series in a high-frequency fashion, provided at suitable intervals, and comprising of a fixed electrode composed of a hollow cylindrical conductor whose lower end portion is fixed to the lower wall of the external conductor and whose upper end portion faces the upper wall of the external conductor a suitable distance away and a movable electrode composed of a hollow or solid cylindrical conductor that is coaxial with the fixed electrode and is attached to the upper wall of the external conductor so that the insertion length of the movable electrode into the fixed electrode can be varied;

an input terminal;

an output terminal;

means for connecting the fixed electrode of the top resonance capacity element of the plurality of resonance capacity elements to the input terminal in a high-frequency fashion; and means for connecting the fixed electrode of the last resonance capacity element of the plurality of resonance capacity elements to the output terminal in a high-frequency fashion.

Another resonator according to the present invention comprises:

an external conductor;

a variable resonance capacity element comprising a hollow cylinder composed of a solid dielectric whose upper and lower end portions face the upper and lower walls, respectively, of the external conductor a suitable distance away, first fixed electrode composed of a metal thin layer that adheres around the inner surface of the hollow cylinder and whose lower end portion is electrically connected to the lower wall of the external conductor, a second fixed electrode composed of a metal thin layer that adheres around the outer surface of hollow cylinder and whose upper end portion is electrically connected to the upper wall of the external conductor, and a hollow or solid cylindrical movable electrode that is coaxial with the first and second fixed electrodes and is attached to the upper wall of the external conductor so that the insertion length into the above-mentioned hollow cylinder can be varied;

an input terminal;

an output terminal; and means for connecting the second fixed electrode to the input terminal and the output terminal in a high-frequency fashion.

Another resonator according to the present invention comprises:

an external conductor;

a variable resonance capacity element comprising a hollow cylinder composed of a solid dielectric whose upper and lower end portions face the upper and lower walls, respectively, of the external conductor a suitable distance away, a first fixed electrode composed of a metal thin layer that adheres around the inner surface of the hollow cylinder and whose lower end portion is electrically connected to the lower wall of the external conductor, a second fixed electrode composed of a metal thin layer that adheres around the outer surface of the hollow cylinder and whose upper end portion is electrically connected to the upper wall of the external conductor, and a hollow or solid cylindrical movable electrode that is coaxial with the first and second fixed electrodes and is attached to the upper wall of the external conductor so that the insertion length of the movable electrode into the hollow cylinder can be varied;

an input terminal;

an output terminal;

two inductance elements or two capacity elements for the compensation of transmission characteristics connected in series between the input terminal and the output terminal; and means for connecting the second fixed electrode to the connecting point of the two inductance elements or the two capacity elements in a high-frequency fashion.

Another filter according to the present invention comprises:

a common external conductor;

a plurality of variable resonance capacity elements connected in series in a high-frequency fashion and comprising a hollow cylinder composed of a solid dielectric whose upper and lower end portions face the upper and lower walls, respectively, of the external conductor a suitable distance away, a first fixed electrode composed of a metal thin layer that adheres around the inner surface of the said hollow cylinder and whose lower end portion is electrically connected to the lower wall of the external conductor, a second fixed electrode composed of a metal thin layer that adheres around the outer surface of the hollow cylinder and whose upper end portion is electrically connected to the upper wall of the external conductor, and a hollow or solid cylindrical movable electrode that is coaxial with the first and second fixed electrodes and is attached to the upper wall of the external conductor so that the insertion length of the movable electrode into the hollow cylinder can be varied;

an input terminal;

an output terminal; and means for connecting the second fixed electrode of the top resonance capacity element of the plurality of resonance capacity elements to the input terminal in a high-frequency fashion; and means for connecting the second fixed electrode of the last resonance capacity element of the plurality of resonance capacity elements to the output terminal in a high-frequency fashion.

Another resonator according to the present invention comprises:

an external conductor;

a variable resonance capacity element comprising a first fixed electrode composed of a metal hollow cylinder whose lower end portion is fixed to the lower wall of the external conductor, a second fixed electrode composed of a metal hollow cylinder that is provided coaxially with the first fixed electrode with a gap on the outside of the first fixed electrode, and whose upper end portion is fixed to the upper wall of the external conductor, and a hollow or solid cylindrical movable electrode that is coaxial with the first and second fixed electrodes and is attached to the upper wall of the external conductor so that the insertion length of the movabe electrode into the first fixed electrode can be varied;

an input terminal;

an output terminal; and means for connecting the second fixed electrode to the input terminal and the output terminal in a high-frequency fashion.

Another resonator according to the present invention comprises:

an external conductor;

a variable resonance capacity element comprising a first fixed electrode composed of a metal hollow cylinder whose lower end portion is fixed to the lower wall of the external conductor, a second fixed electrode composed of a metal hollow cylinder that is provided coaxially with the first fixed electrode with a gap on the outside of said first fixed electrode, and whose upper end portion is fixed to the upper wall of the external conductor, and a hollow or solid cylindrical movable electrode that is coaxial with the first and second fixed electrodes and is attached to the upper wall of the external conductor so that the insertion length of the movable electrode into the first fixed electrode can be varied;

an input terminal;

an output terminal;

two inductance elements or two capacity elements for the compensation of transmission characteristics connected in series between the input terminal and the output terminal; and means for connecting the second fixed electrode to the connection point of the two inductance elements or the two capacity elements in a high-frequency fashion.

Another filter according to the present invention comprises:

a common external conductor;

a plurality of variable resonance capacity elements connected in series in a high-frequency fashion, provided at suitable intervals and comprising a first fixed electrode composed of a metal hollow cylinder whose lower end portion is fixed to the lower wall of the external conductor, a second fixed electrode composed of a metal hollow cylinder that is provided coaxially with the first fixed electrode with a gap on the outside of the first fixed electrode, and whose upper end portion is fixed to the upper wall of the external conductor, and a hollow or solid cylindrical movable electrode that is coaxial with the first and second fixed electrodes and is attached to the upper wall of the external conductor so that the insertion length of the movable electrode into the first fixed electrode can be varied;

an input terminal;

an output terminal;

means for connecting the second fixed electrode of the top resonance capacity element of the plurality of resonance capacity elements to the input terminal in a high-frequency fashion; and means for connecting the second fixed electrode of the last resonance capacity element of the plurality of resonance capacity elements to the output terminal in a high-frequency fashion.

The resonator according to the present invention has good thermal conductivity between the resonance capacity element and the external conductor because of the relatively large thermal radiation surface area of the resonance capacity element, so heat is effectively radiated from the resonance capacity element and the external conductor, and therefore the rise in the temperature of the various resonator components is kept low and there is extremely little fluctuation in resonance frequency caused by distortion of the components as a result of elevated temperature. Furthermore, the structure is extremely simple and mechanically tough, so the product has excellent vibration resistance. The withstand voltage characteristics are also good because of the low impedance of the resonator. These same advantages are realized with a filter that incorporates the resonator according to the present invention.

Further, in the case of a resonator formed with variable capacity by means of fixed and movable electrodes, the range over which the capacity can be varied is wider and the resonance frequency can be set over a wider range, so resonators with a greater variety of resonance frequencies can be formed using parts of the same configurations and the same dimensions, and the costs entailed can therefore be lowered.

BRIEF DESCRIPTION OF THE DRAWINGS

FIG. 1 is a vertical cross section of a conventional resonator.

FIG. 2 is a horizontal cross section of a conventional resonator.

FIG. 27 is a vertical cross section of a filter constructed using the resonator shown in FIG. 11;

FIG. 28 is an equivalent circuit diagram of the filter shown in FIG. 27;

FIG. 29 is an equivalent circuit diagram of a filter constructed using the resonator shown in FIG. 14;

FIG. 68 is a vertical cross section of a filter constructed using the resonator shown in FIG. 46;

FIG. 69 is a horizontal cross section of a filter constructed using the resonator shown in FIG. 46;

FIG. 70 is an equivalent circuit diagram of the filter shown in FIGS. 68 and 69;

FIG. 71 is a converted equivalent circuit diagram of the equivalent circuit diagram shown in FIG. 70;

FIG. 120 is a vertical cross section of an embodiment in which the coupling element 110 in the practical example shown in FIG. 109 has been replaced with a probe 104;

FIG. 121 is a vertical cross section of an embodiment in which the coupling element 110 in the embodiment shown in FIG. 108 has been replaced with a loop 106;

FIG. 122 is a vertical cross section of an embodiment in which the coupling element 110 in the embodiment shown in FIG. 114 has been replaced with a probe 104;

FIG. 123 is a vertical cross section of an embodiment in which the coupling element 110 in the embodiment shown in FIG. 114 has been replaced with a loop 106;

FIG. 124 is a vertical cross section of a filter constructed using the resonator shown in FIG. 102;

FIG. 125 is a horizontal cross section of a filter constructed using the resonator shown in FIG. 102;

FIG. 126 is an equivalent circuit diagram of the filter shown in FIGS. 124 and 125;

FIG. 127 is a converted equivalent circuit diagram of the equivalent circuit diagram shown in FIG. 126;

FIG. 128 is a diagram illustrating an example of the relation between the interstage magnetic field coupling coefficient and the interval of the centers of adjacent resonance capacity elements;

FIG. 129 is a vertical cross section of a band-pass filter in which the interstage coupling consists of electric field coupling;

FIG. 130 is an equivalent circuit diagram of the band-pass filter shown in FIG. 129;

FIG. 131 is a converted equivalent circuit diagram of the equivalent circuit diagram shown in FIG. 130.

Figure 132:
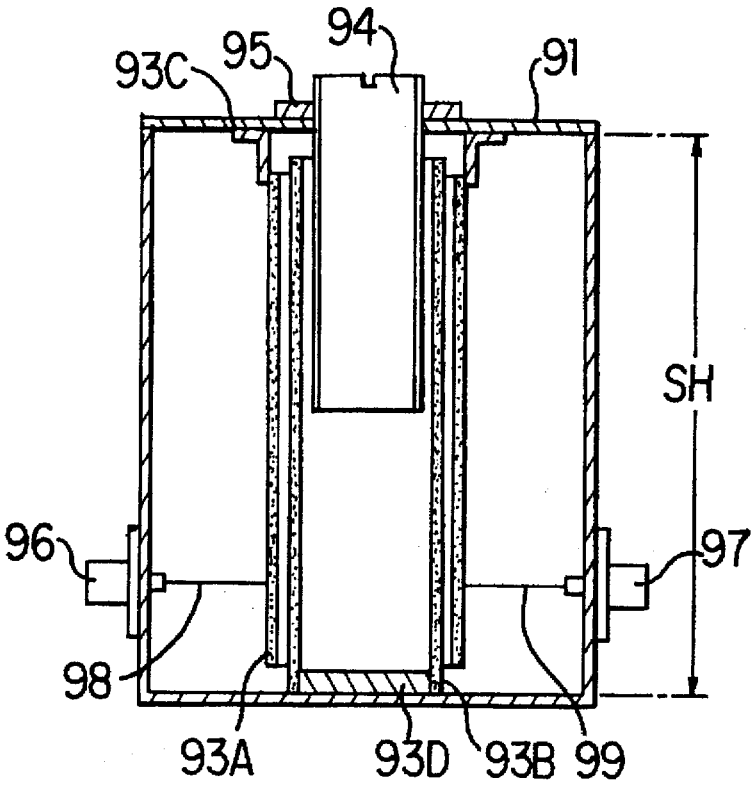
Figure 133:
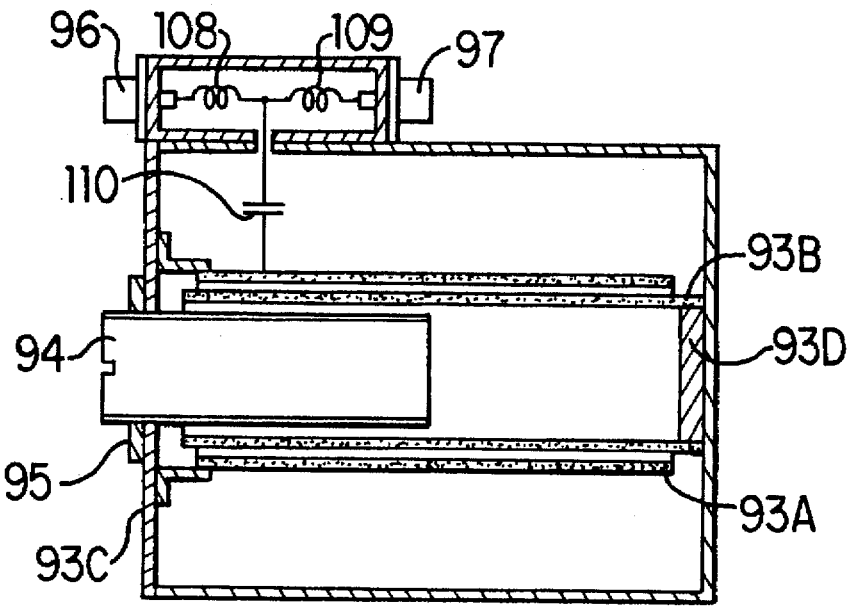

FIG. 132 is a vertical cross section of a resonator according to an embodiment of the invention; and FIG. 133 is a vertical cross section of a resonator according to another embodiment of the invention.

BEST MODE FOR IMPLEMENTING THE INVENTION

Figure 3:
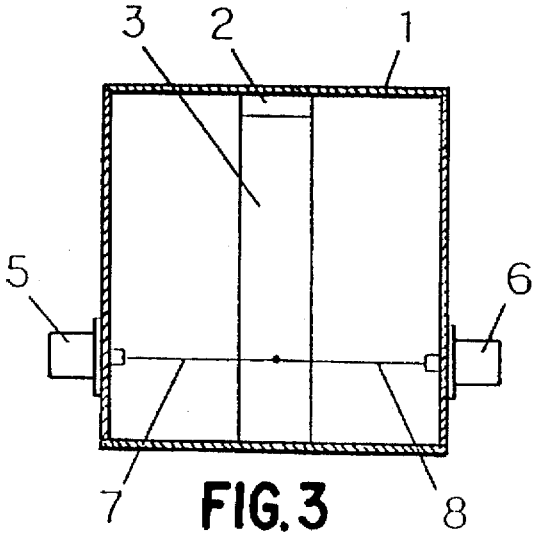
FIG. 3 is a vertical cross section of the resonator of the first embodiment according to the present invention.
Figure 4:
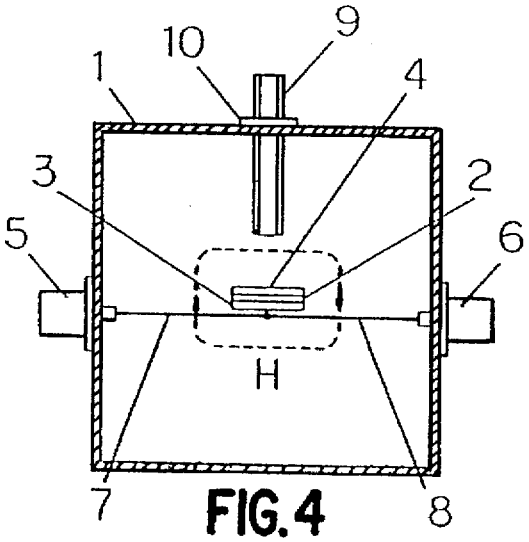
FIG. 4 is a horizontal cross section of the resonator of the first embodiment.
Figure 5:
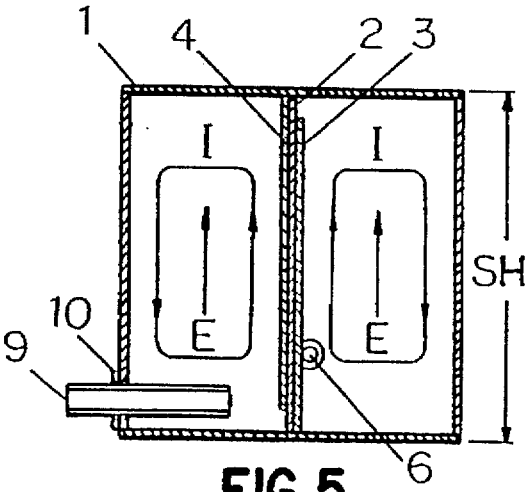
FIG. 5 is a vertical cross section of the resonator of the first embodiment, rotated 90° from FIG. 3.

FIG. 3 is a vertical cross section of the resonator of the first embodiment according to the present invention, FIG. 4 is a horizontal cross section thereof, and FIG. 5 is a vertical cross section rotated 90° from FIG. 3.

The resonator of this embodiemnt comprises a cubic external conductor 1, a slender ribbon-shaped dielectric plate 2, capacity formation electrodes 3 and 4, an input terminal 5, an output terminal 6, an input coupling wire 7, an output coupling wire 8, a resonance frequency fine-tuning element 9, and a lock nut 10 that is used to fix the fine-turning element 9. The external conductor 1 may also be a bottomed cylinder.

The upper and lower ends of the dielectric plate 2 are fixed by an adhesive agent or other suitable means to the upper and lower walls, respectively, of the external conductor 1.

The capacity formation electrodes 3 and 4 are made of metal thin layers bonded to the front and back of the dielectric plate 2, or of metal plates applied to the front and back of the dielectric plate 2. As shown in FIG. 5, regardless of whether the capacity formation electrodes 3 and 4 are made of a metal thin layer or a metal plate, the lower end of one of the electrodes (in this case the capacity formation electrode 3) is electrically connected to the lower wall of the external conductor 1, and a gap of suitable width is provided between the upper end of the capacity formation electrode 3 and the upper wall of the external conductor 1 so that both may not be electrically connected each other. The upper end of the capacity formation electrode 4 is electrically connected to the upper wall of the external conductor 1, and a gap of suitable width is provided between the lower end of the capacity formation electrode 4 and the lower wall of the external conductor 1 so that both may not be electrically connected each other.

The input terminal 5 and the output terminal 6 both consist of coaxial plugs, for example, and the external conductor that forms each coaxial plug is connected to the external conductor 1. One end of the input coupling wire 7 is connected to the internal conductor of the input terminal 5, and the other end is connected to the capacity formation electrode 3. One end of the output coupling wire 8 is connected to the internal conductor of the output terminal 6, and the other end is connected to the capacity formation electrode 3. The fine-tuning element 9 is in this case made of a metal screw threaded into the wall of the external conductor 1.

Figure 6:
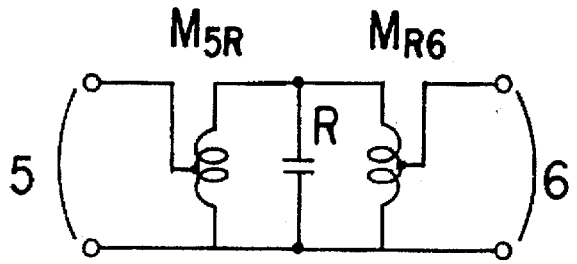
FIG. 6 is an equivalent circuit diagram of the first embodiment.

In the resonator constructed in this manner, a parallel resonance circuit whose equivalent circuit is shown in FIG. 6, is composed of the distributed inductance resulting from the external conductor 1 and the capacity of the resonance capacity element formed by the dielectric plate 2 and the capacity formation electrodes 3 and 4. In FIG. 6, a symbol R represents the resonance circuit, a symbol $M_{5R}$ represents the input magnetic field coupling coefficient, and a symbol $M_{R6}$ represents the output magnetic field coupling coefficient.

When high-frequency power is applied, for example, to the input terminal 5, the electromagnetic field distribution in this resonator becomes as shown in FIGS. 4 and 5. The broken line H marked with arrows in FIG. 4 represents the magnetic field, the solid arrowed line E in FIG. 5 represents the electric field vector, and the solid arrowed line I represents the current.

Since the inductance is relatively small, and the capacity is relatively large in this resonator, this resonator is a low impedance type with good withstand voltage characteristics.

If a material with a high dielectric constant and a dielectric loss that is nearly zero is used as the dielectric plate 2 in the resonance capacity element, then the Q ($Q_d$) of the resonance capacity element consisting of the dielectric plate 2 and the capacity formation electrodes 3 and 4 can be ignored. Since the electromagnetic energy that can be accumulated in this resonator will correspond to the volume of the external conductor 1, and the resistance in the metal portion of this resonator can be kept extremely low, an extremely large unloaded Q can be obtained.

The magnitude of the unloaded Q ($Q_u$) when the external conductor 1 and the capacity formation electrodes 3 and 4 are made of copper in this resonator will vary with the ratio of the inductance to the capacity in the resonator. The inventor was able to obtain the following experimental equation for unloaded Q ($Q_u$) through the use of prototypes.

$$Q_u \approx 20 f_0^{1/2} \cdot SH \quad (1)$$

where $f_0$ is resonance frequency (MHz) and SH is the height (cm) of the external conductor 1 (see FIG. 5).

Figure 7:
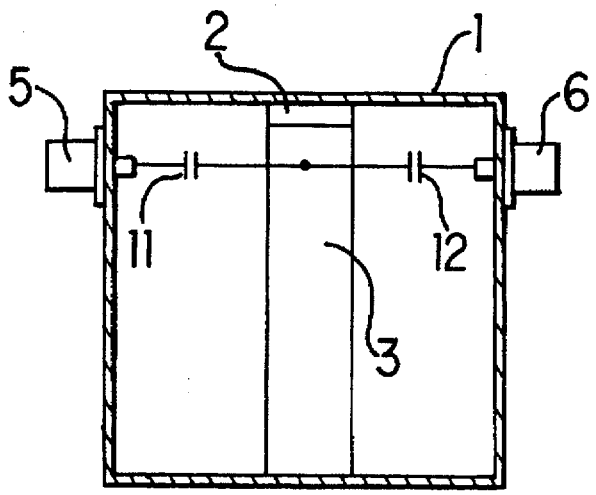
FIG. 7 is a diagram illustrating an example in the first embodiment in which the input terminal 5 and the capacity formation electrode 3 are capacitively coupled by the capacity element 11, and the output terminal 6 and the capacity formation electrode 4 by the capacity element 12.
Figure 8:
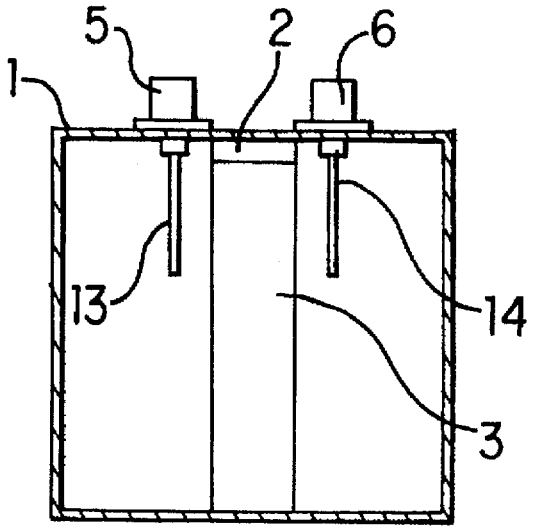
FIG. 8 is a diagram illustrating an example in the first embodiment in which probes 13 and 14 are used as the input/output coupling means.

In this embodiment, tap coupling with the coupling wires 7 and 8 was given as an example of means for coupling in a high-frequency fashion the input terminal 5 with the capacity formation electrode 3, and the output terminal 6 with the capacity formation electrode 3. However, means for capacitively coupling the input terminal 5 with the capacity formation electrode 3 via the capacity element 11 and means for capacitively coupling the output terminal 6 with the capacity formation 3 via the capacity element 12 may also be used, as shown in FIG. 7. In addition, probes 13 and 14 may be used as the input/output coupling means, as shown in FIG. 8.

Figure 9:
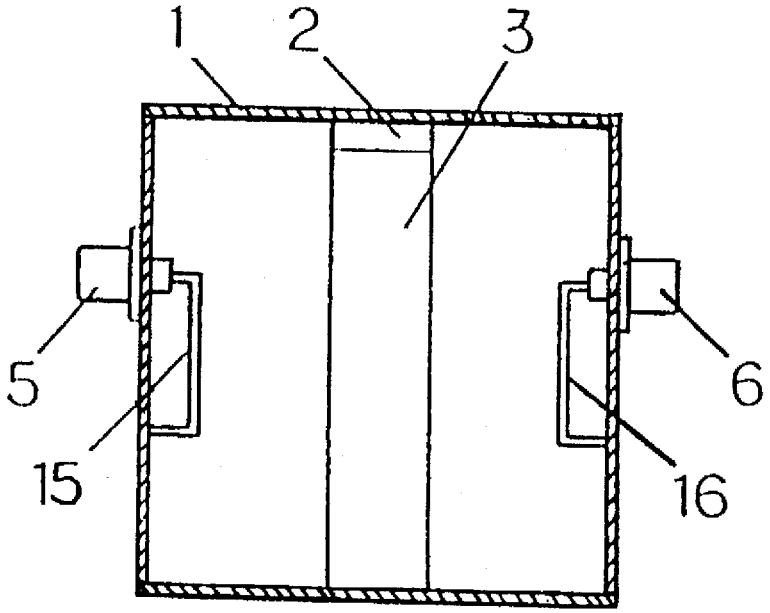
FIG. 9 is a vertical cross section of a resonator in which loops 15 and 16 are used as the input/output coupling means in the first embodiment.
Figure 10:
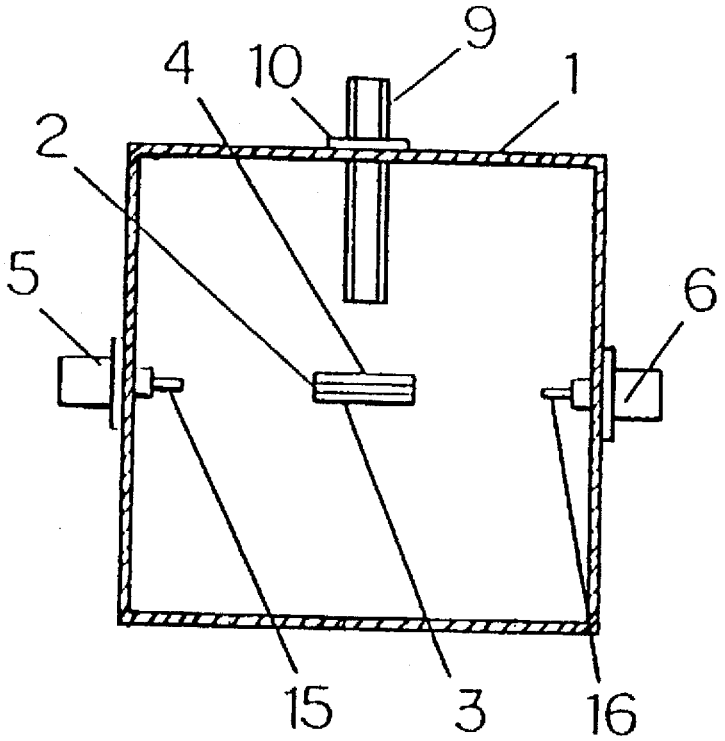
FIG. 10 is a horizontal cross section of a resonator in which loops 15 and 16 are used as the input/output coupling means in the first embodiment.

Loops 15 and 16 may also be used as the input/output coupling means, as shown in FIGS. 9 and 10 which are the vertical cross section and the horizontal cross section, respectively, of the resonator.

The above descriptions are all for a case in which the capacity formation electrode 3 that forms the resonance capacity element is coupled in high-frequency fashion to the input terminal 5 and the output terminal 6. However, the present invention can also be implemented with a structure in which the capacity formation electrode 4 is coupled in high-frequency fashion to the input terminal 5 and the output terminal 6.

In FIGS. 7 through 10, the reference numerals that are the same as in FIG. 1 indicate the same elements.

Figure 11:
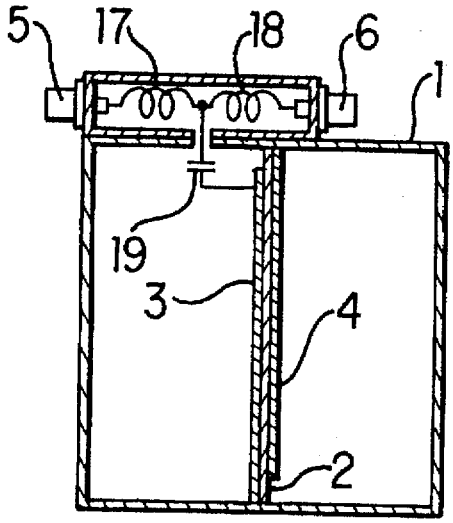
FIG. 11 is a vertical cross section of the resonator of the second embodiment according to the present invention.
Figure 12:
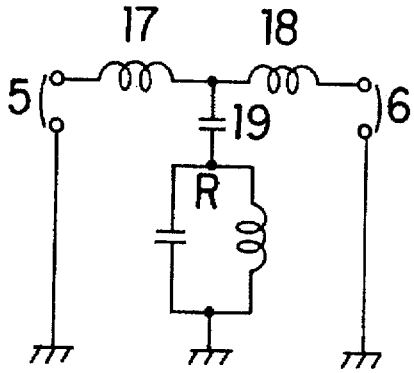
FIG. 12 is an equivalent circuit diagram of the second embodiment.
Figure 13:
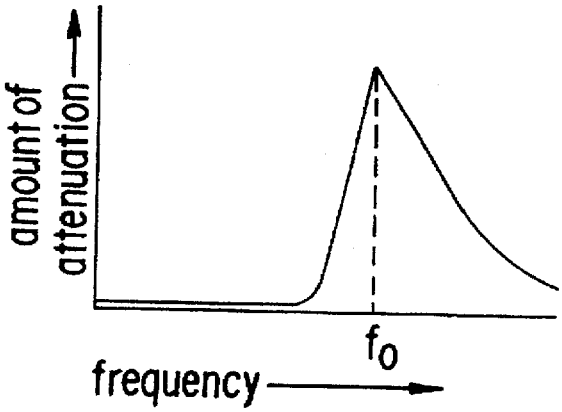
FIG. 13 is a diagram illustrating the transmission characteristics of the second embodiment.

FIG. 11 is a vertical cross section of the resonator of the second embodiment according to the present invention, FIG. 12 is an equivalent circuit diagram thereof, and FIG. 13 is a diagram illustrating the transmission characteristics thereof.

In this embodiment, a low-pass filter circuit is composed of inductance elements 17 and 18 for the compensation of transmission characteristics, interposed between the connection terminals 5 and 6 for an external circuit, and a capacity element 19 connected between the capacity formation electrode 3 and the connection point of the inductance elements 17 and 18. In this resonator, as shown by the transmission characteristics in FIG. 13 where the axis of abscissa represents the frequency and the axis of ordinate represents the amount of attenuation, the slope of the attenuation characteristic curve in the frequency region lower than the resonance frequency $f_0$ is steep, while the slope of the attenuation characteristic curve in the frequency region higher than the resonance frequency $f_0$ is gentle, and a transmission inhibition band is formed in the frequency region including the resonance frequency $f_0$.

The resonance frequency $f_0$ of the circuit composed of the resonance circuit R and the coupling-use capacity element 19 changes according to the capacity of the coupling-use capacity element 19. The fine tuning of the resonance frequency can also be performed by the provision of an adjustment element simlilar to the resonance frequency fine-tuning element 9, as shown in FIG. 4.

Figure 14:
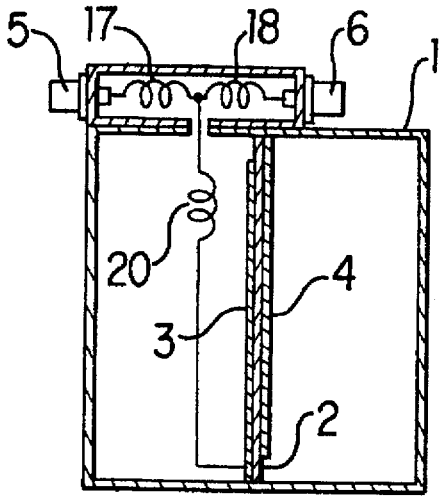
FIG. 14 is a vertical cross section of the resonator of the third embodiment according to the present invention.
Figure 15:
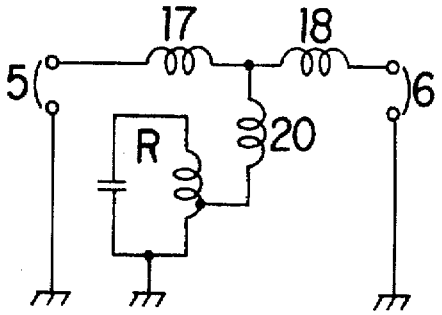
FIG. 15 is an equivalent circuit diagram of the third embodiment.
Figure 16:
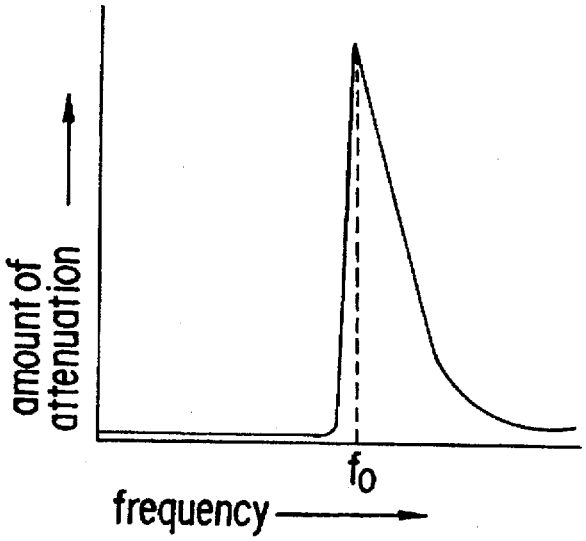
FIG. 16 is a diagram illustrating the transmission characteristics of the third embodiment.

FIG. 14 is a vertical cross section of the resonator of the third embodiment according to the present invention, FIG. 15 is an equivalent circuit diagram thereof, and FIG. 16 is a diagram illustrating the transmission characteristics thereof.

This embodiment differs from the second embodiment shown in FIG. 11 in that the coupling of the connection point of the inductance elements 17 and 18 with the capacity formation electrode is performed by tap coupling using an inductance element 20, and in that the resonance frequency $f_0$ of the circuit composed of the resonance circuit R and the coupling-use inductance element 20 changes according to the inductance of the inductance element 20. The rest of the structure and operation is substantially the same as in the second embodiment shown in FIG. 11.

Figure 17:
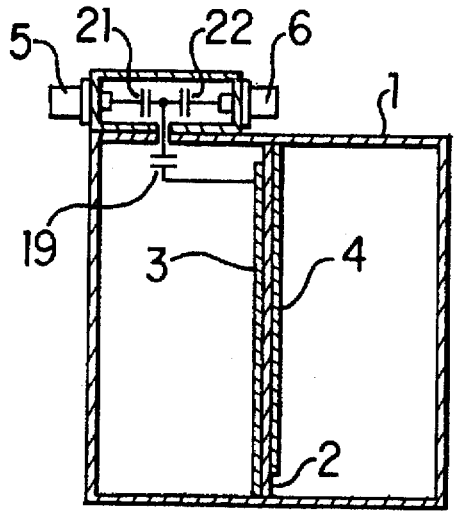
FIG. 17 is a vertical cross section of the resonator of the fourth embodiment according to the present invention.
Figure 18:
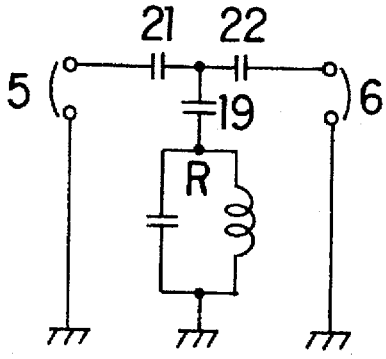
FIG. 18 is an equivalent circuit diagram of the fourth embodiment.
Figure 19:
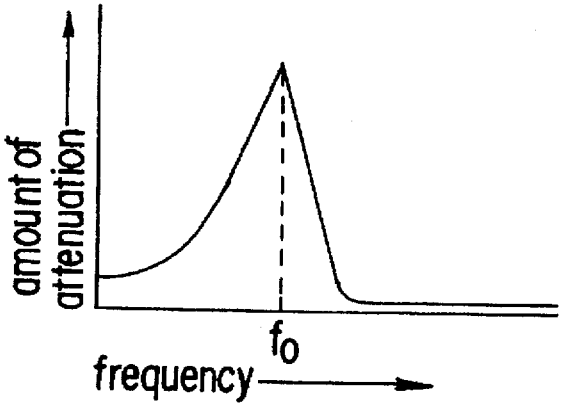
FIG. 19 is a diagram illustrating the transmission characteristics of the fourth embodiment.

FIG. 17 is a vertical cross section of the resonator of the fourth embodiment according to the present invention, FIG. 18 is an equivalent circuit diagram thereof, and FIG. 19 is a diagram illustrating the transmission characteristics thereof.

This embodiment differs from the second embodiment shown in FIG. 11 in that the inductance elements 17 and 18 in the second embodiment shown in FIG. 11 are replaced with capacity elements 21 and 22. The rest of the structure is the same as in the second shown in FIG. 11.

As shown in FIG. 19, in this embodiment, the slope of the attenuation characteristic curve in the frequency region lower than the resonance frequency $f_0$ is gentle, while the slope of the attenuation characteristic curve in the frequency region higher than the resonance frequency $f_0$ is steep, and a transmission inhibition band is formed in the frequency region including the resonance frequency $f_0$.

Figure 20:
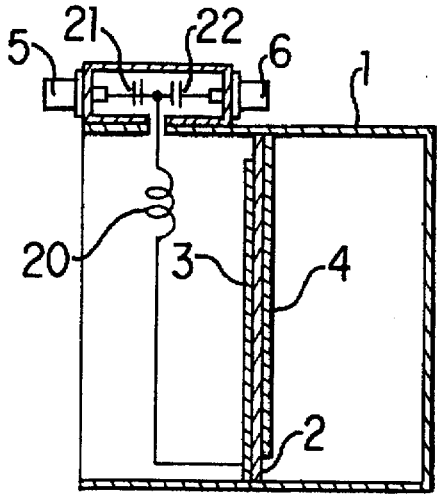
FIG. 20 is a vertical cross section of the resonator of the fifth embodiment according to the present invention.
Figure 21:
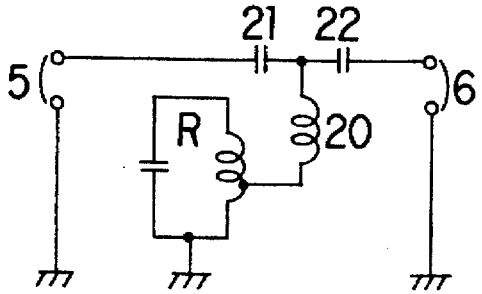
FIG. 21 is an equivalent circuit diagram of the fifth embodiment.
Figure 22:
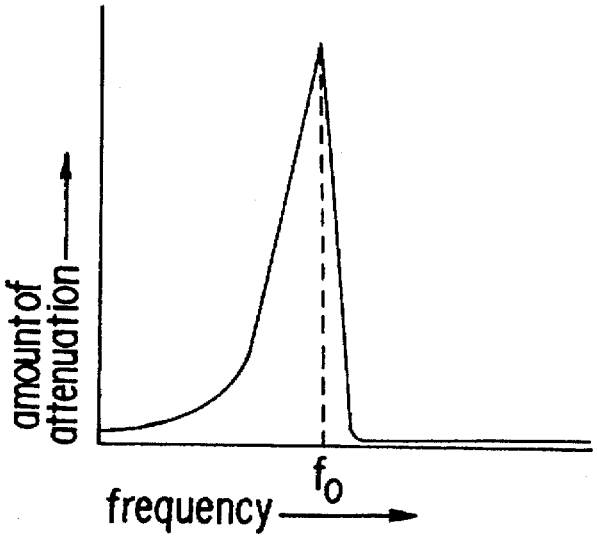
FIG. 22 is a diagram illustrating the transmission characteristics of the fifth embodiment.

FIG. 20 is a vertical cross section of the resonator of the fifth embodiment according to the present invention, FIG. 21 is an equivalent circuit diagram thereof, and FIG. 22 is a diagram illustrating the transmission characteristics thereof.

This embodiment is the same as the fourth embodiment shown in FIG. 17 in that the capacity elements 21 and 22 are used as transmission characteristic compensation elements, and is the same as the embodiment shown in FIG. 14 in that tap coupling is performed using the inductance element 20. The rest of the structure is the same as in the fourth embodiment shown in FIG. 17.

FIGS. 23, 24, 25, and 26 are vertical cross sections of the sixth, seventh, eighth, and ninth embodiments of the present invention, respectively.

Figure 23:
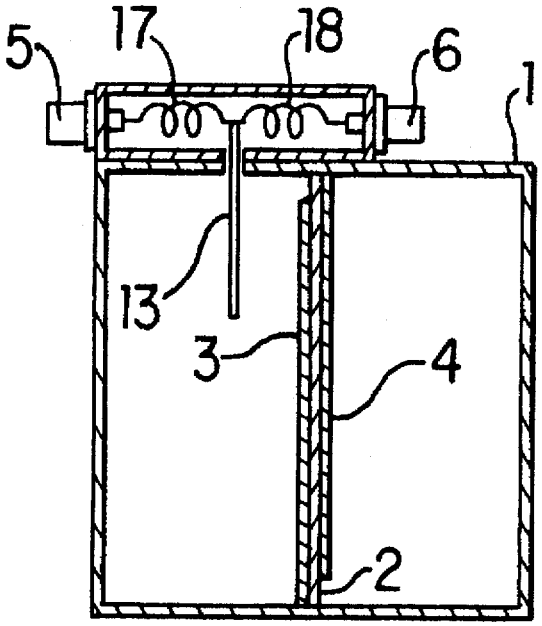
FIG. 23 is a vertical cross section of the resonator of the sixth embodiment according to the present invention.
Figure 24:
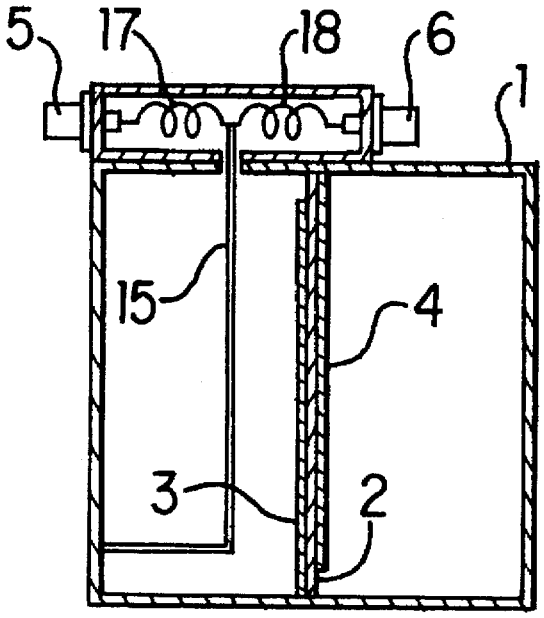
FIG. 24 is a vertical cross section of the resonator of the seventh embodiment of the present invention.
Figure 25:
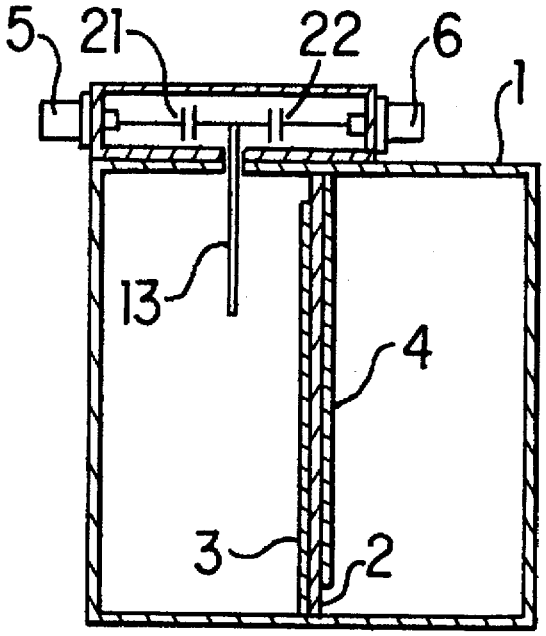
FIG. 25 is a vertical cross section of the resonator of the eighth embodiment according to the present invention.
Figure 26:
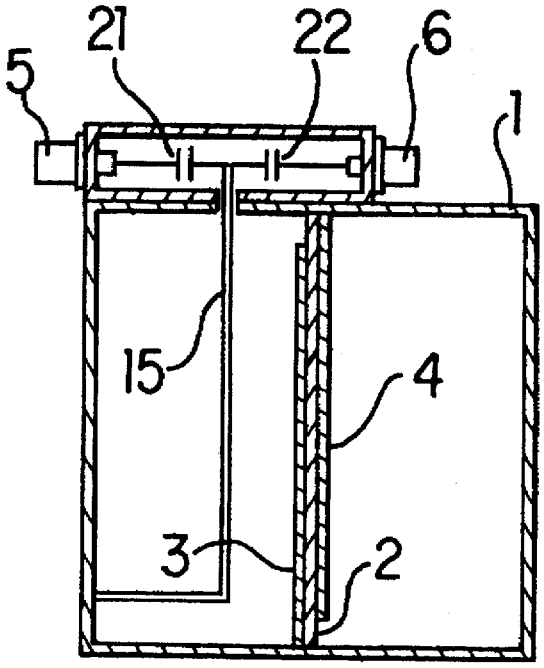
FIG. 26 is a vertical cross section of the resonator of the ninth embodiment according to the present invention.

The resonator shown in FIG. 23 has a probe 13 in place of the coupling element 19 of the second embodiment shown in FIG. 11; the resonator shown in FIG. 24 has a loop 15 in place of the coupling element 19 of the second embodiment shown in FIG. 11; the resonator shown in FIG. 25 has a probe 13 in place of the coupling element 19 of the fourth embodiment shown in FIG. 17; and the resonator shown in FIG. 26 has a loop 15 in place of the coupling element 19 of the fourth embodiment shown in FIG. 17. The rest of the structure in the respective Figs. is the same as the structure in FIG. 11 or 17.

FIG. 27 is a cross section of a filter constructed using a plurality of the resonators shown in FIG. 11.

This filter comprises an external conductor 1C, partition walls $1S_1$, $1S_2$, and $1S_3$, resonance capacity elements $CE_1$, $CE_2$, $CE_3$, and $CE_4$, external circuit connection terminals 5 and 6, inductance elements $17_1$, $18_1$, $17_2$, $18_2$, $17_3$, $18_3$, $17_4$, and $18_4$ for the compensation of transmission characteristics, and coupling capacity elements $19_1$, $19_2$, $19_3$, and $19_4$.

The resonance capacity elements $CE_1$ through $CE_4$ have the same structure as the resonance capacity element shown in FIG. 3. Specifically, electrodes made of a metal thin plate or a metal plate are provided on the front and back sides of a dielectric plate whose upper and lower ends are fixed to the upper and lower walls, respectively, of a common external conductor IC, the lower end of one of the electrodes is electrically connected to the lower wall of the common external conductor IC, and a gap is formed between the upper end of said one electrode and the upper wall of the common external conductor IC, while the upper end of the other electrode is electrically connected to the upper wall of the external conductor IC, and a gap is formed between the lower end of the other electrode and the lower wall of the external conductor IC.

FIG. 28 is an equivalent circuit diagram of the filter shown in FIG. 27. Symbols $R_1$ through $R_4$ represent resonance circuits composed of the common external conductor IC and the resonance capacity elements $CE_1$ through $CE_4$; reference numerals $17_1$, $187_1$ through $187_3$, and $18_4$ represent inductance elements for the compensation of transmission characteristics; the reference numeral $187_1$ represents a synthetic inductance element of the inductance elements $18_1$ and $17_2$ in FIG. 27; the reference numeral $187_2$ represents a synthetic inductance element of the inductance elements $18_2$ and $17_3$; the reference numeral $187_3$ represents a synthetic inductance element of the inductance elements $18_3$ and $17_4$; and reference numerals $19_1$ through $19_4$ represent coupling capacity elements.

The transmission characteristic of the filter shown in FIG. 27 is the superimposition of the transmission characteristics of the resonators at all stages composing this filter, that is, the superimposition of the transmission characteristics substantially the same as the transmission characteristics shown in FIG. 13. The resonance frequencies ($f_0$ in FIG. 13) of all stages composed of a resonator and a coupling-use capacity element are represented by $f_{01}$ through $f_{04}$, respectively. Suitable adjustment of these resonance frequencies such that they approach each other, for instance, allows a region of inhibition with a large amount of attenuation to be realized, while adjustment of these resonance frequencies $f_{01}$ through $f_{04}$ to adequately separated values allows a region of inhibition with a wide range of frequency to be realized.

FIG. 29 is an equivalent circuit diagram of a filter constructed using a plurality of the resonators shown in FIG. 14. The reference numerals $20_1$ through $20_4$ represent coupling-use inductance elements (tap coupling), and the rest of the symbols are the same as in FIG. 24.

The transmission characteristics of this filter represented by the equivalent circuit shown in FIG. 29, is the superimposition of the transmission characteristics of the resonators at all stages composing this filter, that is, the superimposition of the transmission characteristics substantially the same as the transmission characteristics shown in FIG. 16. Suitable adjustment of each resonance frequency allows the frequency range and the amount of attenuation in the synthesis inhibition region to be suitably adjusted.

Figure 30:
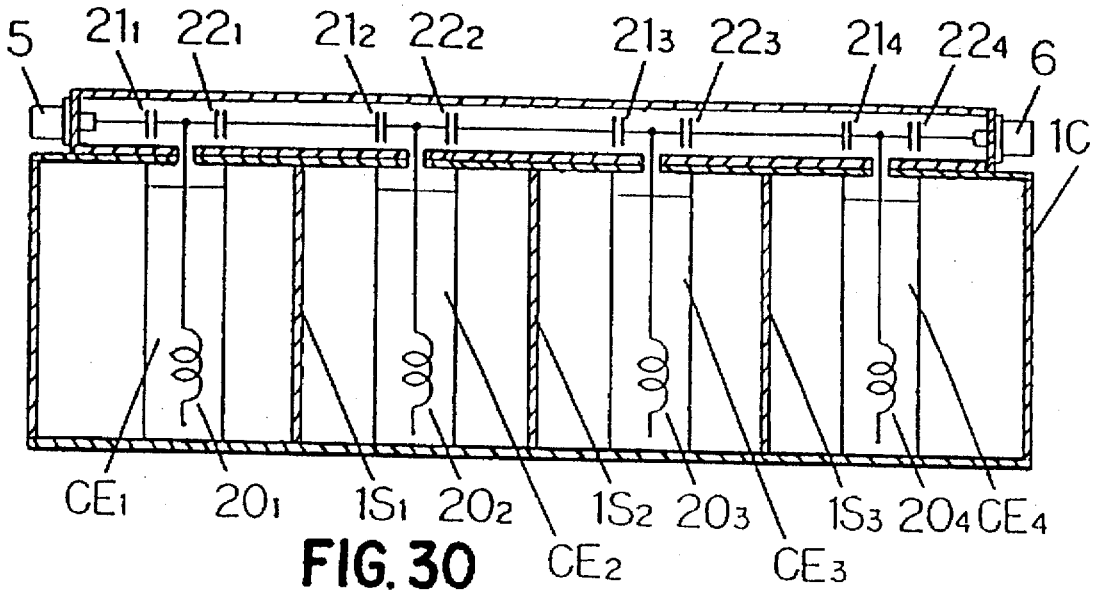
FIG. 30 is a vertical cross section of a filter constructed using the resonator shown in FIG. 20.

FIG. 30 is a vertical cross section of a filter constructed using the resonator shown in FIG. 20.

This filter comprises an external conductor 1C, partition walls $1S_1$, $IS_2$, and $1S_3$, resonance capacity elements $CE_1$, $CE_2$, $CE_3$, and $CE_4$, external circuit connection terminals 5 and 6, inductance elements $21_1$, $22_1$, $21_2$, $22_2$, $21_3$, $22_3$, $21_4$, and $22_4$ for the compensation of transmission characteristics, and inductance elements $20_1$, $20_2$, $20_3$, and $20_4$ for the tap coupling.

Figure 31:
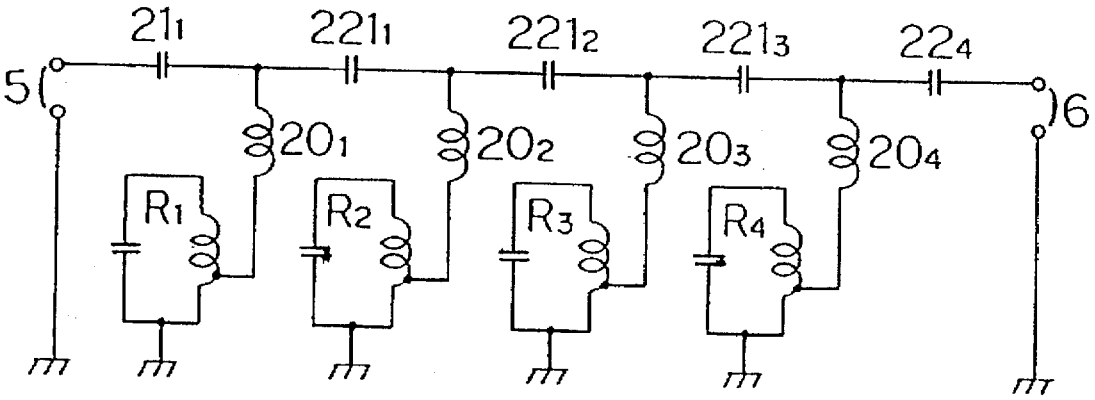
FIG. 31 is an equivalent circuit diagram of the filter shown in FIG. 30.

FIG. 31 is an equivalent circuit diagram of the filter shown in FIG. 30. Symbols $R_1$ through $R_4$ represent resonance circuits, reference numerals $21_1$, $221_1$ through $221_3$, and $22_4$ represent capacity elements for the compensation of transmission characteristics; the reference numerals $221_1$ represents a synthetic capacity element of the capacity elements $22_1$ and $21_2$ in FIG. 26; the reference numeral $221_2$ represents a synthetic capacity element of the capacity elements $22_2$ and $21_3$; the reference numeral $221_3$ represents a synthetic capacity element of the capacity elements $22_3$ and $21_4$; and reference numerals $20_1$ through $20_4$ represent inductance elements for tap coupling.

The transmission characteristics of the filter shown in FIG. 30 is the superimposition of the transmission characteristics of the resonators at all stages composing this filter, that is, the superimposition of the transmission characteristics substantially the same as the transmission characteristics shown in FIG. 22. Suitable adjustment of these resonance frequencies allows the frequency range and the amount of attenuation in the synthesis inhibition region to be suitably adjusted.

Figure 32:
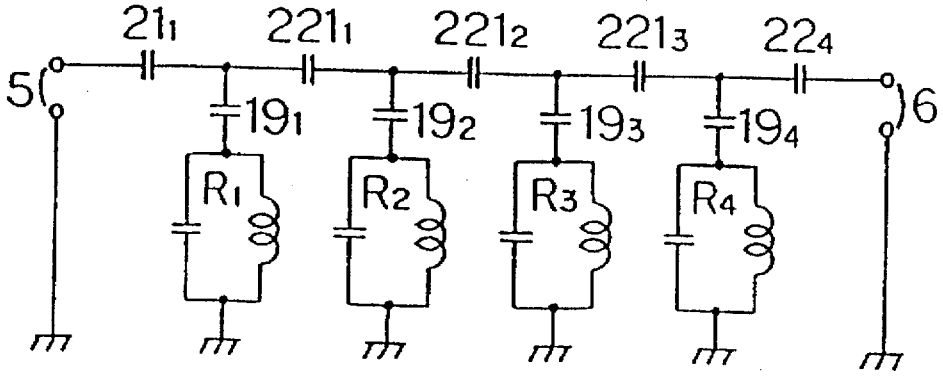
FIG. 32 is a vertical cross section of a filter constructed using the resonator shown in FIG. 17.

FIG. 32 is an equivalent circuit diagram of a filter constructed using the resonator shown in FIG. 17. Reference numerals $19_1$ through $19_4$ represent coupling-use capacity elements, and the rest of the symbols are the same as in FIG. 31.

The transmission characteristics of this filter expressed by the equivalent circuit shown in FIG. 32, is the superimposition of the transmission characteristics of the resonators at all stages composing this filter, that is, the superimposition of the transmission characteristics substantially the same as the transmission characteristics shown in FIG. 19. Suitable adjustment of these resonance frequencies allows the frequency range and the amount of attenuation in the synthesis inhibition region to be suitably adjusted.

Although FIGS. 27 through 32 illustrate examples in which four resonance capacity elements are provided, that is, when the order n of the circuit is 4, the present invention can also be implemented when order of the circuit is suitably increased or decreased.

Figure 33:
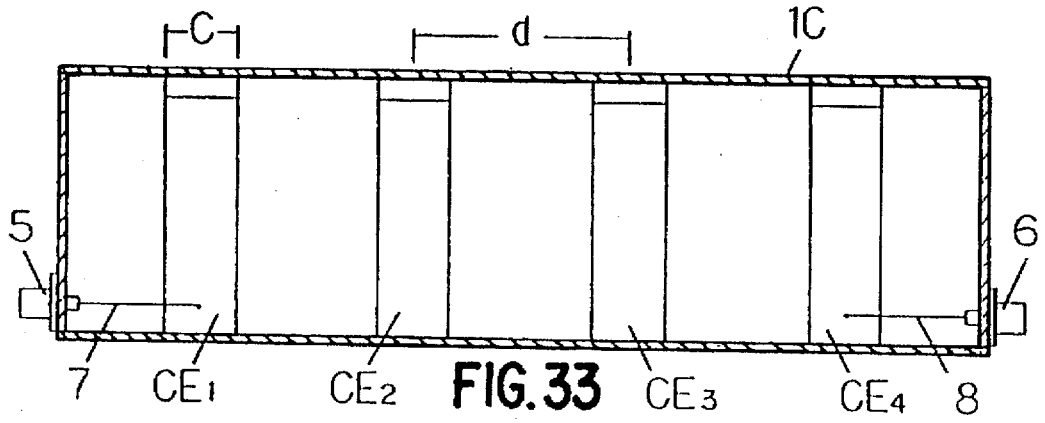
FIG. 33 is a vertical cross section of a filter constructed using the resonator shown in FIG. 3.
Figure 34:
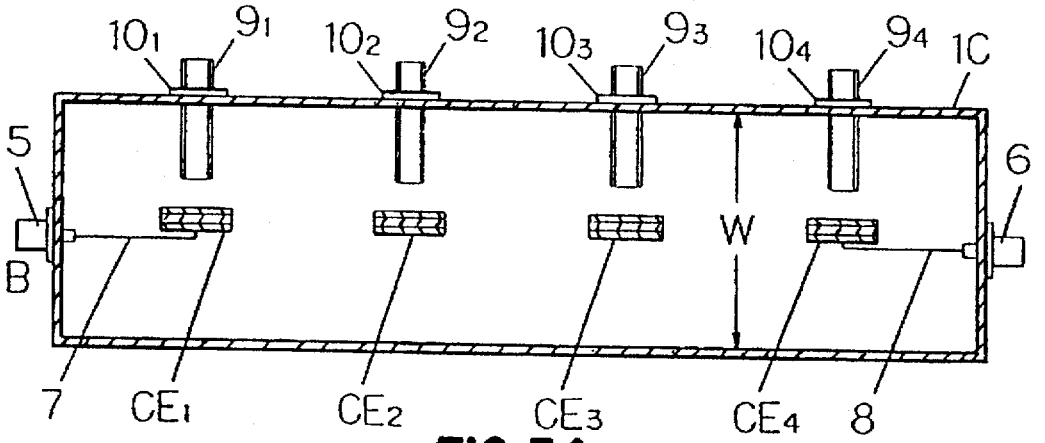
FIG. 34 is a horizontal cross section of the filter shown in FIG. 33.

FIG. 33 is a vertical cross section of a filter constructed using the resonator shown in FIG. 3, and FIG. 34 is a horizontal cross section thereof.

This filter comprises an external conductor 1C, resonance capacity elements $CE_1$, $CE_2$, $CE_3$, and $CE_4$ having the same structure as that described for FIG. 23, an input terminal 5, an output terminal 6, an input coupling wire 7, an output coupling wire 8, resonance frequency fine-tuning elements $9_1$, $9_2$, $9_3$, and $9_4$, and lock nuts $10_1$, $10_2$, $10_3$, and $10_4$ that is used to fix the fine-tuning elements $9_1$, $9_2$, $9_3$, and $9_4$.

Figure 35:
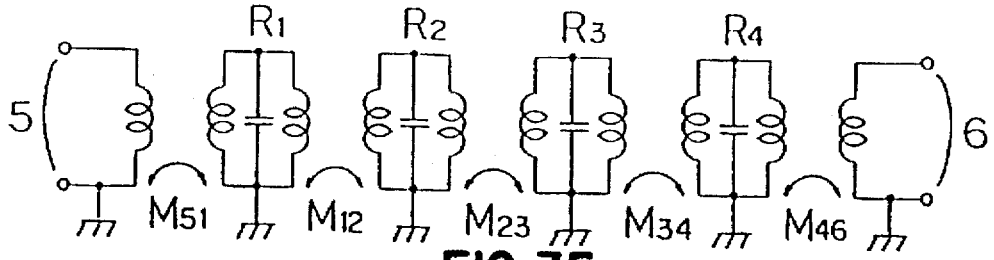
FIG. 35 is an equivalent circuit diagram of the filter shown in FIGS. 33 and 34.

FIG. 35 is an equivalent circuit diagram of the filter shown in FIGS. 33 and 34. Symbols $R_1$ through $R_4$ represent resonance circuits, the symbol $M_{51}$ represents the input magnetic field coupling coefficient, the symbol $M_{46}$ represents the output magnetic field coupling coefficient, and symbols $M_{12}$ through $M_{34}$ represent interstage magnetic field coupling coefficients.

Figure 36:
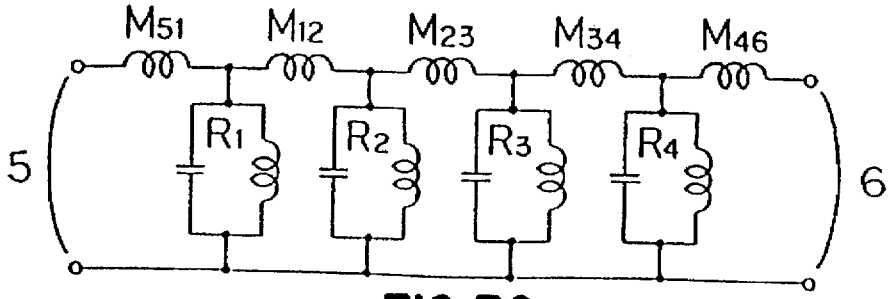
FIG. 36 is a converted equivalent circuit diagram of the equivalent circuit diagram shown in FIG. 35.

FIG. 36 is a converted equivalent circuit diagram of the equivalent circuit diagram shown in FIG. 35. The symbols are the same as in FIG. 35.

Alhtough FIGS. 33 through 36 illustrate examples in which the order n of the circuit is 4, the present invention can also be implemented when the order of the circuit is suitably increased or decreased. In addition, although FIGS. 33 through 36 illustrate examples in which the input/output coupling elements consist of the tap coupling wires 7 and 8, a capacity coupling element composed of the capacitors 11 and 12 or the probes 13 and 14 or a magnetic field coupling element composed of the loops 15 and 16 shown in FIGS. 7 through 10 may also be used to implement the present invention.

Figure 37:
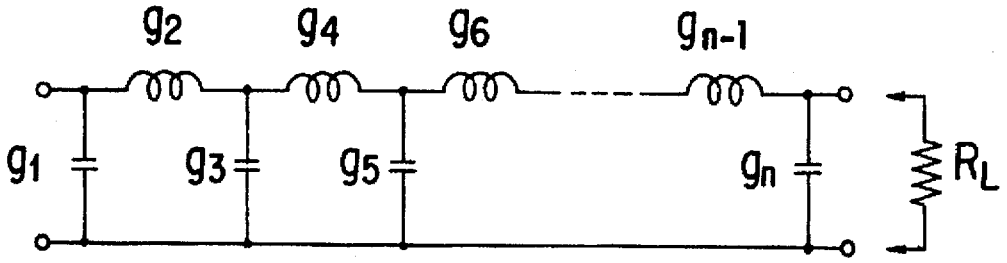
FIG. 37 is a circuit diagram used to illustrate the design method for the filter according to the present invention.
Figure 38:
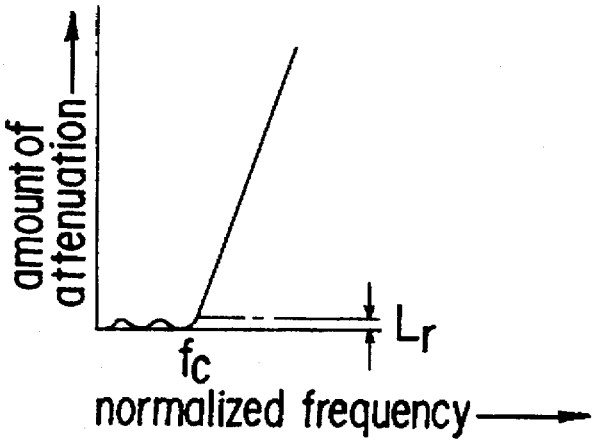
FIG. 38 is a diagram of the transmission characteristics of the circuit in FIG. 37.

In the design of the band-pass filter shown in FIGS. 33 through 36, element values are determined for a normalized low-pass filter, and then circuit constants are determined from these value to obtain the required transmission characteristics, as in a conventional design method. It will now be described how a band-pass filter whose pass band exhibits Chebyshev characteristics and whose attenuation band exhibits Wagner characteristics is designed based on the element values $g_1$ through $g_n$ of a normalized Chebyshev low-pass filter, whose circuit diagram is shown in FIG. 37 and whose transmission characteristic curve is shown in FIG. 38 (where the axis of abscissa represents the normalized frequency, the axis of ordinate represents the amount of attenuation, and $f_c$ is the normalized cut-off frequency).

Let the voltage standing-wave ratio (VSWR) within the pass band that is permissible in terms of the design of the band pass filter be S, then the permissible ripple $L_r$ within the pass band is expressed by the following equation (2).

$$L_r=10 \log \{(S+1)^2/4S\}(dB) \tag{2}$$

The permissible ripple $L_r$ is determined from the above equation, the order n of the circuit is also determined, the element value $g_1$ is determined from equation (3), and the element values $g_2$ through $g_n$ are determined from equation (4).

$$g_1=2a_1/\gamma \tag{3}$$

$$g_k=(4a_{k-1}\cdot a_k)/(b_{k-1}\cdot g_{k-1}) \tag{4}$$

$$k=2, 3, \ldots, n$$

where $$\gamma=\sin h(\beta/2n) \tag{5}$$

$$\beta=l_n\{\cot h(L_r/17.37)\} \tag{6}$$

$$a_k=\sin \{(2k-1)\pi/2n\} \tag{7}$$

$$b_k=\gamma^2+\sin^2(k\pi/n) \tag{8}$$

In FIG. 37, $R_L$ is the load resistnace. When the order n of the circuit is an odd number, $$R_L=1 \tag{9}$$

and when the order n of the circuit is an even number, $$R_L=\cot h^2(\beta/4) \tag{10}$$

The input/output magnetic field coupling coefficients and the interstage magnetic field coupling coefficients can be determined from equations (11) and (12) and the pass band width Bwr, the required center frequency $f_0$ of the band-pass filter, and the element values $g_1$ through $g_n$ determined from equations (3) and (4).

If we express the input/output magnetic field coupling coefficients as $M_{01}$ and $M_{n,\ n+1}$, $$M_{01}=M_{n,n+1}=2/g_1(Bwr/f_0)^{1/2} \tag{11}$$

If we express the interstage magnetic field coupling coefficient as $M_{12}=M_{n-1,n}$ and $M_{23}=M_{n-2,\ n-1}, \ldots$, and if we determine these and express them as $M_{k,\ k+1}$ (k=1, 2, . . . , n−1), $$M_{k,k+1} \approx \{4/(g_k \cdot g_{k+1})\}^{1/2} \cdot Bwr/f_0 \quad (12)$$

Figure 39:
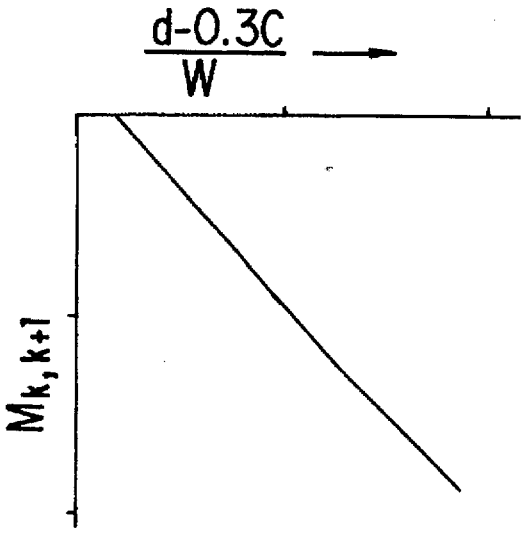
FIG. 39 is a diagram illustrating an example of the relation between the interstage magnetic field coupling coefficient and the center spacing of adjacent resonance capacity elements.

The center spacing of adjacent resonance capacity elements can be determined using FIG. 39 and the interstage magnetic field coupling coefficient $M_{k,\ k+1}$ determined from equation (12).

FIG. 39 illustrates an example of the relation between the interstage magnetic field coupling coefficient and the center spacing of adjacent resonance capacity elements, obtained as a result of repeated experimentation with prototypes by the inventor. The axis of abscissa represents (d–0.3C)/W where d is the center spacing of adjacent resonance capacity elements (see FIG. 33), C is the width of the resonance capacity element (see FIG. 33), and W is the width of the common external conductor (see FIG. 34). The axis of ordinate represents the interstage magnetic field coupling coefficient $M_{k,\ k+1}$.

The transmission loss L of the band-pass filter shown in FIGS. 33 through 36 is expressed by the following equation.

$$L(\text{dB}) = 10 \log \{1 + [(S-1)^2/4S] T^2_n(x)\} \quad (13)$$

where $T_n$ (x) is a Chebishev polynomial;

when x<1, $$T_n(x) = \cos(n \cos^{-1} x), \text{ and}$$

when x>1, $$T_n(x) = \cos h(n \cos h^{-1} x).$$

x is the normalized frequency, $$x = (f_0/Bwr)[f/f_0 - f_0/f]$$

$f_0$ is the center frequency in the BPF pass band, f is an arbitrary transmission frequency, Bwr is the permissible pass band frequency width, and S is the permissible voltage standing-wave ratio (VSWR) within the pass band.

Figure 40:
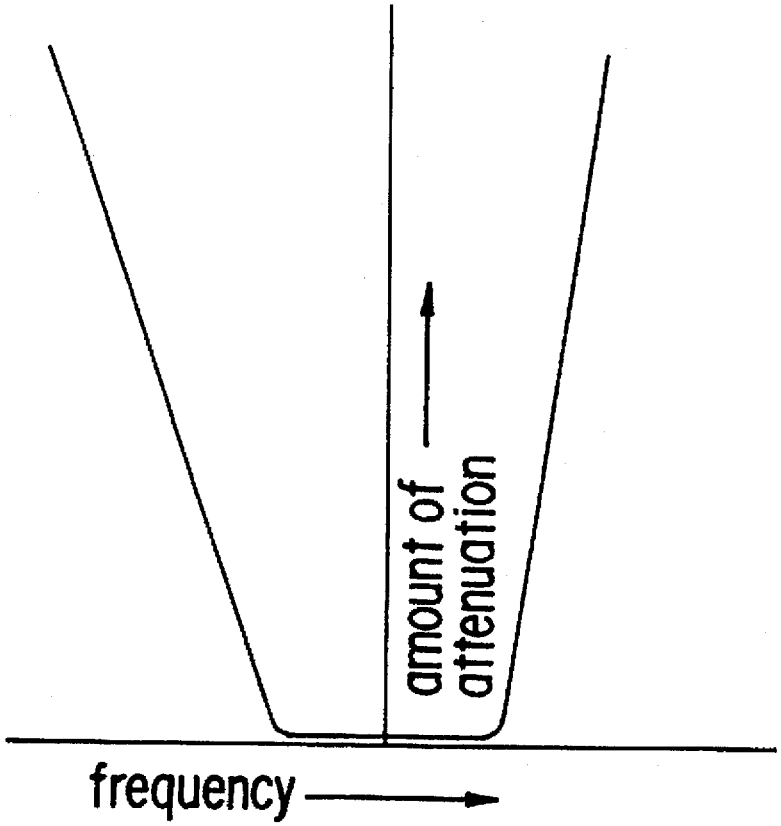
FIG. 40 is a diagram illustrating an example of the transmission characteristics of the filter shown in FIGS. 33 through 36.

FIG. 40 is a diagram illustrating an example of the transmission characteristics of the filter shown in FIGS. 33 through 36. The axis of abscissa represents the frequency, and the axis of ordinate represents the amount of attenuation.

Figure 41:
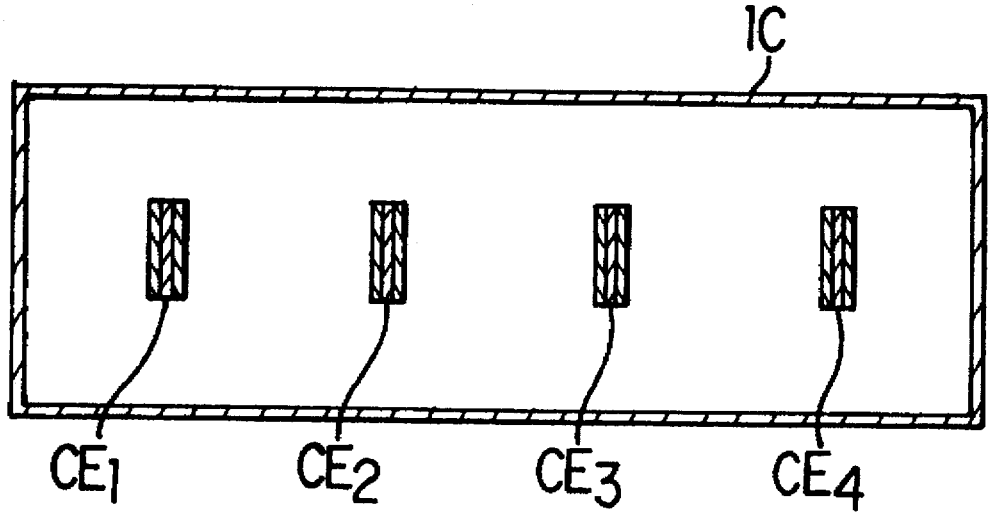
FIG. 41 is a cross section of the main portion of another filter according to the present invention.

Although FIGS. 27, 30, 33, and 34 all give examples in which resonance capacity elements are provided such that the width directions of the resonance capacity elements $CE_1$ through $CE_4$ will be parallel to the lengthwise direction of the common external conductor IC, in all of the embodiments, as shown by the cross section of principal components in FIG. 41 (a cross section similar to FIG. 34), the present invention can also be implemented with the resonance capacity elements $CE_1$ through $CE_4$ arranged such that their width directions are at a right angle to the lengthwise direction of the common external conductor IC.

When a bnad-pass filter is constructed with the resonance capacity elements which are arranged as shown in FIG. 41 and coupled to adjacent elements each other by magnetic field coupling, the design method thereof is the same as the design method for the band-pass filter shown in FIG. 33. A band-pass filter having the required transmission characteristics can be realized through suitable correction of the value of C in the axis of abscissa (d–0.3C)/W of FIG. 39, which is used to determine the center spacing of the resonance capacity elements, or in other words, since the value of C corresponds to the width of the resonance capacity elements, through correction of the value of C to a value that corresponds to the thickness of the resonance capacity element when the resonance capacity elements are arranged as shown in FIG. 41.

Figure 42:
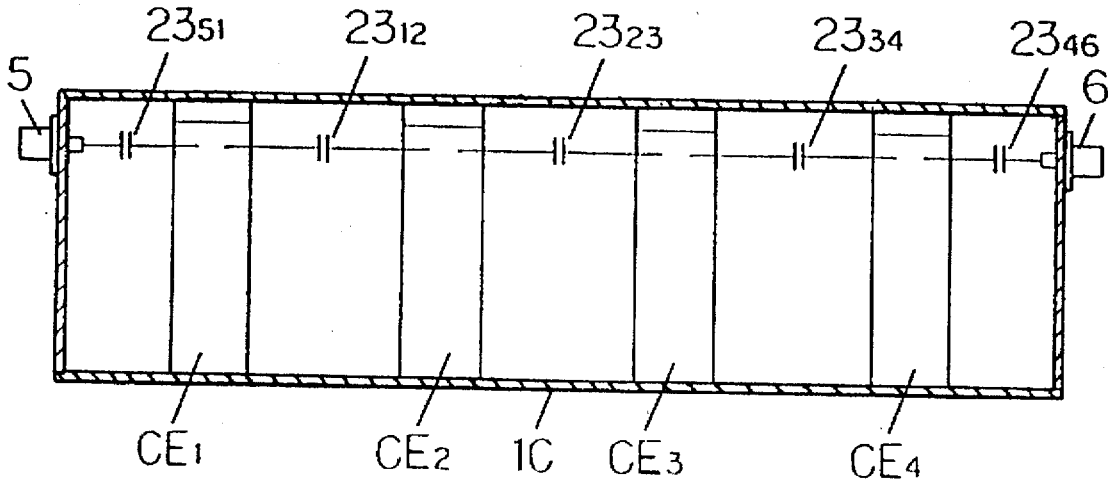
FIG. 42 is a vertical cross section of a filter in which the interstage coupling consists of capacitive coupling.

FIG. 42 is a vertical cross section of a band-pass filter in which the interstage coupling consists of capacitive coupling (a cross section at the same location as in FIG. 33).

This filter comprises an external conductor 1C, resonance capacity elements $CE_1$ through $CE_4$, an input terminal 5, an output terminal 6, an input coupling capacity element $\mathbf{23}_{51}$, interstage coupling capacity elements $\mathbf{23}_{12}$, $\mathbf{23}_{23}$, and $\mathbf{23}_{34}$, and an output coupling capacity element $\mathbf{23}_{46}$.

Figure 43:
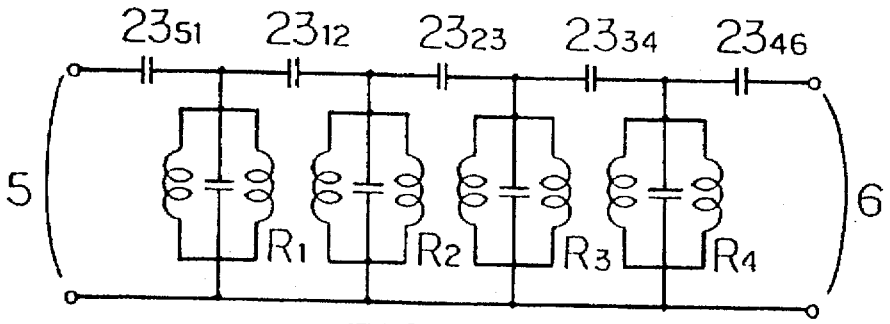
FIG. 43 is an equivalent circuit diagram of the filter shown in FIG. 42.

FIG. 43 is an equivalent circuit diagram of the band-pass filter shown in FIG. 42. Symbols $R_1$ through $R_4$ represent resonance circuits, the reference numeral $\mathbf{23}_{51}$ represents the input coupling capacity, reference numerals $\mathbf{23}_{12}$ through $\mathbf{23}_{34}$ represent interstage coupling capacities, and the reference numeral $\mathbf{23}_{46}$ represents the output coupling capacity.

Figure 44:
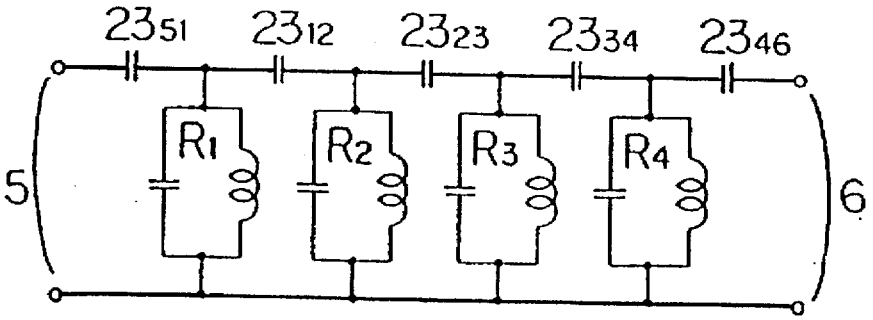
FIG. 44 is a converted equivalent circuit diagram of the equivalent circuit diagram shown in FIG. 43.

FIG. 44 is a converted equivalent circuit diagram of the equivalent circuit diagram shown in FIG. 43.

Although FIG. 42 shows an example in which the input/output coupling elements consist of capacity elements, tap coupling wires, probes, loops, or other such high-frequency coupling means may also be used.

Figure 45:
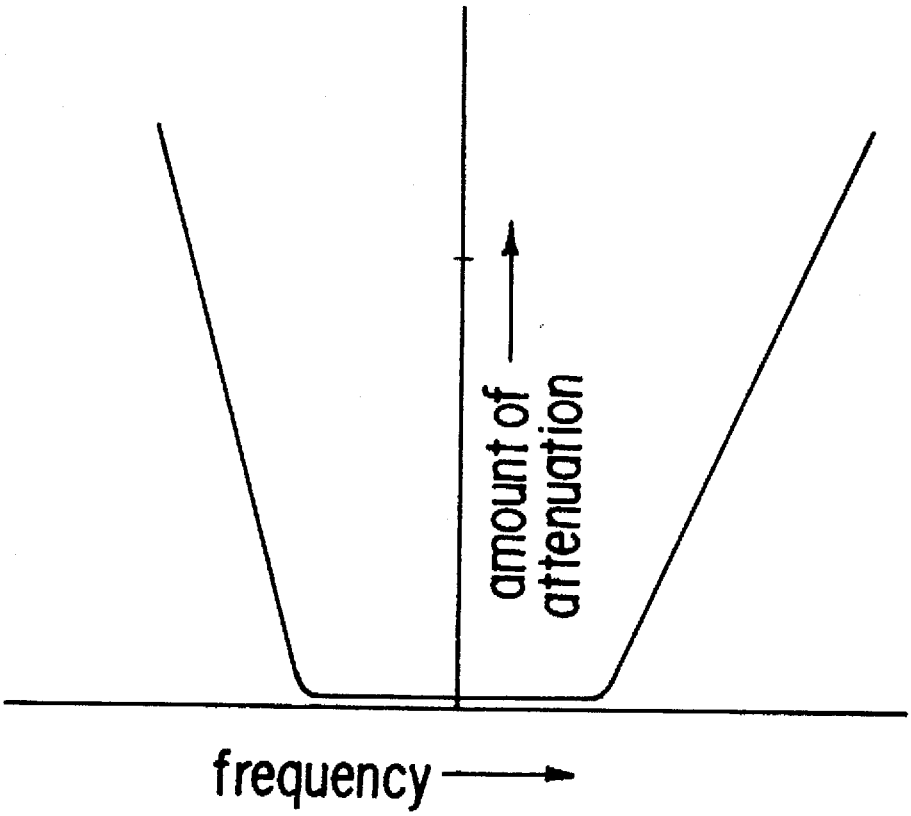
FIG. 45 is a diagram illustrating an example of the transmission characteristics of the filter shown in FIG. 42.

FIG. 45 is a diagram illustrating an example of the transmission characteristics of the band-pass filter shown in FIG. 42. The axis of abscissa represents the frequency, and the axis of ordinate represents the amount of attenuation.

Figure 46:
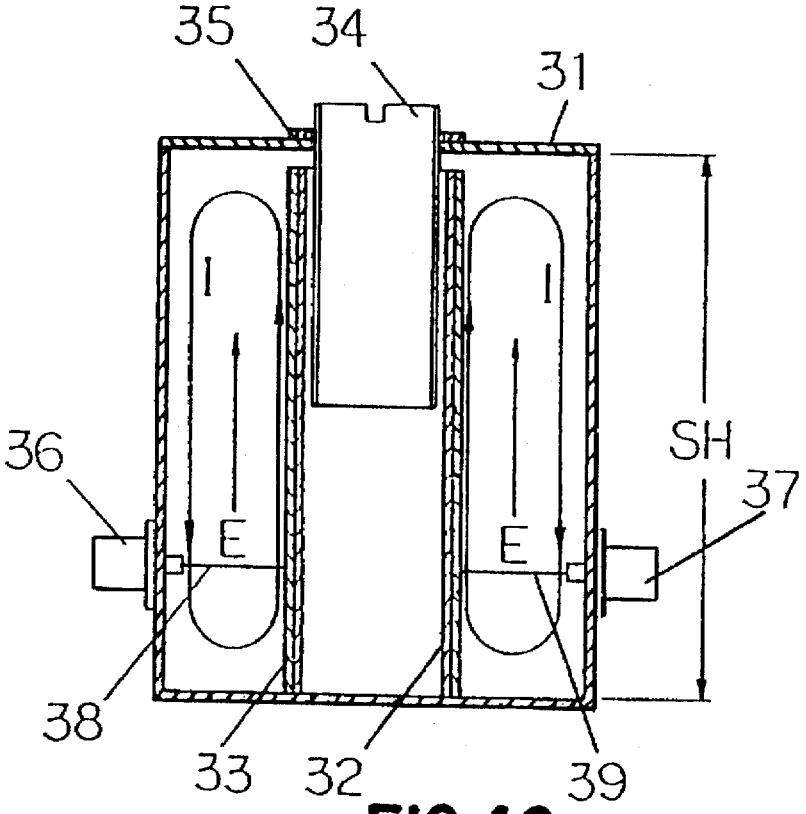
FIG. 46 is a vertical cross section of the resonator of the tenth embodiment according to the present invention.
Figure 47:
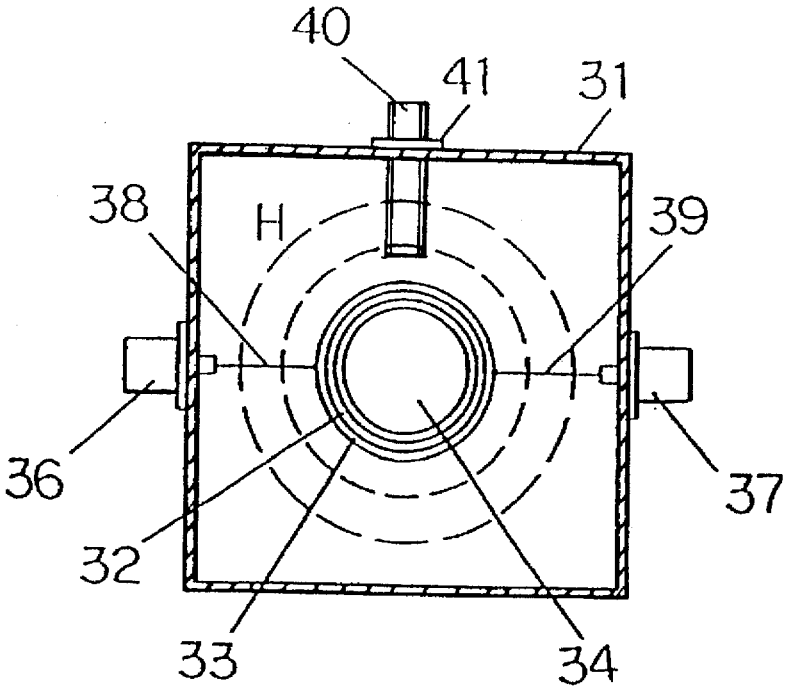
FIG. 47 is a horizontal cross section of the resonator of the tenth embodiment according to the present invention.

FIG. 46 is a vertical cross section of the resonator of the tenth embodiment according to the present invention. FIG. 47 is a horizontal cross section thereof.

The resonator of this embodiment comprises a cubic external conductor 31; a variable resonance capacity element 32 made of a solid dielectric hollow cylinder, a fixed electrode 33, and a movable electrode 34; a lock nut 35 that is used to fix the movable electrode 34; an input terminal 36; an output terminal 37; an input coupling wire 38; an output coupling wire 39; a resonance frequency fine-tuning element 40; and a lock nut 41. The external conductor 31 may also be a bottomed cylinder.

The lower end of the hollow cylinder 32 is fixed to the lower wall of the external conductor 31 by an adhesive agent or another suitable means, and the upper end faces the upper wall of the external conductor 31 a suitable distance away.

The fixed electrode 33 is made of silver or another metal thin layer bonded around the outside of the hollow cylinder 32, and the lower end thereof is electrically connected to the lower wall of the external conductor 31 by soldering or another suitable means.

The movable electrode 34 is made of a solid or hollow cylindrical conductor (such as copper) with a threaded outside, and is screwed into the threaded hole in the upper wall of the external conductor 31 coaxially with the fixed electrode 33. The insertion length of the movable electrode 34 into the hollow cylinder 32, and therefore the insertion length of the movable electorde 34 into the fixed electrode 33 can be varied through the rotation of the movable electorde 34 in a forward or reverse direction to move the movable electrode 34 forward and backward. The movable electorde 34 can be fixed through the lock nut 35.

The input terminal 6 and the output terminal 7 consist, for example, of coaxial plugs, and the external conductor forming these coaxial plugs is connected to the external conductor 31. The input coupling wire 38 is connected at one end to the internal conductor of the coaxial plug 36, and at the other end to the fixed electrode 33. The output coupling wire 39 is connected at one end to the internal conductor of the coaxial plug 37, and at the other end to the fixed electrode 33. The fine-tuning element 40 is made, for example, of a metal screw threaded into the wall of the external conductor 31, and is fixed through the lock nut 41.

Figure 48:
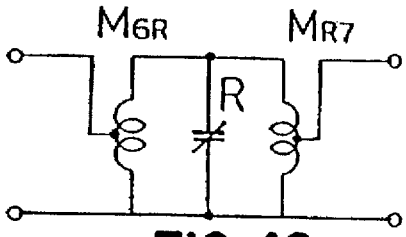
FIG. 48 is an equivalent circuit diagram of the resonator shown in FIG. 47.

In the resonator constructed in this manner, a parallel resonator circuit whose equivalent circuit is shown in FIG. 48, is formed by the distributed inductance of the external conductor 31 and the capacity of the variable resonance capacity element composed of the solid dielectric hollow cylinder 32, the fixed electrode 33, and the movable electrode 34.

In FIG. 48, the symbol R represents the resonance circuit, the symbol $M_{6R}$ represents the input magnetic field coupling coefficient, and the symbol $M_{R7}$ represents the output magnetic field coupling coefficient.

When high-frequency power is applied, for example, to the coaxial plug 36, the electromagnetic field distribution in this resonator will be such that the electric field vector is expressed by the solid arrowed line E in FIG. 46, the current by the solid arrowed line I in FIG. 46, and the magnetic field by the broken line H in FIG. 47.

Since inductance is relatively small, and the capacity is relatively large in this resonator, this resonator is a low impedance type with good withstand voltage characteristics.

If a material with a high dielectric constant and a dielectric loss that is nearly zero is used as the hollow cylinder 32 made of a solid dielectric in the variable resonance capacity element, then the Q ($Q_u$) of the variable resonance capacity element composed of the solid dielectric hollow cylinder 32, the fixed electrode 33, and the movable electrode 34 can be ignored. Since the electromagnetic energy that can be accumulated in this resonator will correspond to the volume of the external conductor 31, and the resistance in the metal portion of this resonator can be kept extremely low, an extremely large unloaded Q can be obtained.

The inventor was able to obtain the following experimental equation (14) for the unloaded Q ($Q_u$) of this resonator through the use of prototypes whose external conductor 31, fixed electrode 33 and movable electrode 34 are made of copper, although the magnitude of the unloaded Q ($Q_u$) will also vary with the ratio of the inductance to the capacity in the resonator.

$$Q_u \approx 20 f_0^{1/2} \cdot SH \tag{14}$$

where $f_0$ is the resonance frequency (MHz) and SH is the height (cm) of the external conductor 31 (cm) (see FIG. 46).

Figure 49:
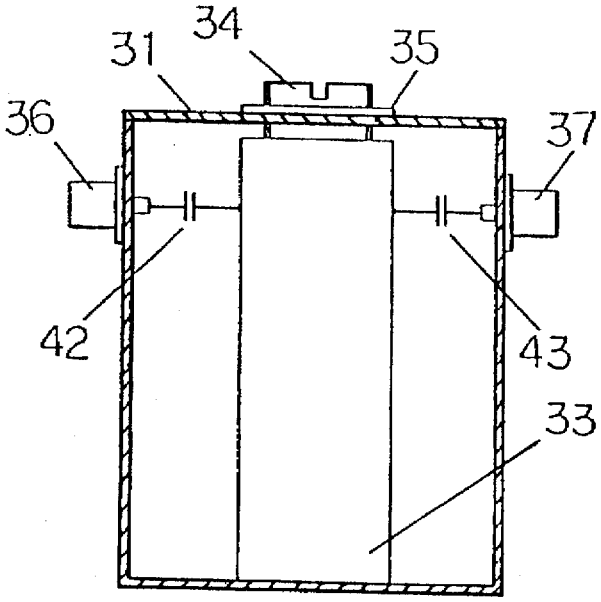
FIG. 49 is a diagram illustrating an example in the tenth embodiment in which the input terminal 36 and the fixed electrode 33 are capacitively coupled by the capacity element 42, and the output terminal 37 and the fixed electrode 33 by the capacity element 43.

Although FIG. 46 illustrates an example in which tap coupling by the coupling wires 38 and 39 is used as means for coupling in high-frequency fashion the input terminal 36 with the fixed electrode 33, and the output terminal 37 with the fixed electrode 33, means for capacitively coupling the input terminal 36 with the fixed electrode 33 via the capacity element 42 and means for capacitively coupling the output terminal 37 with the fixed electrode 33 via the capacity element 43 may also be used, as shown in FIG. 49. In addition, probes 44 and 45 may be used as the input/output coupling means, as shown in FIG. 50, or loops 46 and 47 may be used as the input/output coupling means, as shown in FIG. 51.

Figure 50:
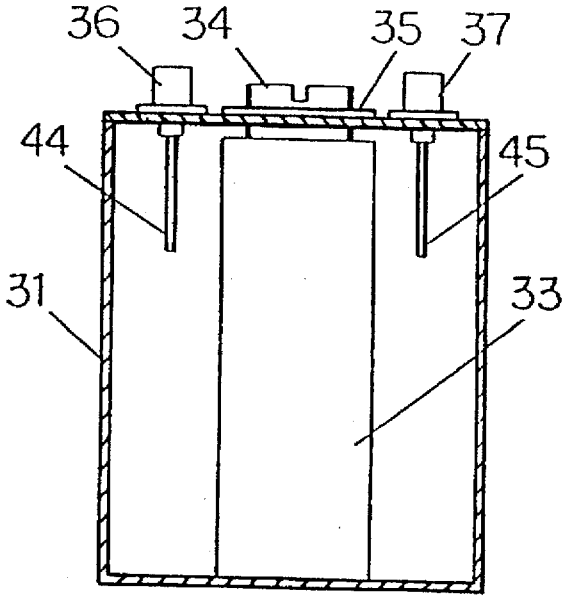
FIG. 50 is a diagram illustrating an example in the tenth embodiment in which probes 44 and 45 are used as the input/output coupling means.
Figure 51:
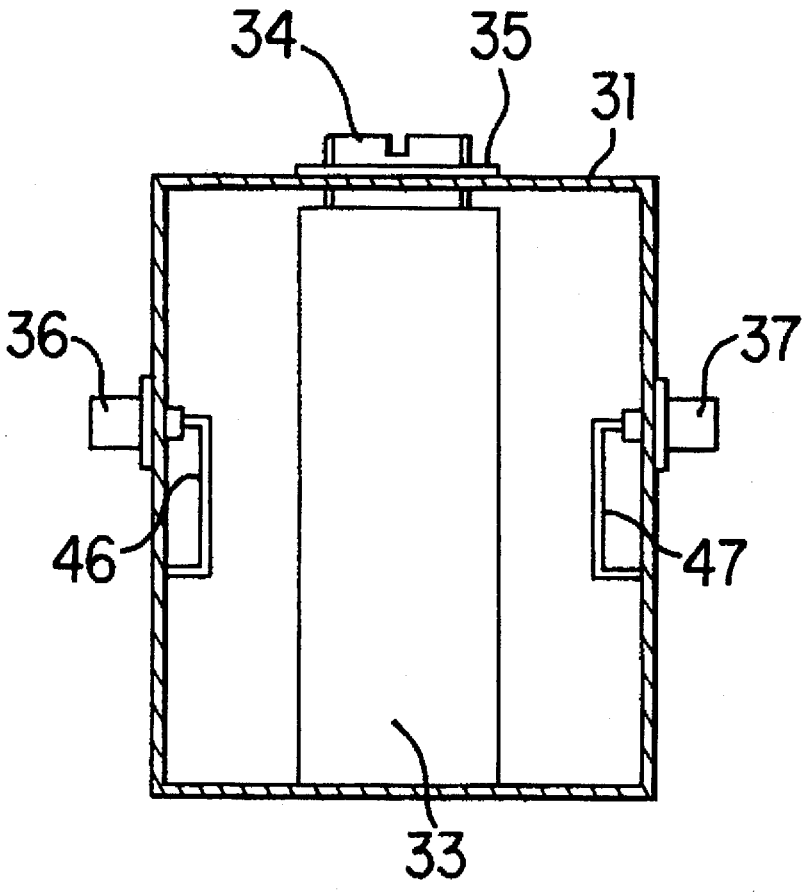
FIG. 51 is a diagram illustrating an example in the tenth embodiment in which loops 46 and 47 are used as the input/output coupling means.

FIGS. 49 through 51 correspond to cross sections of FIG. 47 viewed from below with the side wall on the bottom (from the front) removed from the external conductor 31 and hereinafter the same applies to cross sections similar to FIGS. 49 through 51, such as FIG. 52.

Figure 52:
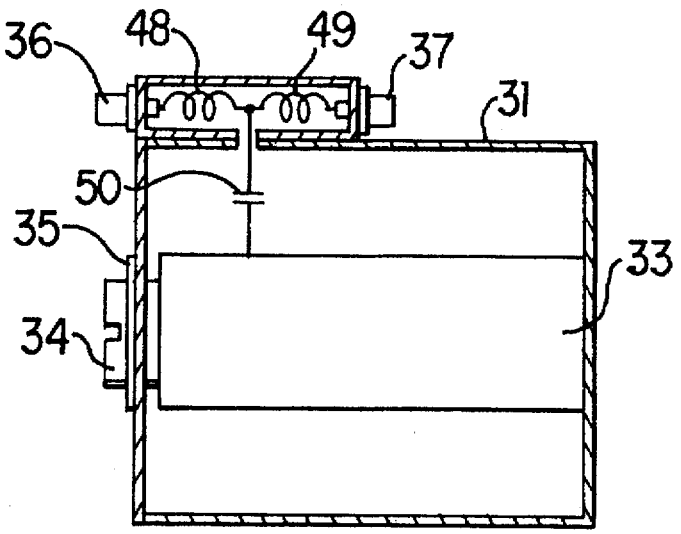
FIG. 52 is a vertical cross section of the resonator of the eleventh embodiment according to the present invention.

FIG. 52 is a vertical cross section of the resonator of the eleventh embodiment according to the present invention.

In this embodiment, a low-pass filter circuit is composed of inductance elements 48 and 49 for the compensation of transmission characteristics, interposed between the connection terminals 36 and 37 for the external circuit, and a capacity element 20 connected between the connection point of the inductance elements 48 and 49 and the fixed electrode 33 forming the resonance capacity element. With this resonator, as shown by the transmission characteristics in FIG. 54 where the axis of abscissa represents the frequency and the axis of ordinate represents the amount of attenuation, the slope of the attenuation characteristic curve in the frequency region lower than the resonance frequency $f_0$ is steep, while the slope of the attenuation characteristic curve in the frequency region higher than the resonance frequency $f_0$ is gentle, and a transmission inhibition band is formed in the frequency region including the resonance frequency $f_0$.

Figure 53:
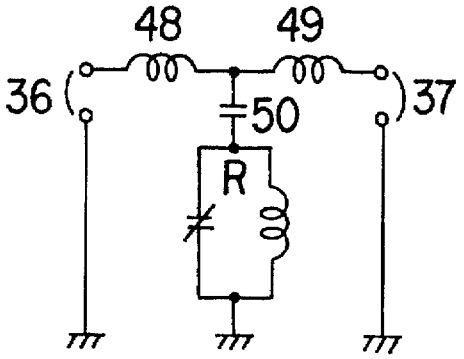
FIG. 53 is an equivalent circuit diagram of the resonator shown in FIG. 52.

FIG. 53 is an equivalent circuit diagram of the resonator shown in FIG. 52. The symbol R represents a resonance circuit composed of the external conductor 31 and the variable resonance capacity element, and the rest of the symbols are the same as in FIG. 52.

The resonance frequency $f_0$ of the circuit composed of the resonance circuit R and the coupling-use capacity element 52 changes according to the capacity of the coupling-use capacity element 50, and the fine tuning of the resonance frequency can be performed by the provision of an adjustment element that is the same as the resonance frequency fine-tuning element 40 shown in FIG. 47.

Figure 55:
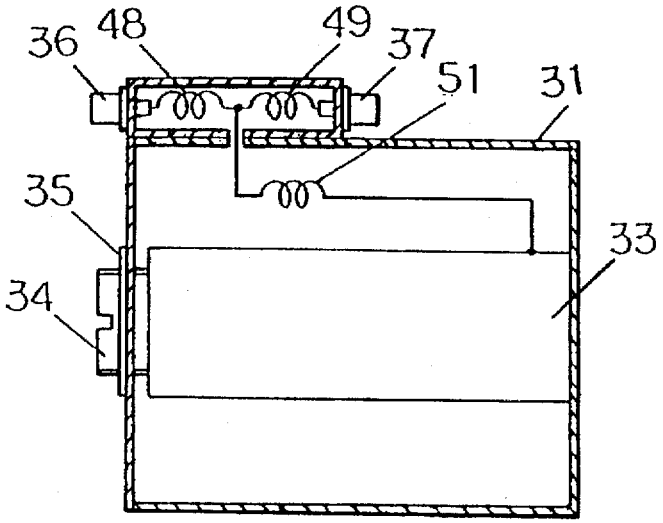
FIG. 55 is a vertical cross section of the resonator of the twelfth embodiment according to the present invention.

FIG. 55 is a vertical cross section of the resonator of the twelfth embodiment according to the present invention.

This embodiment differs from the eleventh embodiment shown in FIG. 52 in that the coupling of the connection point of the inductance elements 48 and 49 with the fixed electrode 33 is performed by tap coupling using an inductance element 51, and in that the resonance frequency $f_0$ of the circuit composed of the resonance circuit R and the coupling-use inductance element 51 changes according to the inductance of the inductance element 51. The rest of the structure and operation is substantially the same as in the eleventh embodiment shown in FIG. 52.

Figure 56:
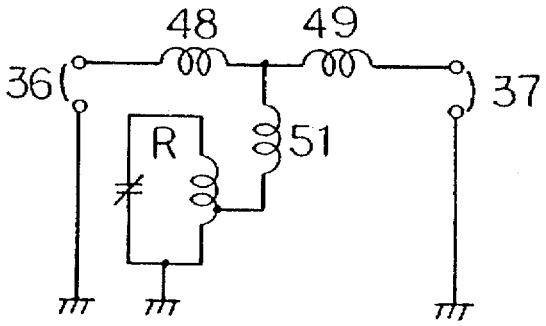
FIG. 56 is an equivalent circuit diagram of the resonator shown in FIG. 55.

FIG. 56 is an equivalent circuit diagram of the resonator shown in FIG. 55. Except for the inductance element 51, all of the symbols are the same as in FIG. 53.

Figure 54:
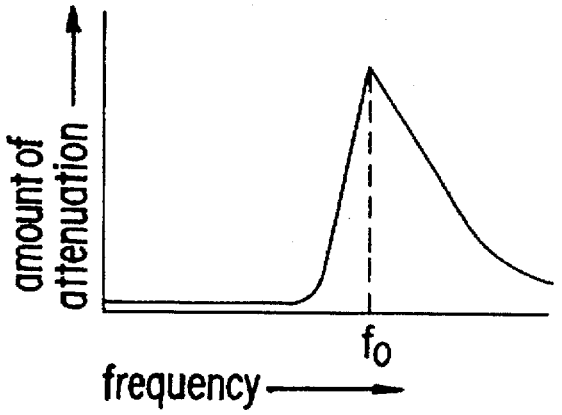
FIG. 54 is a diagram illustrating the transmission characteristics of the resonator shown in FIG. 52.
Figure 57:
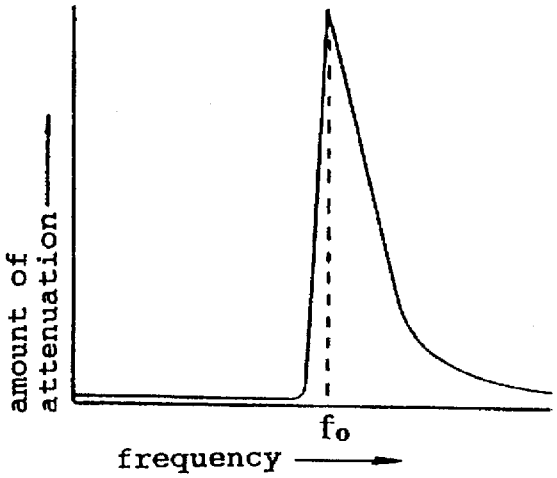
FIG. 57 is a diagram illustrating the transmission characteristics of the resonator shown in FIG. 55.

FIG. 57 where the asix of abscissa and the axis of ordinate are the same as in FIG. 54, is a diagram illustrating the transmission characteristics of the resonator shown in FIG. 55, which is substantially the same as the characteristics shown in FIG. 54.

Figure 58:
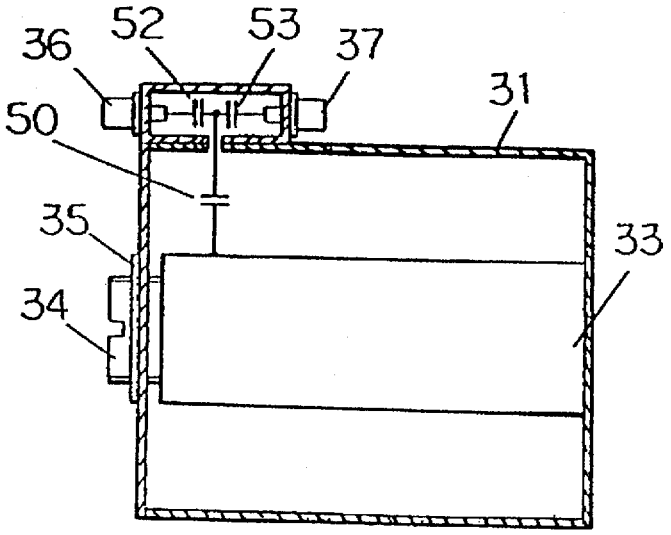
FIG. 58 is a vertical cross section of the resonator of the thirteenth embodiment according to the present invention.

FIG. 58 is a vertical cross section of the resonator of the thirteenth embodiment according to the present invention. This embodiment differs from the eleventh embodiment shown in FIG. 52 in that the inductance elements 48 and 49 used in the eleventh embodiment shown in FIG. 52 are replaced with capacity elements 52 and 53. The rest of the structure is the same as in the eleventh embodiment shown in FIG. 52.

Figure 59:
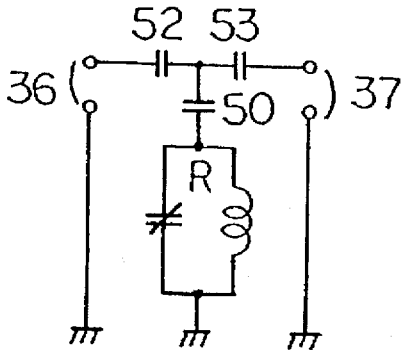
FIG. 59 is an equivalent circuit diagram of the resonator shown in FIG. 58.

FIG. 59 is an equivalent circuit diagram of the resonator shown in FIG. 58. Except for the capacity elements 52 and 53, all of the symbols are the same as in FIG. 53.

Figure 60:
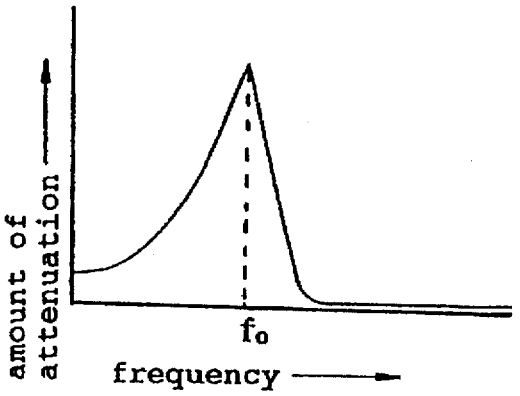
FIG. 60 is a diagram illustrating the transmission characteristics of the resonator shown in FIG. 58.

FIG. 60 where the axis of abscissa and the axis of ordinate are the same as in FIG. 54, is a diagram illustrating the transmission characteristics of the resonator shown in FIG. 58. In this embodiment, the slope of the attenuation characteristic curve in the frequency region lower than the resonance frequency $f_0$ is gentle, while the slope of the attenuation characteristic curve in the frequency region higher than the resonance frequency $f_0$ is steep, and a transmission inhibition band is formed in the frequency region including the resonance frequency $f_0$.

Figure 61:
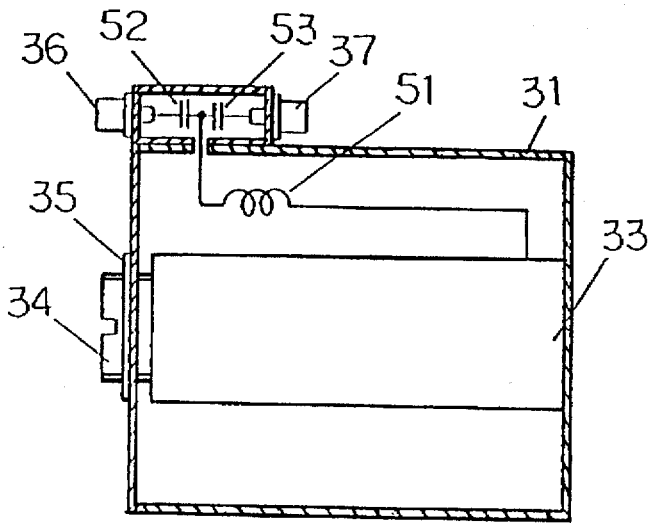
FIG. 61 is a vertical cross section of the resonator in the fourteenth embodiment according to the present invention.

FIG. 61 is a vertical cross section of the resonator of the fourteenth embodiment according to the present invention.

This embodiment is the same as the embodiment shown in FIG. 58 in that the capacity elements 52 and 53 are used as transmission characteristic compensation elements, and is the same as the twelfth embodiment shown in FIG. 55 in that the coupling element is formed such that tap coupling will be performed using the inductance element 51. The rest of the structure is the same as in the thirteenth embodiment shown in FIG. 58.

Figure 62:
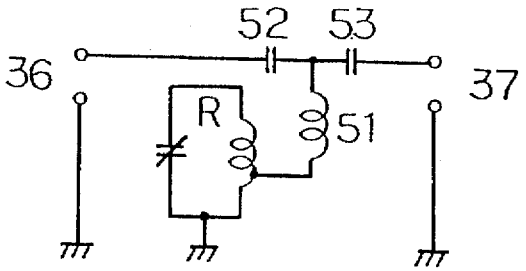
FIG. 62 is an equivalent circuit diagram of the resonator shown in FIG. 61.

FIG. 62 is an equivalent circuit diagram of the resonator shown in FIG. 61. Except for the inductance element 51, all of the symbols are the same as in FIG. 59.

Figure 63:
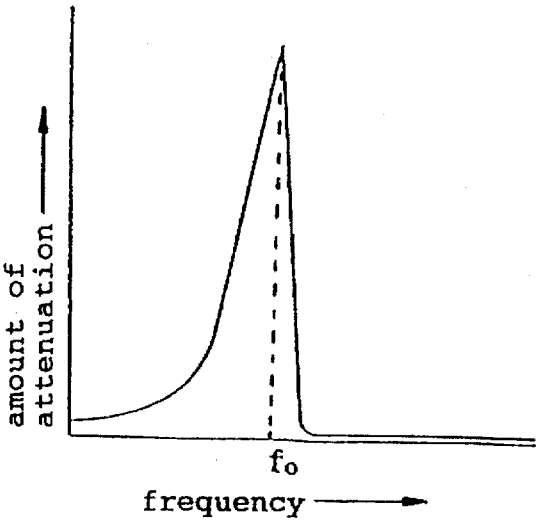
FIG. 63 is a diagram illustrating the transmission characteristics of the resonator shown in FIG. 61.
Figure 64:
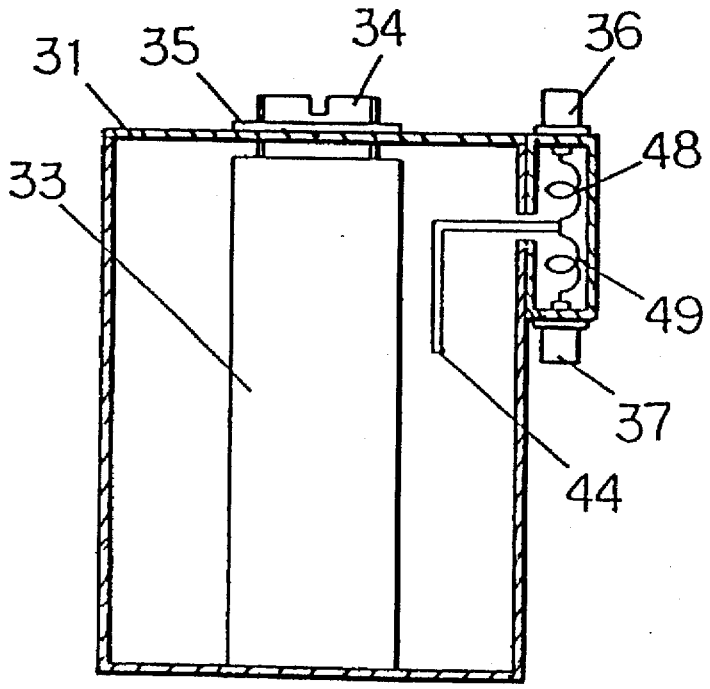
FIG. 64 is a vertical cross section of an embodiment in which the coupling element 50 in the practical example shown in FIG. 52 has been replaced with a probe 44.
Figure 65:
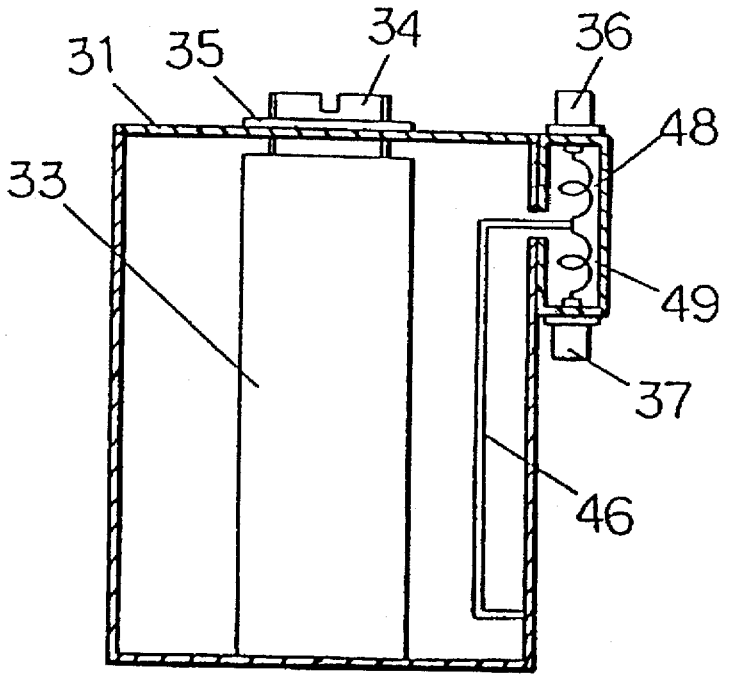
FIG. 65 is a vertical cross section of an embodiment in which the coupling element 50 in the embodiment shown in FIG. 52 has been replaced with a loop 46.
Figure 66:
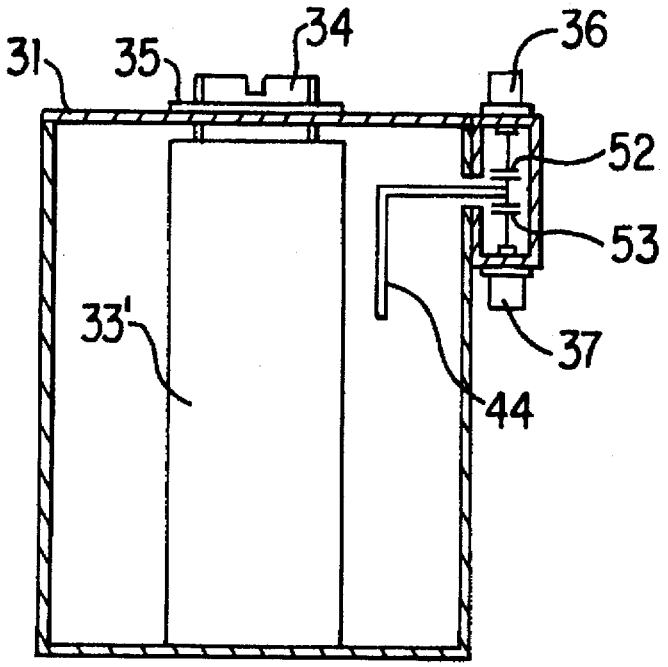
FIG. 66 is a vertical corss section of an embodiment in which the coupling element 50 in the embodiment shown in FIG. 58 has been replaced with a probe 44.
Figure 67:
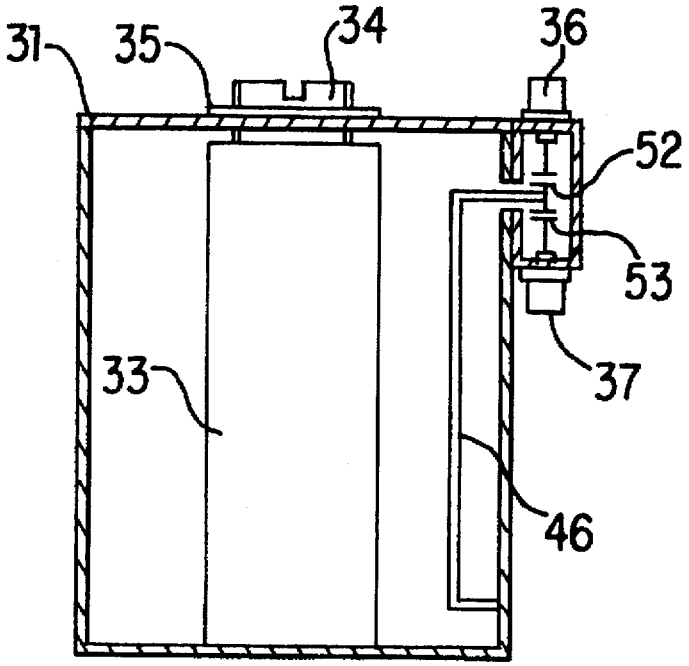
FIG. 67 is a vertical cross section of an embodiment in which the coupling element 50 in the embodiment shown in FIG. 58 has been replaced with a loop 46.

FIG. 63 where the axis of abscissa and the axis of ordinate are the same as in FIG. 60, is a diagram illustrating the transmission characteristics of the resonator shown in FIG. 61, which is substantially the same as the characteristics shown in FIG. 60.

FIGS. 64 through 67 are cross sections illustrating the fifteenth through eighteenth embodiments according to the present invention. The resonator shown in FIG. 64 has a probe 44 in place of the coupling element 50 in the embodiment shown in FIG. 52; the resonator shown in FIG. 65 has a loop 46 in place of the coupling element 50 in the embodiment shown in FIG. 52; the resonator shown in FIG. 66 has a probe 44 in place of the coupling element 50 in the embodiment shown in FIG. 58; and the resonator shown in FIG. 67 has a loop 46 in place of the coupling element 50 in the embodiment shown in FIG. 58. The rest of the structure in the respective Figs. is the same as the structure in FIG. 52 or 58.

FIG. 68 is a vertical cross section of a filter constructed using the resonator shown in FIG. 46, and FIG. 69 is a horizontal cross section thereof.

This filter comprises an external conductor 31C, fixed electrodes $\mathbf{33}_1$ through $\mathbf{33}_4$ which are the same as the fixed electrode 33 shown in FIG. 46, variable electrodes $\mathbf{34}_1$ through $\mathbf{34}_4$ that make up the variable resonance capacity element along with the fixed electrodes $\mathbf{33}_1$ through $\mathbf{33}_4$ and are the same as the movable electrode 34 shown in FIG. 46, lock nuts $\mathbf{35}_1$ through $\mathbf{35}_4$ which are used to fix the variable electrodes $\mathbf{34}_1$ through $\mathbf{34}_4$, an input terminal 36, an output terminal 37, an input coupling wire 38, an output coupling wire 39, resonance frequency fine-tuning elements $\mathbf{40}_1$ through $\mathbf{40}_4$, and lock nuts $\mathbf{41}_1$ through $\mathbf{41}_4$ that are used to fix the fine-tuning elements $\mathbf{40}_1$ through $\mathbf{40}_4$.

FIG. 70 is an equivalent circuit diagram of the filter shown in FIGS. 68 and 69. Symbols $R_1$ through $R_4$ represent resonance circuits, the symbol $M_{61}$ represents the input magnetic field coupling coefficient, the symbol $M_{47}$ represents the output magnetic field coupling coefficient, and symbols $M_{12}$ through $M_{34}$ represent the interstage magnetic field coupling coefficients.

FIG. 71 is a converted equivalent circuit diagram of the equivalent circuit diagram shown in FIG. 70, and the symbols are the same as in FIG. 70.

Although FIGS. 68 through 71 illustrate an example in which the input/output coupling elements is made of the tap coupling wires 38 and 39, a capacity coupling element composed of the capacitors 42 and 43 or the probes 44 and 45 or a magnetic field coupling element composed of the loops 46 and 47 may also be used to implement the present invention, as shown in FIGS. 49 through 51.

The band-pass filter shown in FIG. 68 through 71 can be designed in the same manner as the band-pass filter shown in FIGS. 33 through 36.

Figure 72:
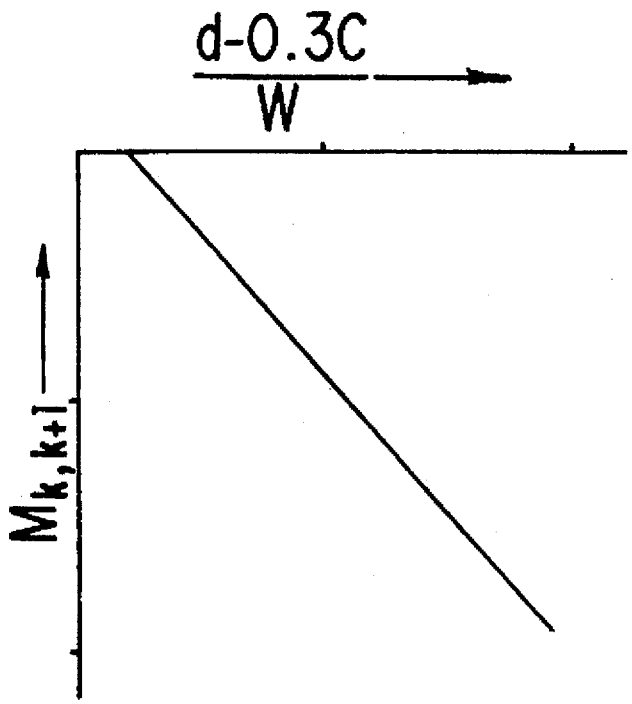
FIG. 72 is a diagram illustrating an example of the relation between the interstage magnetic field coupling coefficient and the center spacing of adjacent resonance capacity elements.

FIG. 72 is a diagram illustrating an example of the relation between the interstage magnetic field coupling coefficient and the center spacing of adjacent resonance capacity elements, obtained as a result of repeated experimentation with prototypes by the inventor. The axis of abscissa represents (d–0.3C)/W where d is the center spacing of adjacent resonance capacity elements (see FIG. 68), C is the external diameter of the fixed electrodes $\mathbf{33}_1$ through $\mathbf{33}_4$ that form the variable resonance capacity element (see FIG. 68), and W is the width of the external conductor 31C (see FIG. 69). The axis of ordinate represents the interstage magnetic field coupling coefficient $M_{k,\ k+1}$.

The transmission loss L of the band-pass filter shown in FIGS. 68 through 71 is expressed by equation (13).

An example of the transmission characteristics of the filter shown in FIGS. 68 through 71 is shown in FIG. 40.

Figure 73:
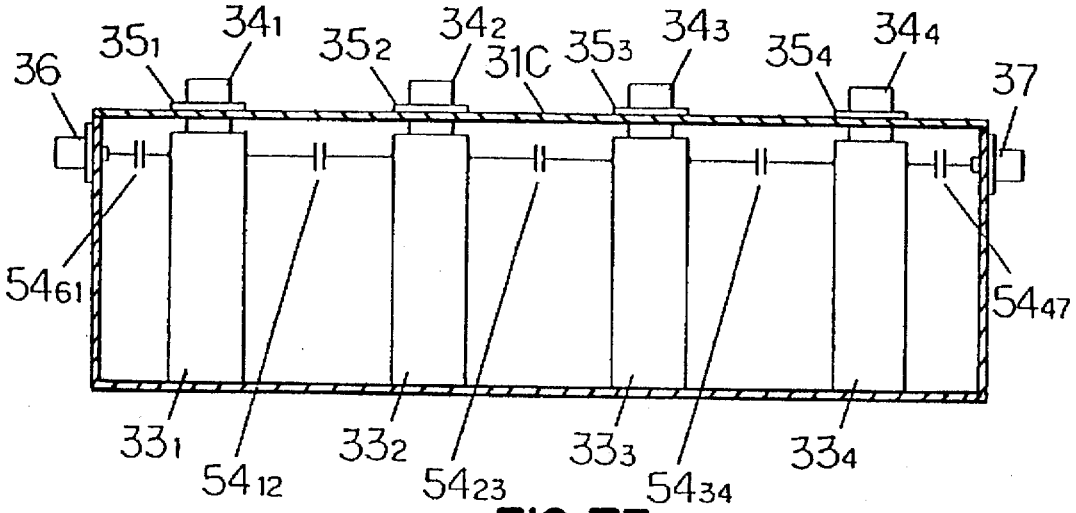
FIG. 73 is a vertical cross section of a band-pass filter in which the interstage coupling consists of electric field coupling.

FIG. 73 is a vertical cross section of a band-pass filter in which the interstage coupling consists of capacitive coupling.

This filter comprises an external conductor 31C, fixed electrodes $\mathbf{33}_1$ through $\mathbf{33}_4$, lock nuts $\mathbf{35}_1$ through $\mathbf{35}_4$, an input terminal 36, an output terminal 37, an input coupling capacity element $\mathbf{54}_{61}$, interstage coupling capacity elements $\mathbf{54}_{12}$ through $\mathbf{54}_{34}$, and an output coupling capacity element $\mathbf{54}_{47}$.

Figure 74:
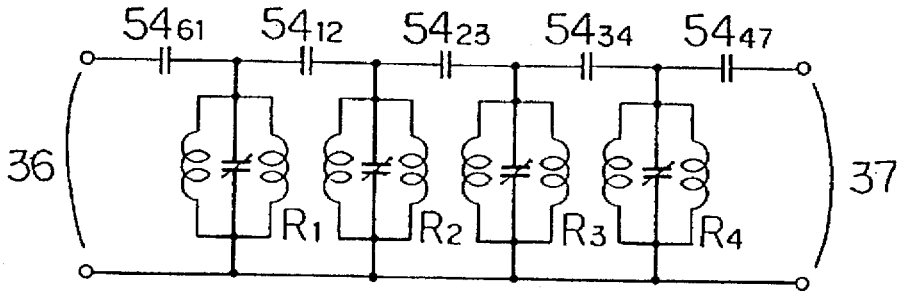
FIG. 74 is an equivalent circuit diagram of the band-pass filter shown in FIG. 73.

FIG. 74 is an equivalent circuit diagram of the band-pass filter shown in FIG. 73. Symbols $R_1$ through $R_4$ represent resonance circuits, the reference numeral $\mathbf{54}_{61}$ represents the input coupling capacity, the reference numerals $\mathbf{54}_{12}$ through $\mathbf{54}_{34}$ represent the interstage coupling capacity, and the reference numeral $\mathbf{54}_{47}$ represents the output coupling capacity.

Figure 75:
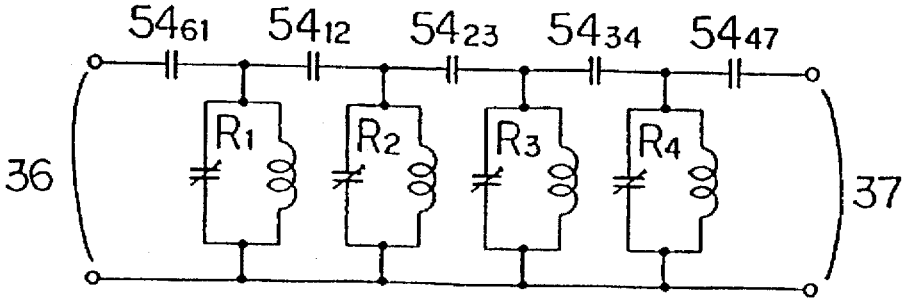
FIG. 75 is a converted equivalent circuit diagram of the equivalent circuit diagram shown in FIG. 74.

FIG. 75 is a converted equivalent circuit diagram of the equivalent circuit diagram shown in FIG. 74, and the symbols are the same as in FIG. 74.

Although FIG. 73 shows an example in which the input/output coupling elements are made of capacity elements, tap coupling wires, probes, loops, or other such high-frequency coupling means may also be used.

An example of the transmission characteristics of the band-pass filter shown in FIG. 73 is shown in FIG. 40.

Figure 76:
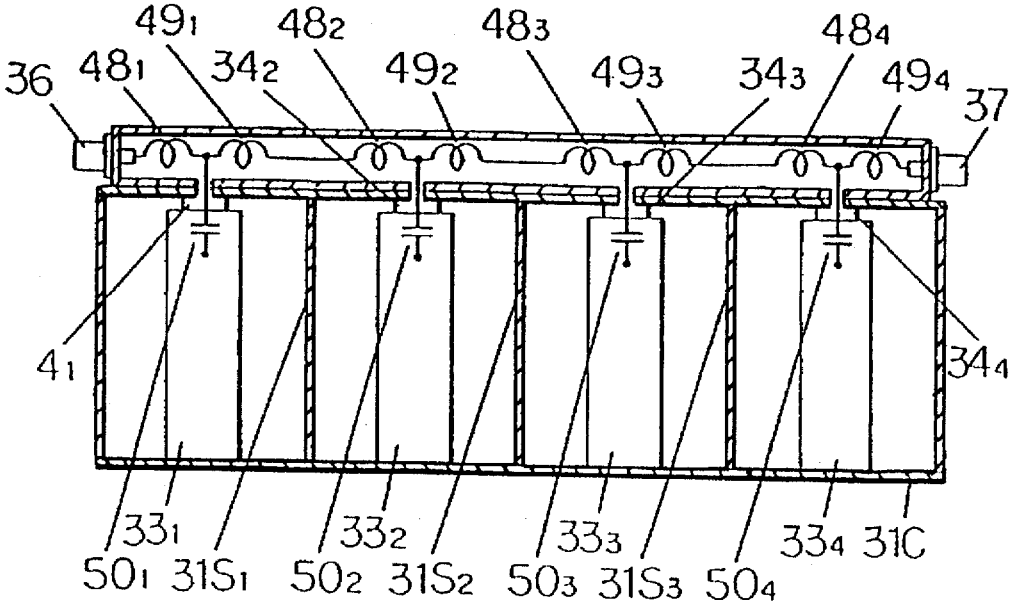
FIG. 76 is a vertical cross section of a filter constructed using the resonator shown in FIG. 52.
Figure 77:
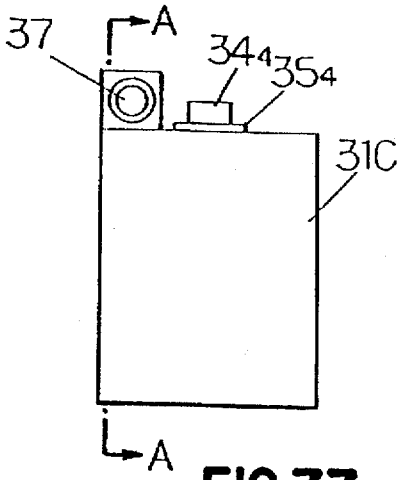
FIG. 77 is a right side view of the filter shown in FIG. 76.

FIG. 76 is a vertical cross section of a filter constructed using the resonator shown in FIG. 52. FIG. 77 is a right side view of FIG. 76.

This filter comprises an external conductor 31C, partition walls $\mathbf{31S}_1$ through $\mathbf{31S}_3$ made of conductor plates, fixed electrodes $\mathbf{33}_1$ through $\mathbf{33}_4$, movable electrodes $\mathbf{34}_1$ through $\mathbf{34}_4$, lock nuts $\mathbf{35}_1$ through $\mathbf{35}_4$ that are used to fix the movable electrodes $\mathbf{34}_1$ through $\mathbf{34}_4$, external circuit connection terminals 36 and 37; inductance elements $\mathbf{48}_1$ through $\mathbf{48}_4$ and $\mathbf{49}_1$ through $\mathbf{49}_4$ for the compensation of transmission characteristics, and coupling capacity elements $\mathbf{50}_1$ through $\mathbf{50}_4$.

Figure 78:
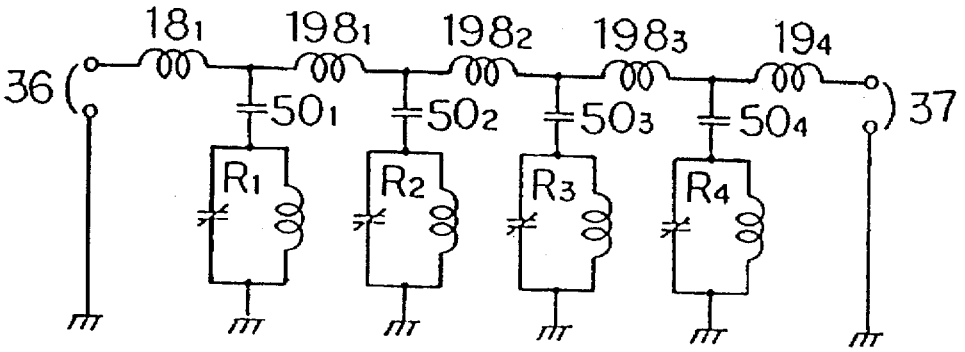
FIG. 78 is an equivalent circuit diagram of the filter shown in FIG. 76.

FIG. 78 is an equivalent circuit diagram of the filter shown in FIG. 76. Symbols $R_1$ through $R_4$ represent resonance circuits comprising a common external conductor 31C and variable resonance capacity elements composed of fixed electrode $\mathbf{33}_1$ through $\mathbf{33}_4$ and movable electrodes $\mathbf{34}_1$ through $\mathbf{34}_4$; the reference numerals $\mathbf{48}_1$, $\mathbf{498}_1$ through $\mathbf{498}_3$, and $\mathbf{49}_4$ represent inductance elements for the compensation of transmission characteristics; the reference numeral $\mathbf{498}_1$ represents a synthetic inductance element of the inductance elements $49_1$ and $48_2$ shown in FIG. 75, the reference numeral $498_2$ represents a synthetic inductance element of the inductance elements $49_2$ and $48_3$, the reference numeral $498_3$ represents a synthetic inductance element of the inductance elements $49_3$ and $48_4$, and the reference numerals $50_1$ through $50_4$ represent coupling-use capacity elements.

The transmission characteristics of the filter shown in FIG. 76 is the superimposition of the transmission characteristics of the resonators at all stages composing this filter, that is, the superimposition of the transmission characteristics substantially the same as the transmission characteristics shown in FIG. 54. The resonance frequencies ($f_0$ in FIG. 54) of all stages composed of a resonator and a coupling-use capacity element are represented by $f_{01}$ through $f_{04}$, respectively. Suitable adjustment of these resonance frequencies such that they approach each other, for instance, allows a region of inhibition with a large amount of attenuation to be realized, while adjustment of these resonance frequencies $f_{01}$ through $f_{04}$ to adequately separated values allows a region of inhibition with a wide range of frequency to be realized.

Figure 79:
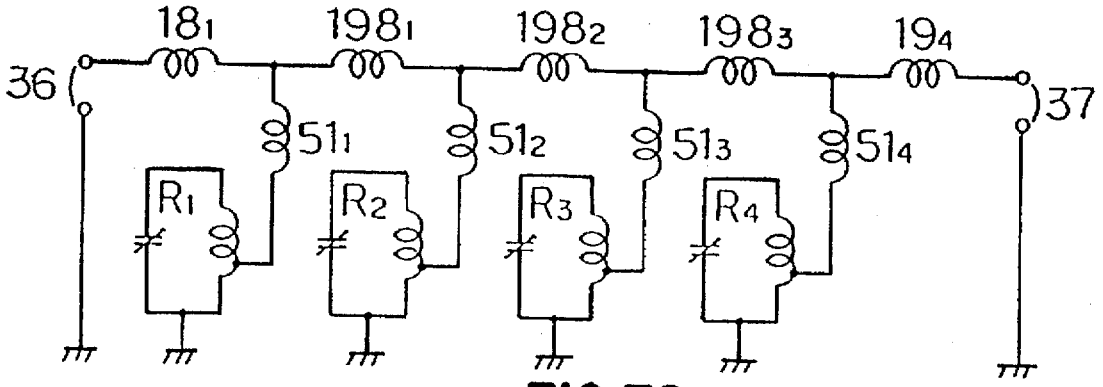
FIG. 79 is an equivalent circuit diagram of a filter constructed using the resonator shown in FIG. 55.

FIG. 79 is an equivalent circuit diagram of a filter constructed using the filter shown in FIG. 55. Reference numerals $51_1$ through $51_4$ represent tap coupling-use inductance elements, and the rest of the symbols are the same as in FIG. 78.

The transmission characteristics of this filter expressed by the equivalent circuit shown in FIG. 79, is the superimposition of the transmission characteristics of the resonators at all stages composing this filter, that is, the superimposition of the transmission characteristics substantially the same as the transmission characteristics shown in FIG. 57. Suitable adjustment of resonance frequency at each stage allows the frequency range and the amount of attenuation in the synthesis inhibition region to be suitably adjusted.

Figure 80:
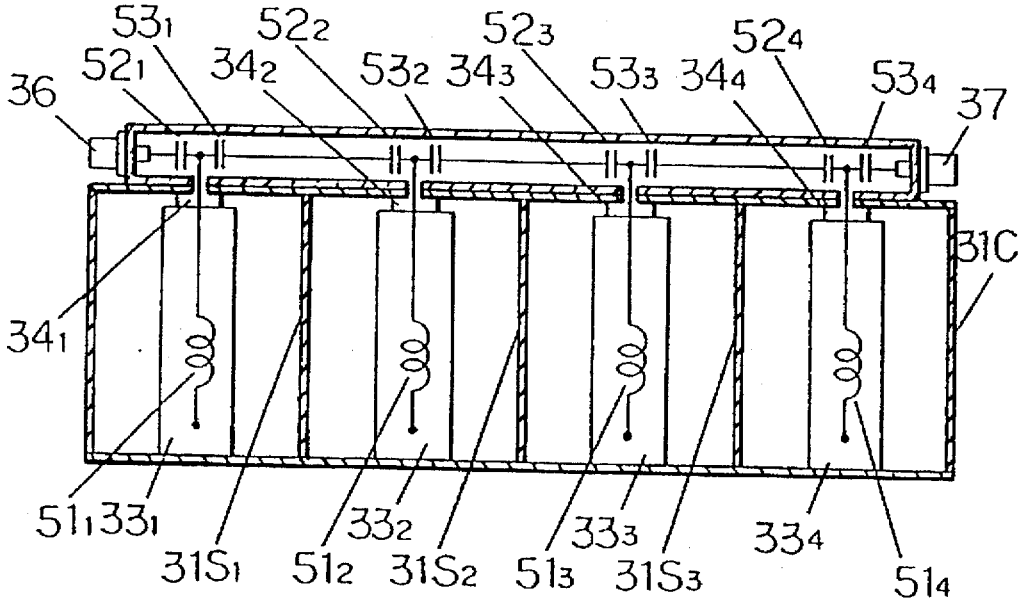
FIG. 80 is a vertical cross section of a constructed using the resonator shown in FIG. 61.

FIG. 80 is a vertical cross section of a filter constructed using the resonator shown in FIG. 61.

This filter comprises an external conductor 31C, partition walls $31S_1$ through $31S_3$ made of conductor plates, fixed electrodes $33_1$ through $33_4$, movable electrodes $34_1$ through $34_4$, external circuit connection terminals 36 and 37, inductance elements $52_1$ through $52_4$ and $53_1$ through $53_4$ for the compensation of transmission characteristics and tap coupling inductance elements $51_1$ through $51_4$.

Figure 81:
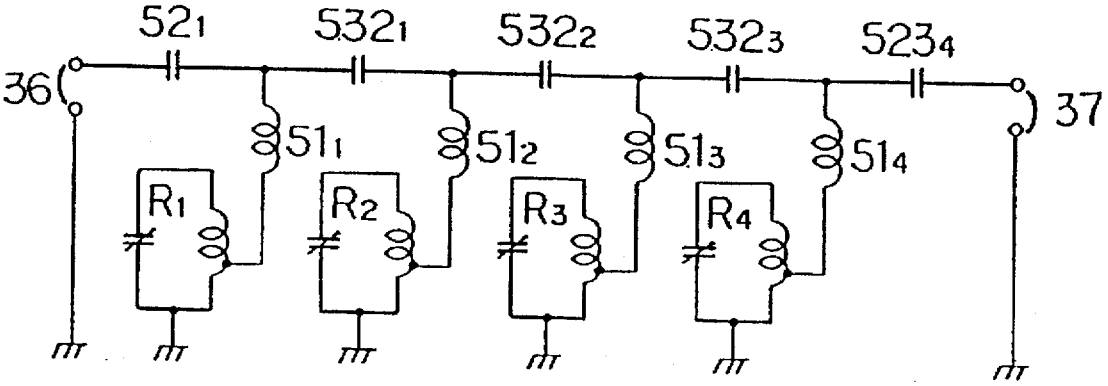
FIG. 81 is an equivalent circuit diagram of the filter shown in FIG. 80.

FIG. 81 is an equivalent circuit diagram of the filter shown in FIG. 80. Symbols $R_1$ through $R_4$ represent resonance circuits, the reference numerals $521_1$, $532_1$ through $532_3$, and $53_4$ represent capacity elements for the compensation of transmission characteristics; the reference numeral $532_1$ represents a synthetic capacity element of the capacity elements $53_1$ and $52_2$ in FIG. 80; the reference numeral $532_2$ represents a synthetic capacity element of the capacity elements $53_2$ and $53_3$; the reference numeral $532_3$ represents a synthetic capacity element of the capacity elements $53_3$ and $52_4$; and the reference numerals $51_1$ through $51_4$ represent inductance elements for tap coupling.

The transmission characteristics of the filter shown in FIG. 80 is the superimposition of the transmission characteristics of the resonators at all stages composing this filter, that is, the superimposition of the transmission characteristics substantially the same as the transmission characteristics shown in FIG. 63. Suitable adjustment of resonance frequency at each stage allows the frequency range and the amount of attenuation in the synthesis inhibition region to be suitably adjusted.

Figure 82:
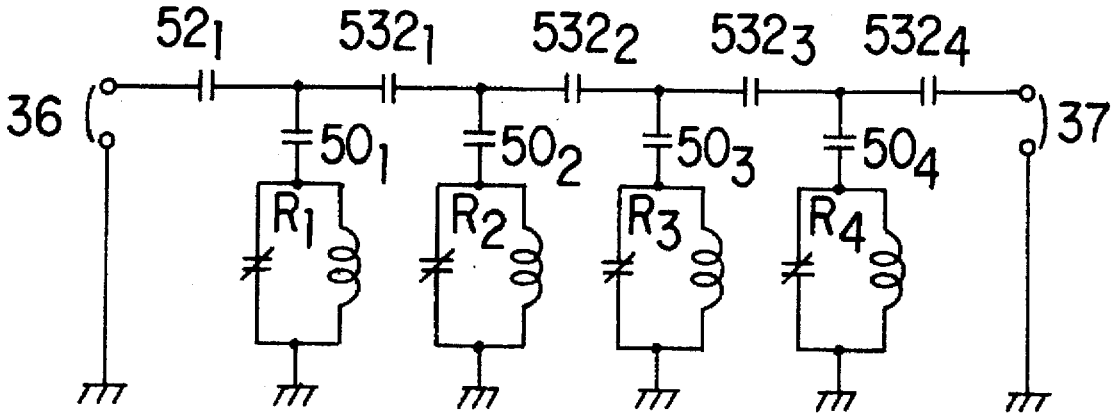
FIG. 82 is an equivalent circuit diagram of a filter constructed using the resonator shown in FIG. 58.

FIG. 82 is an equivalent circuit diagram of a filter constructed using the resonator shown in FIG. 58. Reference numerals $20_1$ through $20_4$ represent coupling-use capacity elements, and the rest of the symbols are the same as in FIG. 81.

The transmission characteristics of the filter expressed by the equivalent circuit shown in FIG. 82, is the superimposition of the transmission characteristics of the resonators at all the stages composing this filter, that is, the superimposition of the transmission characteristics substantially the same as the transmission characteristics shown in FIG. 60. Suitable adjustment of the resonance frequency at each stage allows the frequency range and the amount of attenuation in the synthesis inhibition region to be suitably adjusted.

Although FIGS. 68 through 82 illustrate examples in which four variable resonance capacity elements are provided, that is, when the order n of the circuit is 4, the present invention can also be implemented when the order n of the circuit is suitably increased or decreased.

Although the filters shown in FIGS. 68 through 82 are Combline-type filters, the present invention can also be applied to interdigital filters.

Figure 83:
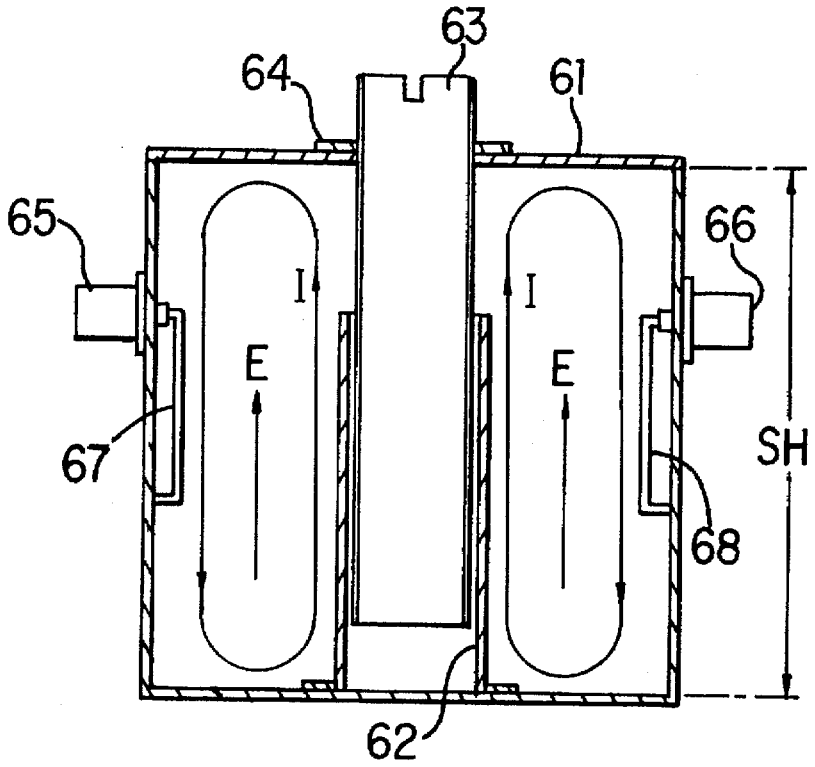
FIG. 83 is a vertical cross section of the resonator of the nineteenth embodiment according to the present invention.
Figure 84:
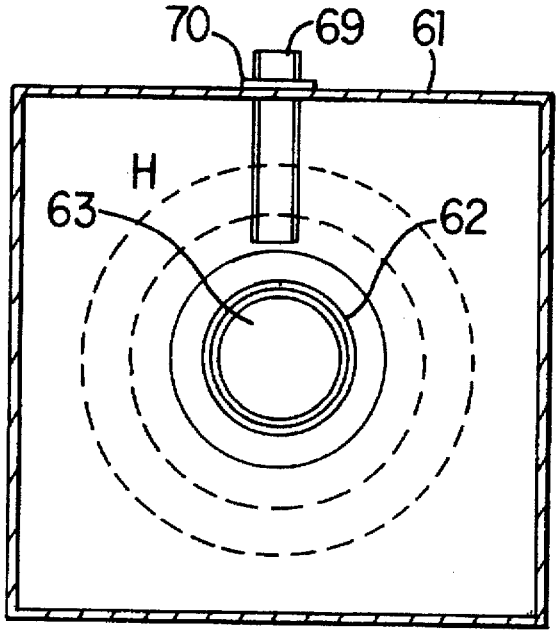
FIG. 84 is a horizontal cross section of the resonator of the nineteenth embodiment according to the present invention.

FIG. 83 is a vertical cross section of the resonator of the nineteenth embodiment according to the present invention, and FIG. 84 is a horizontal cross section thereof.

The resonator of this embodiment comprises a cubic external conductor 61; a fixed electrode 62 made of a hollow cylindrical conductor, a movable electrode 63; a lock nut 64 that is used to fix the movable electrode 63; an input terminal 65; an output terminal 66; an input coupling loop 67; an output coupling loop 68; a resonance frequency fine-tuning element 69; and a lock nut 70 that is used to fix the fine-tuning element 69. The external conductor 61 may also be a bottomed cylinder.

The lower end of the fixed electrode 62 is fixed to the lower wall of the external conductor 61, and the upper end faces the upper wall of the external conductor 61 a suitable distance away. The lower end of the fixed electrode 62 is fixed, for example, by screwing a flange that is integrally attached to the lower end of the fixed electrode 62 to the lower wall of the external conductor 61. The movable electrode 63 is made of a solid or hollow cylindrical conductor (such as copper) with a threaded outside, and is screwed into the threaded hole formed in the upper wall of the external conductor 61 coaxially with the fixed electrode 62. The insertion length of the movable electrode 63 into the holow cylinder 62, can be varied through the rotation of the movable electrode 62 in a forward or reverse direction to move the movable electrode 63 forward or backward. The input terminal 65 and the output terminal 66 is made, for example, of coaxial plugs, and the external conductor that forms these coaxial plugs is connected to the external conductor 61. The fine-tuning element 69 is made, for example, of a metal screw threaded into the wall of the external conductor 61.

Figure 85:
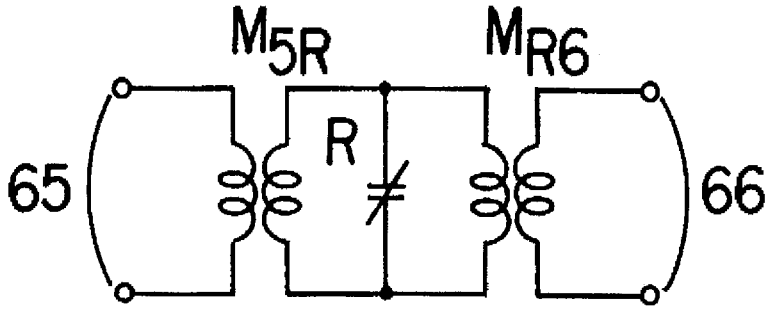
FIG. 85 is an equivalent circuit diagram of the resonator of the nineteenth embodiment.

With a resonator constructed in this manner, a parallel resonator circuit whose equivalent circuit is shown in FIG. 85, is formed by the distributed inductance in the external conductor 61 and the capacity in the variable resonance capacity element composed of the fixed electrode 62 and the movable electrode 63.

In FIG. 85, the symbol R represents the resonance circuit, the symbol $M_{5R}$ represents the input magnetic field coupling coefficient, and the symbol $M_{R6}$ represents the output magnetic field coupling coefficient.

When high-frequency power is applied, for example, to the input terminal 65, the electromagnetic field distribution in this resonator will be such that the electric field vector is expressed by the solid arrowed line E in FIG. 83, the current by the solid arrowed line I, and the magnetic field by the broken line H in FIG. 84.

Since the inductance is relatively small, and the capacity is relatively large in this resonator, this resonator is a low impedance type with good withstand voltage characteristics. In addition, the electromagnetic energy that can be accumulated in this resonator will correspond to the volume of the external conductor 61, and the resistance in the metal portion of this resonator can be kept extremely low, so that an extremely large unloaded Q can be obtained.

The inventor was able to obtain the following experimental equation (15) for the unloaded Q ($Q_u$) through the use of prototypes whose external conductor 61, the fixed electrode 62, and the movable electrode 63 of this resonator are made of copper, although the magnitude of the unloaded Q ($Q_u$) will vary with the ratio of inductance to the capacity of the resonator.

$$Q_u \approx 20 f_0^{1/2} \cdot SH \tag{15}$$

where $f_0$ is the resonance frequency (MHz) and SH is the height (cm) of the external conductor 61 (see FIG. 83).

Figure 86:
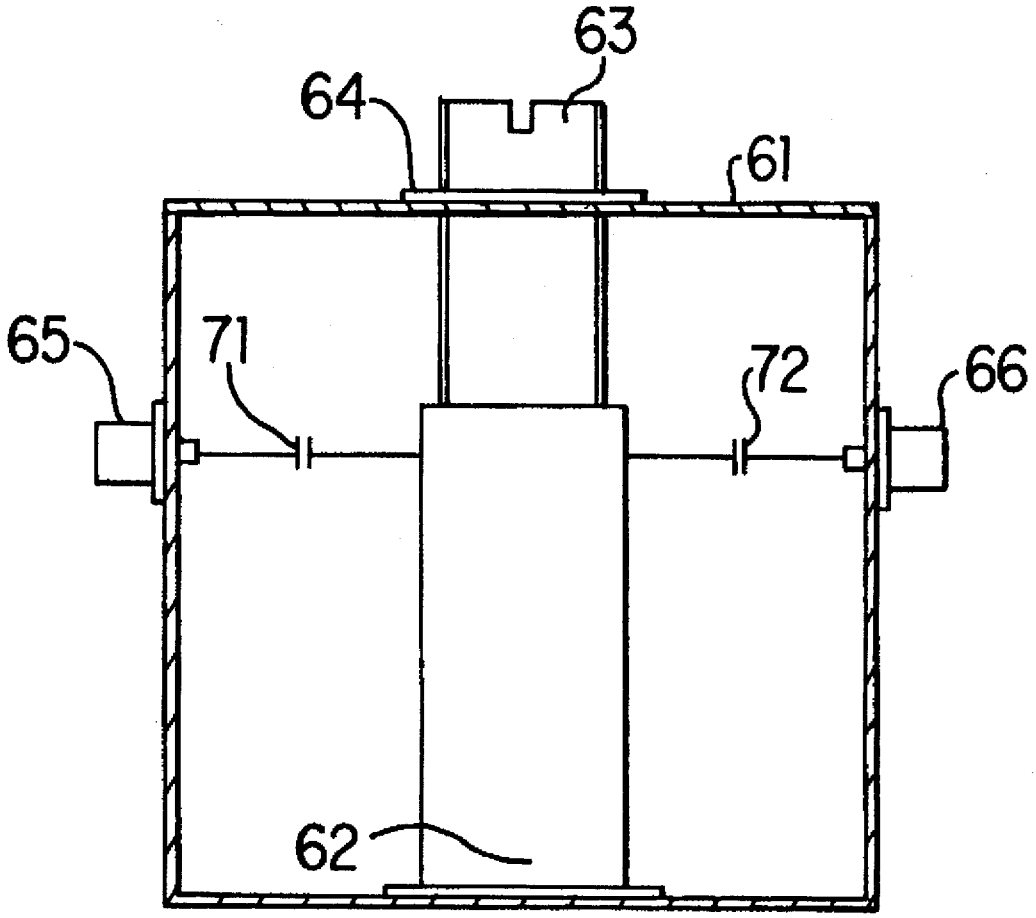
FIG. 86 is a vertical cross section of an example in the nineteenth embodiment in which the input terminal 65 and the fixed electrode 62 are capacitively coupled by the capacity element 71, and the output terminal 66 and the fixed electrode 62 by the capacity element 72.

Although FIG. 83 illustrates an example in which a resonance frequency fine-tuning element 69 and a lock nut 70 are provided, the present invention can also be implemented with these components omitted. Also, FIG. 83 illustrates an example in which loops 67 and 68 are provided as means for coupling in high-frequency fashion the input terminal 65 with the fixed electrode 62 and the output terminal 66 with the fixed electrode 62, means for capacitively coupling the input terminal 65 with the fixed electrode 62 via the capacity element 71 and means for capacitively coupling the output terminal 66 with the fixed electrode 62 via the capacity element 72 may also be used, as shown in FIG. 86. In addition, probes 73 and 74 may be used as the input/output coupling means, as shown in FIG. 87, or tap coupling may be performed using coupling wires 75 and 76 as the input/output coupling means, as shown in FIG. 88.

Figure 87:
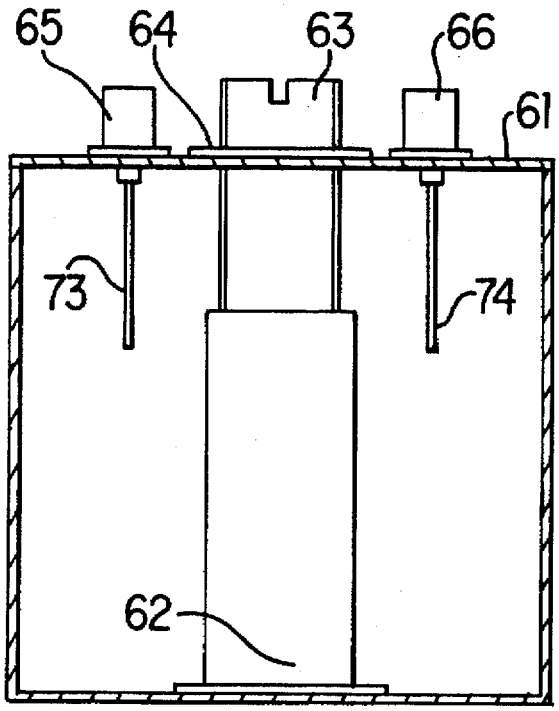
FIG. 87 is a diagram illustrating an example in the nineteenth embodiment in which probes 73 and 74 are used as the input/output coupling means.
Figure 88:
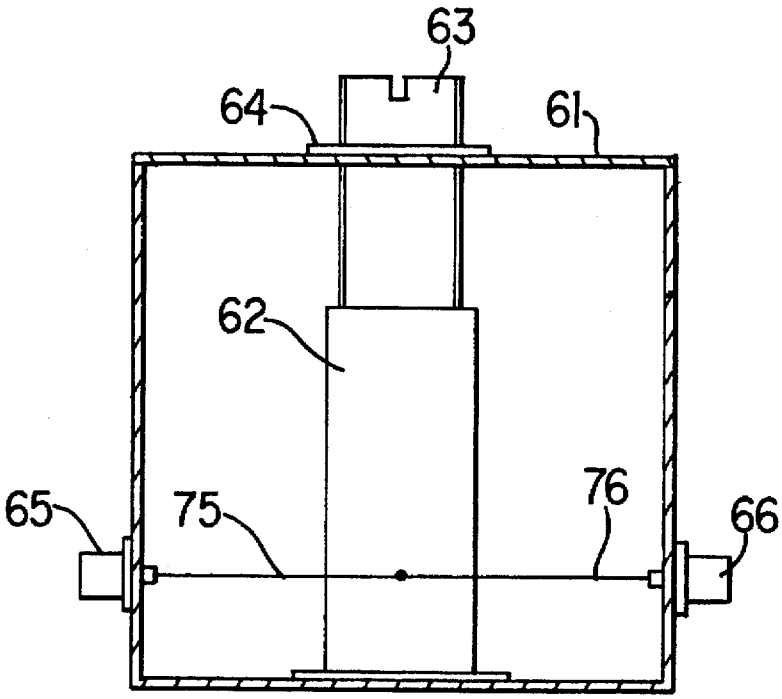
FIG. 88 is a diagram illustrating an example in the nineteenth embodiment in which tap coupling is performed using coupling wires 75 and 76 as the input/output coupling means.

FIGS. 86 through 88 are the cross sections of FIG. 84, omitting the lower side wall of the external conductor 61.

Those symbols and structure not discussed in the explanation of FIGS. 86 through 88 are the same as in FIG. 83.

Figure 89:
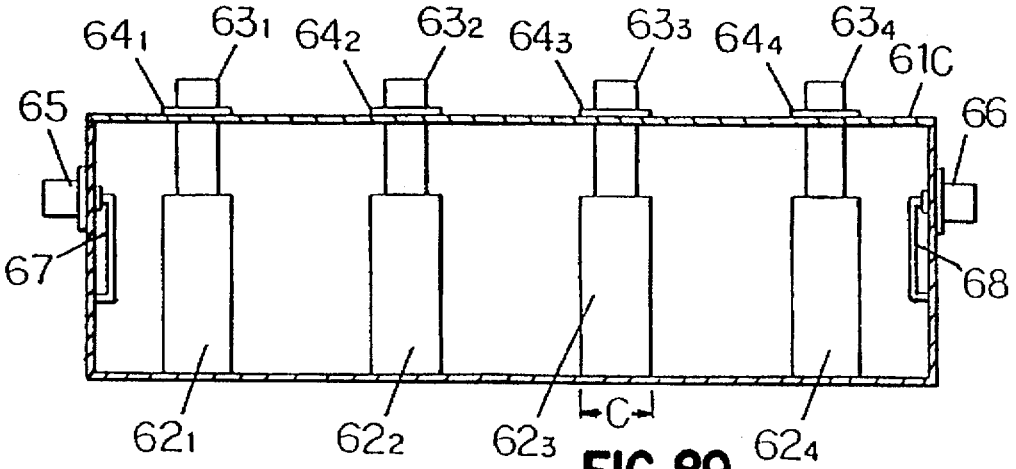
FIG. 89 is a vertical cross section of the filter shown in FIG. 83.
Figure 90:
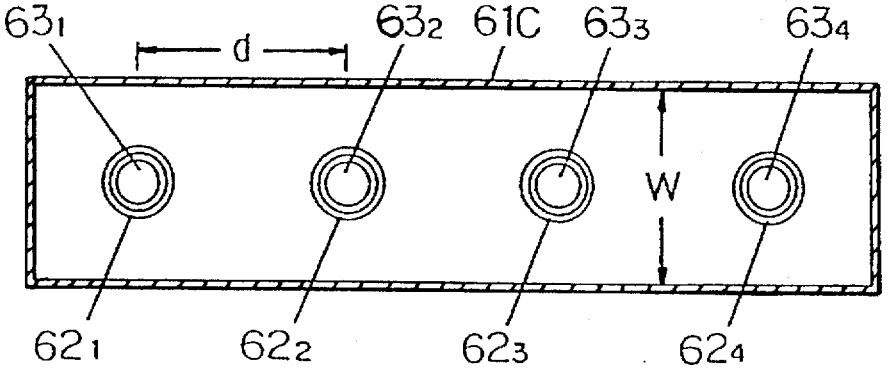
FIG. 90 is a horizontal cross section of the filter shown in FIG. 89.

FIG. 89 is a vertical cross section of a filter constructed using the resonator shown in FIG. 83, and FIG. 90 is a horizontal cross section thereof.

This filter comprises an external conductor 61C, fixed electrodes $\mathbf{62}_1$ through $\mathbf{62}_4$, movable electrodes $\mathbf{63}_1$ through $\mathbf{63}_4$, lock nuts $\mathbf{64}_1$ through $\mathbf{64}_4$ that are used to fix the movable electrodes $\mathbf{63}_1$ through $\mathbf{63}_4$, an input terminal 65, an output terminal 66, an input coupling loop 67, and an output coupling loop 68.

Figure 91:
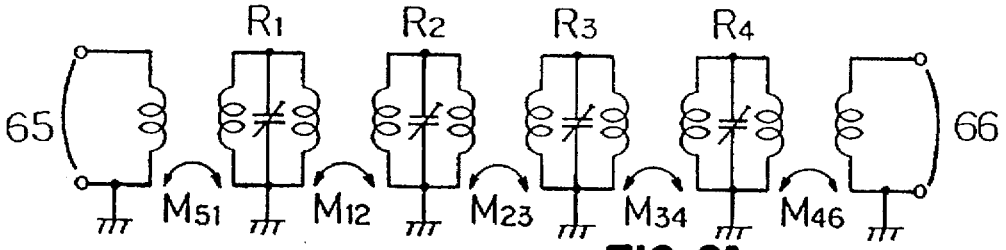
FIG. 91 is an equivalent circuit diagram of the filter shown in FIGS. 89 and 90.

FIG. 91 is an equivalent circuit diagram of the filter shown in FIGS. 89 and 90. Symbols $R_1$ through $R_4$ represent resonance circuits, the symbol $M_{51}$ represents the input magnetic field coupling coefficient, the symbol $M_{46}$ represents the output magnetic field coupling coefficient, and symbols $M_{12}$ through $M_{34}$ represent the interstage magnetic field coupling coefficients.

Figure 92:
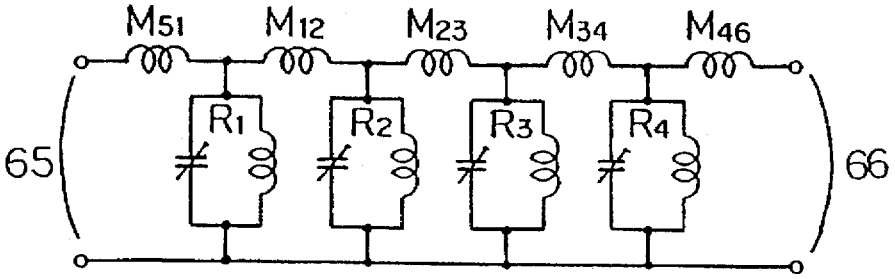
FIG. 92 is a converted equivalent circuit diagram of the equivalent circuit diagram shown in FIG. 91.

FIG. 92 is a converted equivalent circuit diagram of the equivalent circuit diagram shown in FIG. 91, and the symbols are the same as in FIG. 91.

The band-pass filter shown in FIGS. 89 through 92 can be designed in the same manner as the band-pass filter shown in FIGS. 33 through 36.

Figure 93:
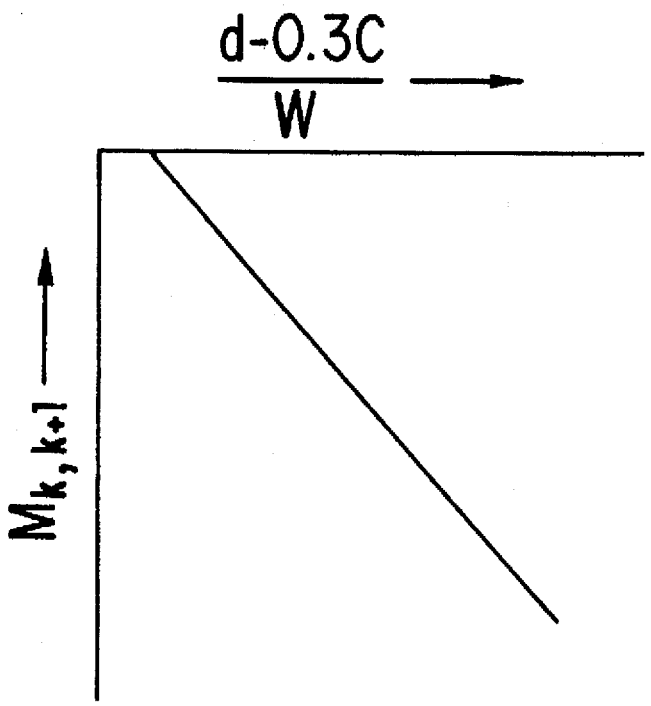
FIG. 93 is a diagram illustrating an example of the relation between the interstage magnetic field coupling coefficient and the center spacing of adjacent variable resonance capacity elements.

FIG. 93 illustrates an example of the relation between the interstage magnetic field coupling coefficient and the center spacing of adjacent resonance capacity elements, obtained as a result of repeated experimentation with prototypes by the inventor. The axis of abscissa represents (d−0.3C)/W where d is the center spacing of adjacent resonance capacity elements (see FIG. 90), C is the external diameter of each of the fixed electrodes $\mathbf{2}_1$ through $\mathbf{2}_4$ that form the variable resonance capacity element (see FIG. 89), and W is the width of the common shield case 61C (see FIG. 90). The axis of ordinate represents the interstage magnetic field coupling coefficient $M_{k,\ k+1}$.

The transmission loss L of the band-pass filter shown in FIGS. 89 through 92 is expressed by equation (13).

Figure 94:
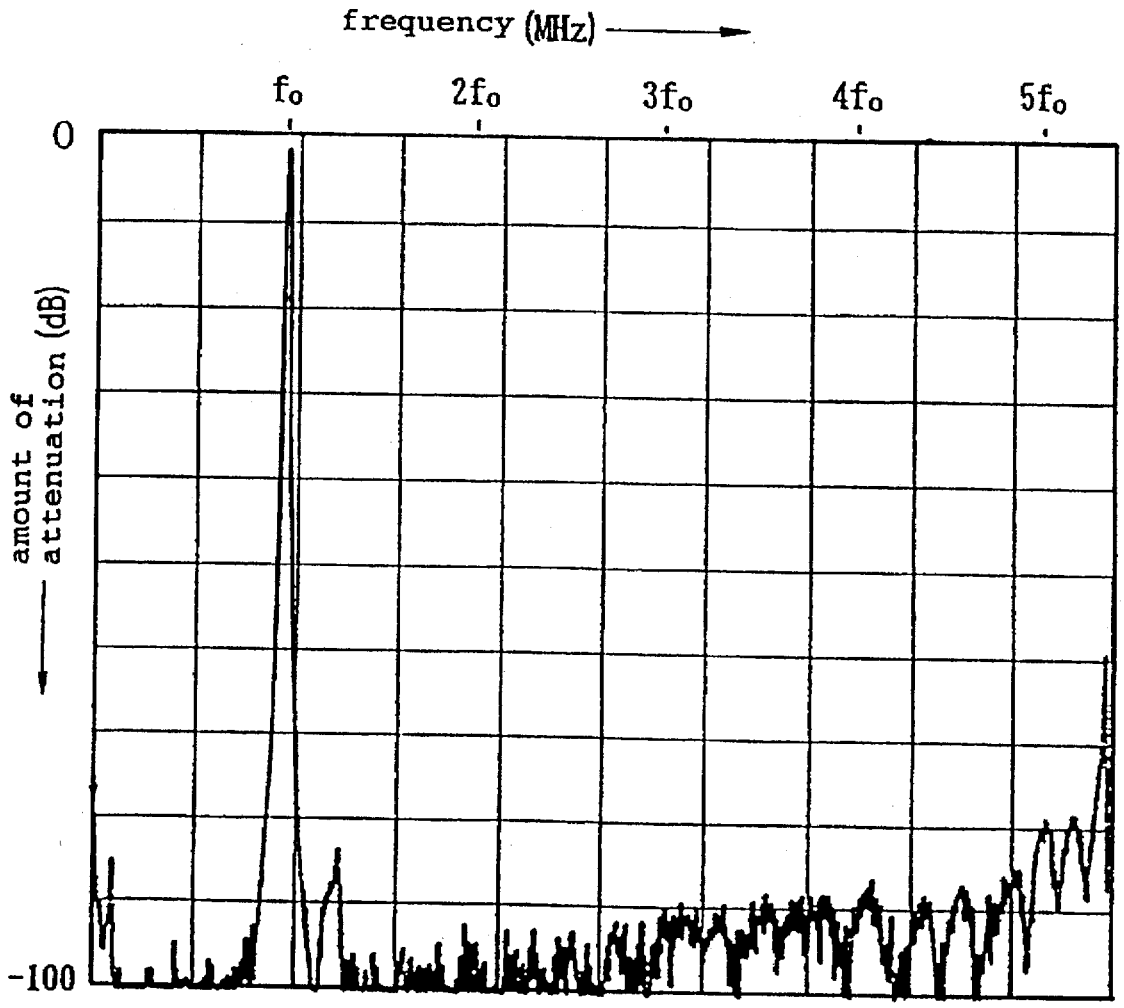
FIG. 94 is a diagram illustrating an example of the transmission characteristics over the wide band of the filter shown in FIGS. 89 through 92.

FIG. 94 is a diagram illustrating an example of the transmission characteristics over the wide band of the filter shown in FIGS. 89 through 92. The axis of abscissa represents the frequency (MHz), with graduations of 300 MHz and a resonance frequency $f_0$ of 565 MHz, while the axis of ordinate represents the amount of attenuation (dB), with graduations of 10 dB.

Figure 95:
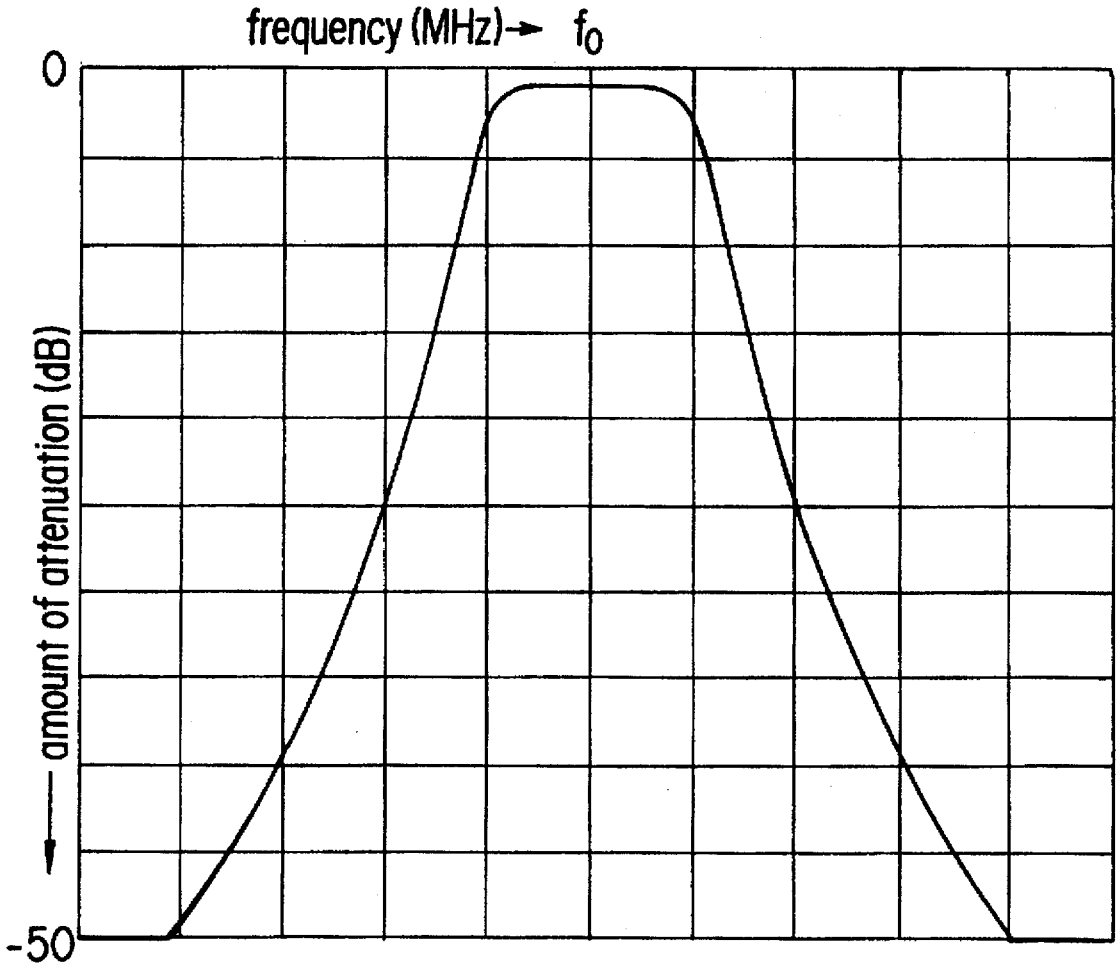
FIG. 95 is an enlarged transmission characteristics diagram near the resonance frequency $f_0$ in FIG. 94.

FIG. 95 is an enlarged transmission characteristics diagram near the resonance frequency $f_0$ in FIG. 94. The axis of abscissa represents the frequency (MHz), with graduations of 5 MHz, while the axis of ordinate represents the amount of attenuation (dB), with graduations of 5 dB.

As shown in FIG. 94, the harmonic components of the resonance frequency $f_0$ are greatly attenuated, since this characteristic is also a characteristic of the resonators composing this filter, the resonator shown in FIG. 83 will have substantially the same characteristics as a lumped constant type of resonator composed of a coil and a capacitor, which are lumped-constant circuit elements.

The irregular waveform present near an attenuation of −80 dB to −100 dB in FIG. 94 is believed to be noise admixed in the measurement device circuit.

Although the filter shown in FIGS. 89 through 92 is constructed such that the required electrical characteristics will be obtained by setting the center spacing of the variable resonance capacity elements according to the required interstage magnetic field coupling coefficient, the required electrical characteristics can also be obtained by arranging the variable resonance capacity elements at a suitable fixed interval and interposing conventional interstage magnetic field coupling adjustment elements between adjacent variable resonance capacity elements.

Figure 96:
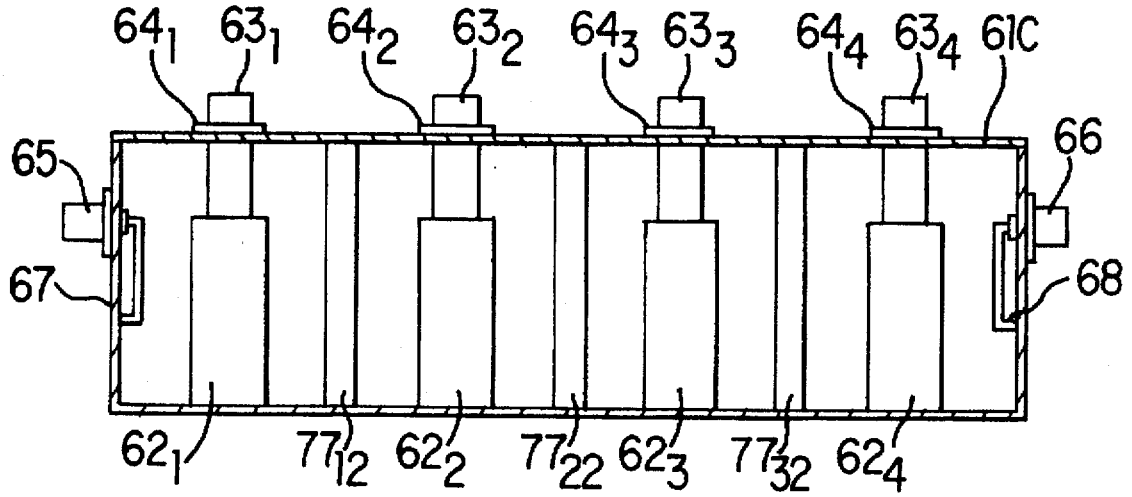
FIG. 96 is a vertical cross section of a filter in which variable resonance capacity elements are arranged at specific intervals, and interstage magnetic field coupling adjustment elements are interposed between adjacent variable resonance capacity elements.
Figure 97:
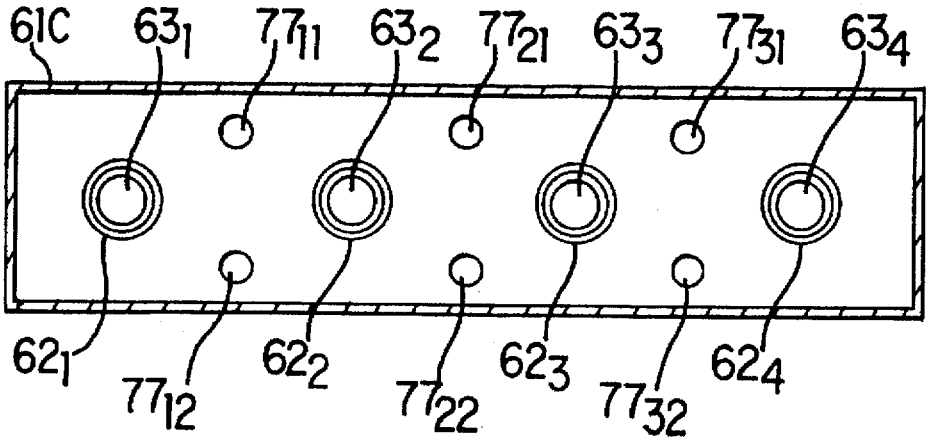
FIG. 97 is a horizontal cross section of the filter shown in FIG. 96.

FIG. 96 is a vertical cross section illustrating an example of the above, and FIG. 97 is a horizontal cross section of the same. In these Figs., reference numerals $\mathbf{77}_{11}$ through $\mathbf{77}_{32}$ represent conventional interstage magnetic field coupling adjustment elements made of round or square rod-shaped or ribbon-shaped conductors. The axial direction of the interstage magnetic field coupling adjustment elements $\mathbf{77}_{11}$ through $\mathbf{77}_{32}$ between adjacent fixed electrodes $\mathbf{62}_1$ and $\mathbf{62}_2$, $\mathbf{62}_2$ and $\mathbf{62}_3$, and $\mathbf{62}_3$ and $\mathbf{62}_4$ is parallel to the axial direction of the fixed electrodes $\mathbf{62}_1$ through $\mathbf{62}_4$, and the both ends of each of the interstage magnetic field coupling adjustment elements $\mathbf{77}_{11}$ through $\mathbf{77}_{32}$ are electrically and mechanically connected to the upper and lower walls of the common shield case 61C.

The interstage magnetic field coupling coefficient can be adjusted to the required value by forming each of the interstage magnetic field coupling adjustment elements $\mathbf{77}_{11}$ through $\mathbf{77}_{32}$ in a suitable thickness, or by suitably increasing or decreasing the number of interstage magnetic field coupling adjustment elements interposed between the adjacent variable resonance capacity elements.

Figure 98:
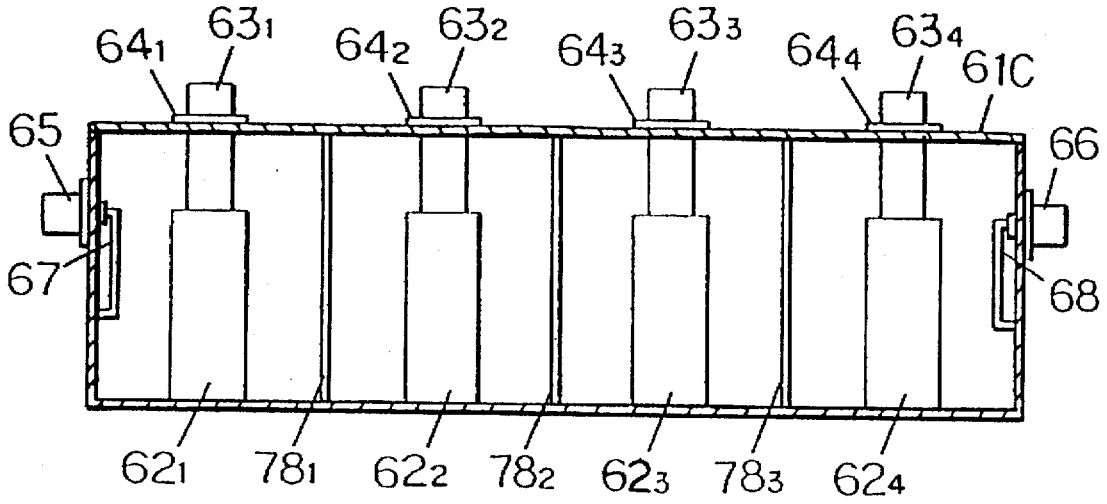
FIG. 98 is a vertical cross section of a filter constructed such that the interstage magnetic field coupling coefficient is adjusted by another type of interstage magnetic field coupling adjustment element.
Figure 99:
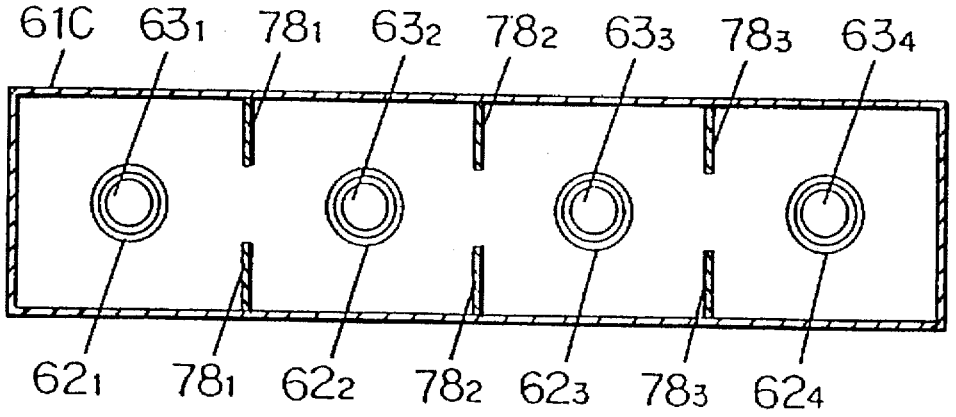
FIG. 99 is a horizontal cross section of the filter shown in FIG. 98.

FIG. 98 is also a vertical cross section of a filter constructed such that the interstage magnetic field coupling coefficient is adjusted by means of interstage magnetic field coupling adjustment elements, and FIG. 99 is a horizontal cross section thereof. In these Figs., reference numerals $78_1$ through $78_3$ represent conventional interstage magnetic field coupling adjustment elements in the shape of a plate. Each plate is at a right angle to the lengthwise direction of the common shield case 61C between adjacent fixed electrodes $62_1$ and $62_2$, $62_2$ and $62_3$, and $62_3$ and $62_4$, each edge of the plate is electrically connected to the upper and lower walls and both side walls of the common shield case 61C, and a magnetic field coupling hole is formed in each plate.

The interstage magnetic field coupling coefficient can be suitably adjusted according to the surface area of the magnetic field coupling holes formed in the interstage magnetic field coupling adjustment elements $78_1$ through $78_3$.

The rest of the structure in FIGS. 96 through 99 is the same as in FIGS. 89 and 90.

Figure 100:
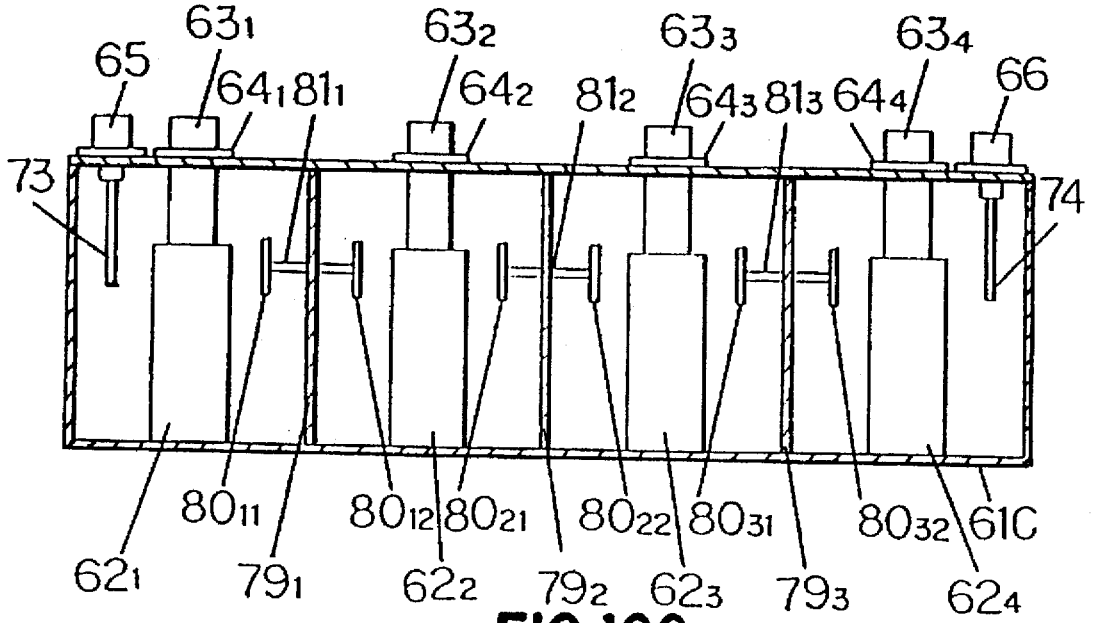
FIG. 100 is a vertical cross section of another example of a filter constructed using the resonator shown in FIG. 83.

FIG. 100 is a vertical cross section of another example of a filter constructed using the resonator shown in FIG. 83.

This filter comprises an external conductor 61C, fixed electrodes $62_1$ through $62_4$, movable electrodes $63_1$ through $63_4$, lock nuts $64_1$ through $64_4$ that are used to fix the movable electrodes $63_1$ through $63_4$, an input terminal 65, and output terminal 66, an input coupling-use probe 73, an output coupling-use probe 74, partition walls $79_1$ through $79_3$ made of conductor plates, capacity formation electrodes $80_{11}$ through $80_{32}$, and connection conductors $81_1$ through $81_3$.

The connection conductors $81_1$ through $81_3$ are inserted through and fixed to the partition walls $79_1$ through $79_3$ while maintaining insulation between connection conductors $81_1$ through $81_3$ and the partition walls $79_1$ through $79_3$. The connection conductor $81_1$ connects the electrodes $80_{11}$ with the electrode $80_{12}$, and capacitively couples the resonator including the fixed electrode $62_1$ with the resonator including the fixed electrode $62_2$. The other resonators are similarly coupled.

Figure 101:
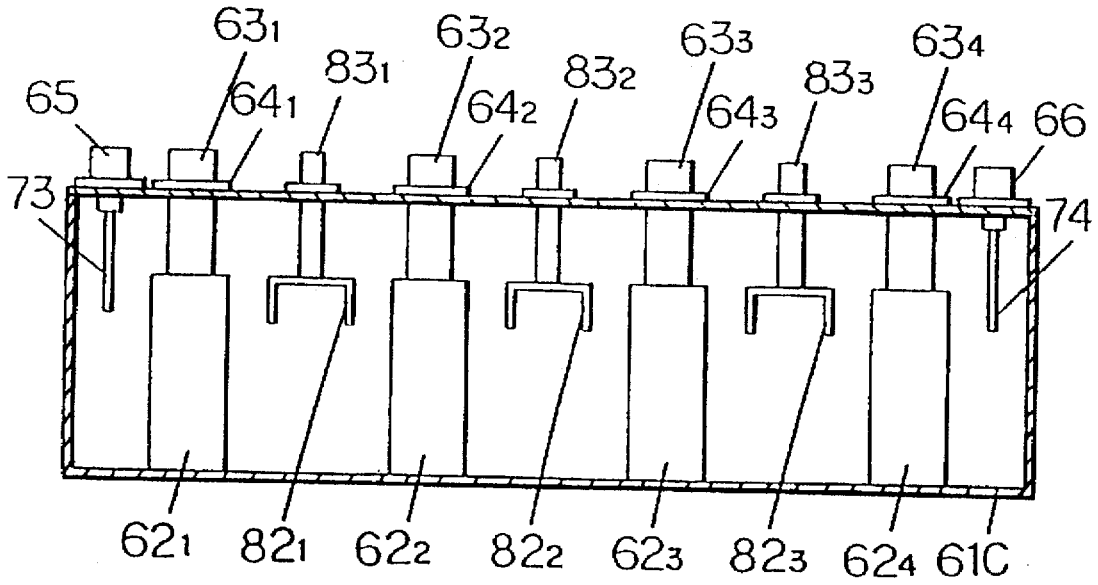
FIG. 101 is a vertical cross section of another example of a filter in which the stages are coupled by capacitive coupling.

FIG. 101 is also a vertical cross section of a filter in which the neighbouring stages are coupled by capacitive coupling.

With this filter, capacity formation electrodes $82_1$ through $82_3$ having U-shaped cross sections, and rotary support shafts $83_1$ through $83_3$ that are rotatably attached to the upper wall of the common shield case 61C maintaining insulation between the support shafts $83_1$ through $83_3$ and the upper wall of the common shield case 61C, are provided in place of the partition walls $79_1$ through $79_3$, the capacity formation electrodes $80_{11}$ through $80_{32}$, and the connection conductors $81_1$ through $81_3$ of the filter in FIG. 100. When the support shaft $83_1$ is rotated, the electrode $82_1$ supported by this support shaft $83_1$ also rotates, thereby changing the interstage coupling capacity coefficient. The other neighbouring stages are similarly coupled.

Although the filters in the embodiments shown in FIGS. 89, 90, and 96 through 101 are examples of cases in which the order of the circuit is 4, the present invention can also be implemented with this order suitably increased or decreased.

In addition, although above embodiments are for cases of a Combline-type filter, the present invention can also be implemented for interdigital filters.

In the filters shown in FIGS. 89, 90, and 96 through 101, any one of the input/output coupling elements in the resonators shown in FIGS. 83 and 86 through 88 as the input/output coupling elements.

The resonators shown in FIGS. 83 and 86 through 88 can be operated as a band elimination filter by connecting one of the terminals to an external circuit using one of the methods shown in FIGS. 52, 55, 58, 61, 64 through 67, and so on.

A band elimination filter of which the elimination band width, the amount of attenuation, etc., can be set and changed at will can be constructed by replacing the various variable capacity elements in FIGS. 76 through 82 with the variable capacity element in FIG. 83.

Figure 102:
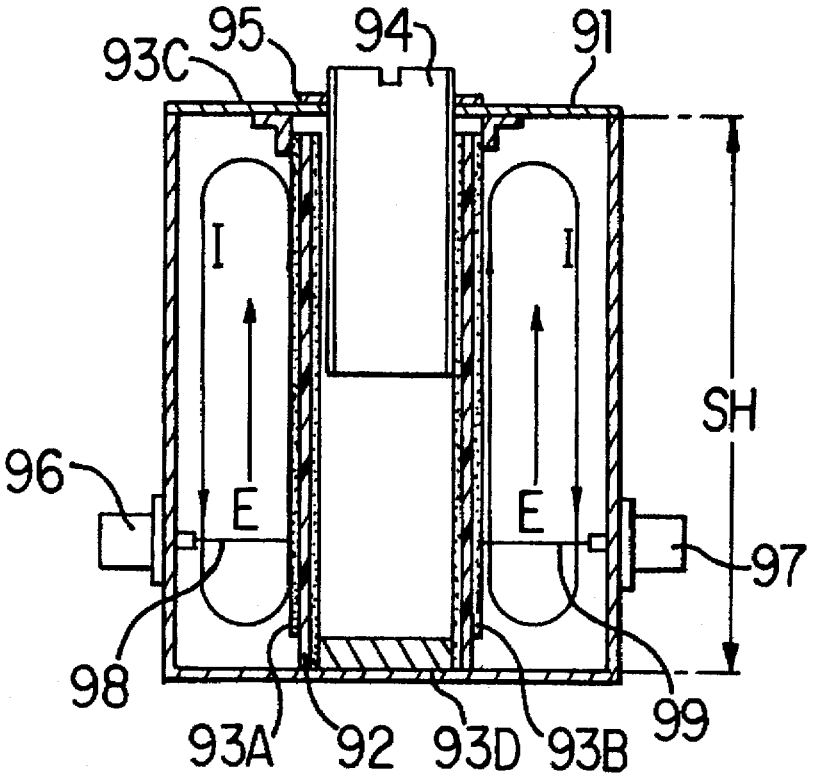
FIG. 102 is a vertical cross section of the twentieth embodiment according to the present invention.
Figure 103:
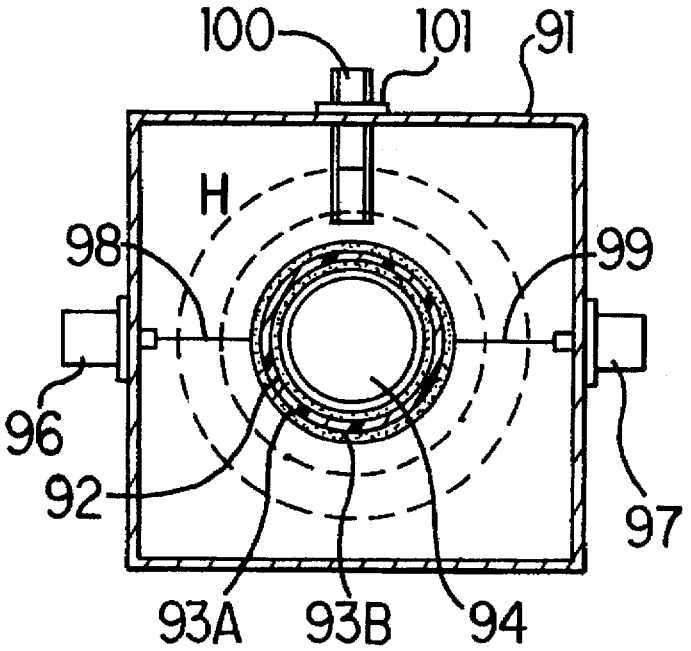
FIG. 103 is a horizontal cross section of the resonator of the twentieth embodiment according to the present invention.

FIG. 102 is a vertical cross section of the resonator of the twentieth embodiment according to the present invention, and FIG. 103 is a horizontal cross section thereof.

The resonator in this embodiment comprises a cubic external conductor 91; a solid dielectric hollow cylinder 92 made of ceramic or hollow (see FIGS. 132–133); a variable resonance capacity element composed of fixed electrodes 93A and 93B, and a movable electrode 94; a fixing member 93C that is used to fix the fixed electrode 93A, a fixing member 93D that is used to fix the fixed electrode 93B, a lock nut 95 that is used to fix the movable electrode 94; an input terminal 96; an output terminal 97; an input coupling wire 98; an output coupling wire 99; a resonance frequency fine-tuning element 100; and a lock nut 101. The external conductor 91 may also be a bottomed cylinder.

The upper and lower ends of the hollow cylinder 92 are a suitable distance apart from, and face the upper and lower walls, respectively, of the external conductor 91. The fixed electrode 93A, 93B are made of a metal thin layer such as silver that is bonded around the inside and outside, respectively, of the hollow cylinder 92. The upper end of the fixed electrode 93A is soldered to the inner side of the conductive fixing member 93C, which is in the form of a flanged hollow cylinder, and the flange of the fixing member 93C is fixed by a screw to the upper wall of the external conductor 91. The lower end of the fixed electrode 93B is attached in elastic contact with the upper portion of the conductive fixing member 93D whose upper portion is provided with a plurality of slits to achieve elasticity and which is in the form of a bottomed hollow cylinder. This fixing member 93D is fixed to the lower wall of the external conductor 91 by a screw, using the threaded hole formed in the bottom of itself.

The movable electrode 94 made of a solid or hollow cylindrical conductor (such as copper) threaded around its outside, and is screwed into the threaded hole formed in the upper wall of the external conductor 91 coaxially with the fixed electrodes 93A and 93B. The insertion length of the movable electrode 94 into the hollow cylinder 92, and therefore the insertion length of the movable electrode 94 into the fixed electrode 93B can be varied by the rotation of the movable electrode 94 in a forward or reverse direction to move the movable electrode 94 forward or backward. The movable electrode 94 is fixed by the lock nut 95.

The input terminal 96 and the output terminal 97 consist, for example, of coaxial plugs, and the external conductor that forms these coaxial plugs is connected to the external conductor 91. The input coupling wire 98 is connected at one end to the internal conductor of the coaxial plug 96, and at the other end to the fixed electrode 93A. The output coupling wire 99 is connected at one end to the internal conductor of the coaxial plug 97, and at the other end to the fixed electrode 93A. The fine-tuning element 100 is made of a metal screw threaded into the wall of the external conductor 91, and is fixed by a lock nut 101.

Figure 104:
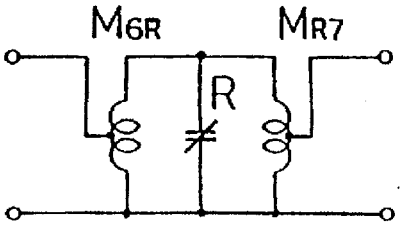
FIG. 104 is an equivalent circuit diagram of the resonator shown in FIG. 103.

With a resonator constructed in this manner, a parallel resonance circuit whose equivalent circuit is shown in FIG. 104, is formed by the distributed inductance of the external conductor 91 and the capacity of the variable resonance capacity element composed of the solid dielectric hollow cylinder 92, the fixed electrodes 93A and 93B, and the movable electrode 94.

In FIG. 104, the symbol R represents the resonance circuit, the symbol $M_{6R}$ represents the input magnetic field coupling coefficient, and the symbol $M_{R7}$ represents the output magnetic field coupling coefficient.

When high-frequency power is applied, for example, to the coaxial plug 96, the electromagnetic field distribution in this resonator will be such that the electric field vector is expressed by the solid arrowed line E in FIG. 102, the current by the solid arrowed line I in FIG. 102, and the magnetic field by the broken line H in FIG. 103.

Since inductance is relatively small, and the capacitance is relatively large in this resonator, this resonator is a low impedance type with good withstand voltage characteristics.

If a ceramic with a high dielectric constant and a dielectric loss that is nearly zero is used as the hollow cylinder 92 made of a solid dielectric in the variable resonance capacity element, then the Q ($Q_u$) of the variable resonance capacity element consisting of the solid dielectric hollow cylinder 92, the fixed electrodes 93A and 93B, and the movable electrode 94 can be ignored. In addition, the electronic energy that can be accumulated in this resonator will correspond to the volume of the external conductor 91, and the resistance in the metal portion of this resonator can be kept extremely low, so that an extremely large unloaded Q can be obtained.

The inventor was able to obtain the following experimental equation (16) for the unloaded Q ($Q_u$) through the use of prototypes whose external conductor 91, fixed electrodes 93A and 93B, and movable electrode 94 are made of copper, although the magnitude of the unloaded Q ($Q_u$) will vary with the ratio of the inductance to the capacitance of the resonator.

$$Q_u \approx 20 f_0^{1/2} \cdot SH \quad (16)$$

where $f_0$ is the resonance frequency (MHz) and SH is the height (cm) of the external conductor 91 (cm) (see FIG. 102).

Figure 105:
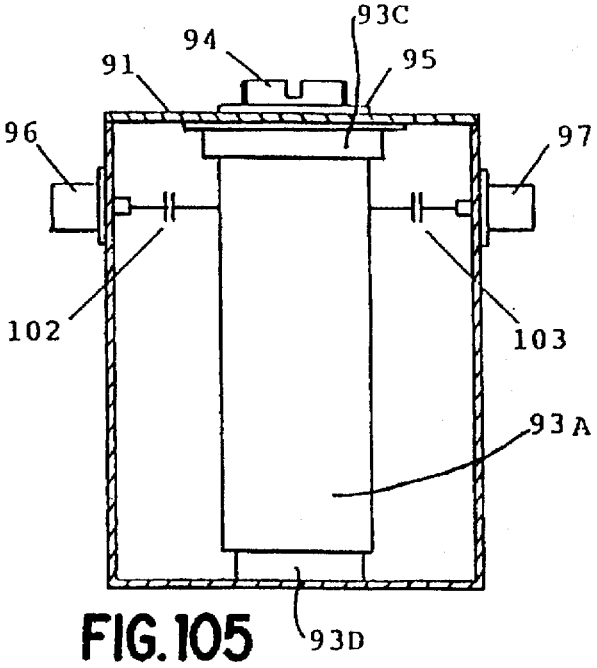
FIG. 105 is a diagram illustrating an example in the twentieth embodiment in which the input terminal 96 and the fixed electrode 93 are capacitively coupled by the capacity element 102, and the output terminal 97 and the fixed electrode 93 by the capacity element 103.
Figure 106:
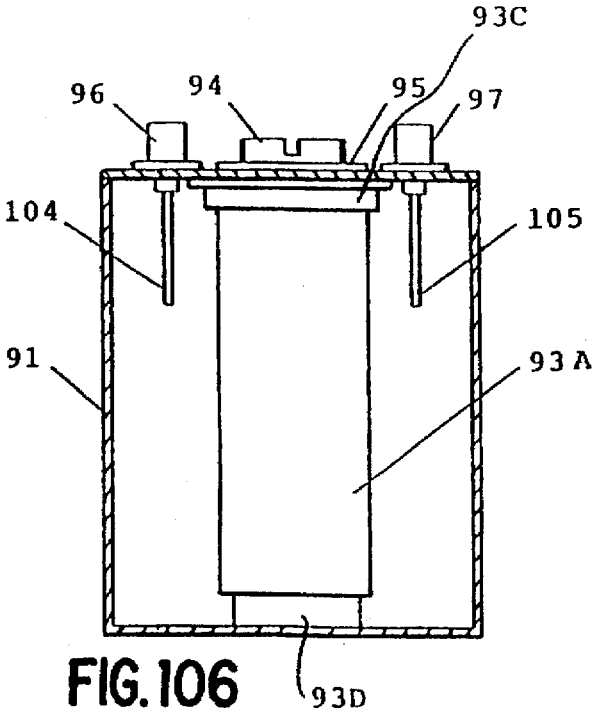
FIG. 106 is a diagram illustrating an example in the twentieth embodiment in which probes 104 and 105 are used as the input/output coupling means.

Although FIG. 102 illustrates an example of a case in which tap coupling by the coupling wires 98 and 99 is used as means for coupling in high-frequency fashion the input terminal 96 with the fixed electrode 93A, and the output terminal 97 with the fixed electrode 93A, means for capacitively coupling the input terminal 96 with the fixed electrode 93A via the capacity element 102 and means for capacitively coupling the output terminal 97 with the fixed electrode 93A via the capacity element 103 may also be used, as shown in FIG. 105, or probes 104 and 105 may be used as the input/output coupling means, as shown in FIG. 106. In addition, loops 106 and 107 may be used as the input/output coupling means, as shown in FIG. 107.

Figure 107:
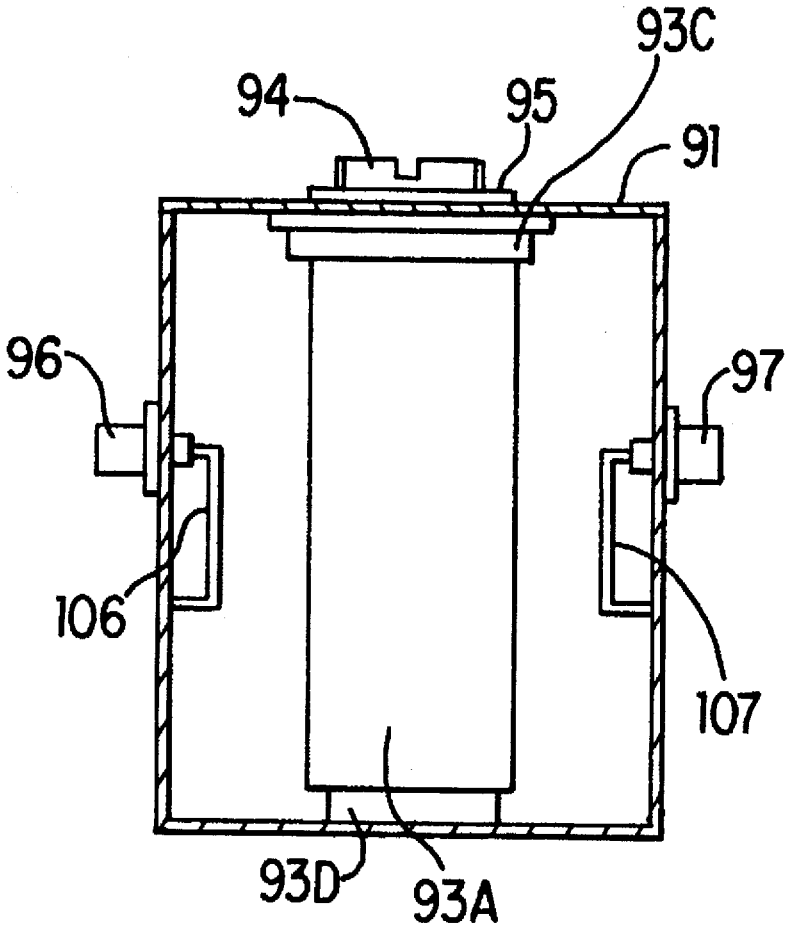
FIG. 107 is a diagram illustrating an example in the twentieth embodiment in which loops 106 and 107 are used as the input/output coupling means.

FIGS. 105 through 107 correspond to the cross section of FIG. 103 viewed from below, omitting the lower side wall of external conductor 91, and hereinafter the same applies to FIG. 108 similar to FIGS. 105 through 107.

The structure not discussed in the explanation of FIGS. 105 through 107 are the same as in FIG. 102.

Figure 108:
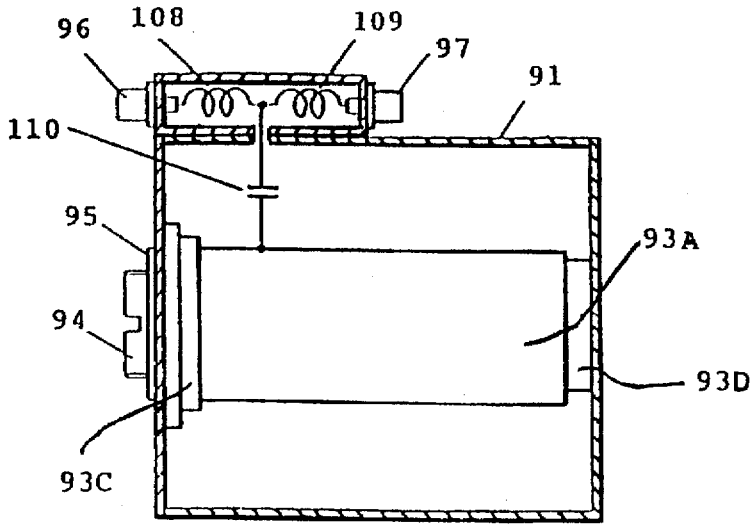
FIG. 108 is a vertical cross section of the resonator of the twenty-first embodiment according to the present invention.

FIG. 108 is a vertical cross section of the resonator of the twenty-first embodiment according to the present invention.

In this embodiment, a low-pass filter circuit is formed by inductance elements 108 and 109 for the compensation of transmission characteristics, interposed between the connection terminals 96 and 97 with the external circuit, and a capacity element 110 connected between the fixed electrode 93A that forms the resonance capacity element and the connection point of the inductance elements 108 and 109. With this resonator, as shown by the transmission characteristics in FIG. 110 where the axis of abscissa represents the frequency and the axis of ordinate represents the amount of attenuation, the slope of the attenuation characteristic curve in the frequency region lower than the resonance frequency $f_0$ is steep, while the slope of the attenuation characteristic curve in the frequency region higher than the resonance frequency $f_0$ is gentle, and a transmission inhibition band is formed in the frequency region including the resonance frequency $f_0$.

Figure 109:
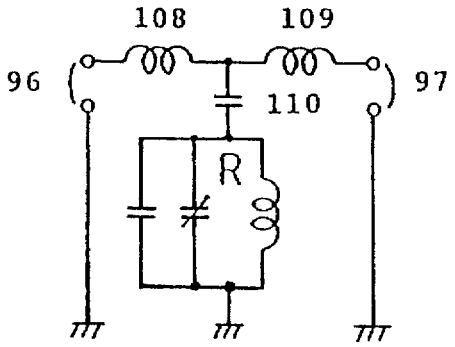
FIG. 109 is an equivalent circuit diagram of the resonator shown in FIG. 108.

FIG. 109 is an equivalent circuit diagram of the resonator shown in FIG. 108. The symbol R represents the resonance circuit composed of the external conductor 91 and the variable resonance capacity element, and the rest of the symbols are the same as in FIG. 108.

The resonance frequency $f_0$ of the circuit composed of the resonance circuit R and the coupling-use capacity element 112 changes according to the capacitance of the coupling-use capacity element 110, and the fine tuning of the resonance frequency can be performed by the provision of an adjustment element similar to the resonance frequency fine-tuning element 100 shown in FIG. 103.

Figure 111:
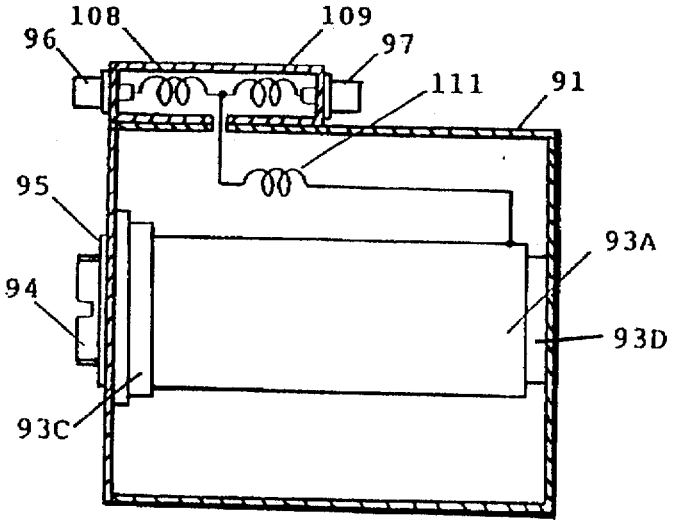
FIG. 111 is a vertical cross section of the resonator of the twenty-second embodiment according to present invention.

FIG. 111 is a vertical cross section of the resonator of the twenty-second embodiment according to the present invention.

This embodiment differs from the twenty-first embodiment shown in FIG. 108 in that the coupling of the connection point of the inductance elements 108 and 109 with the fixed electrode 93A is performed by tap coupling using an inductance element 111, and in that the resonance frequency $f_0$ of the circuit composed of the resonance circuit R and the coupling-use inductance element 111 changes according to the inductance of the inductance element 111. The rest of the structure and operation is substantially the same as in the twenty-first embodiment shown in FIG. 108.

Figure 112:
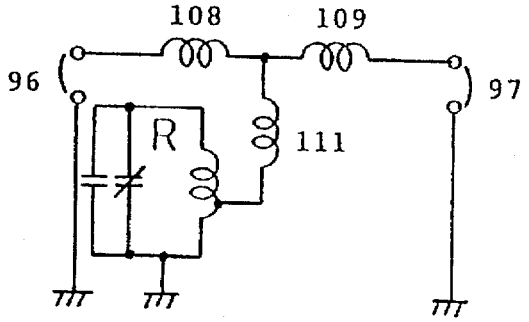
FIG. 112 is an equivalent circuit diagram of the resonator shown in FIG. 111.

FIG. 112 is an equivalent circuit diagram of the resonator shown in FIG. 111. Except for the inductance element 111, all of the symbols are the same as in FIG. 109.

Figure 110:
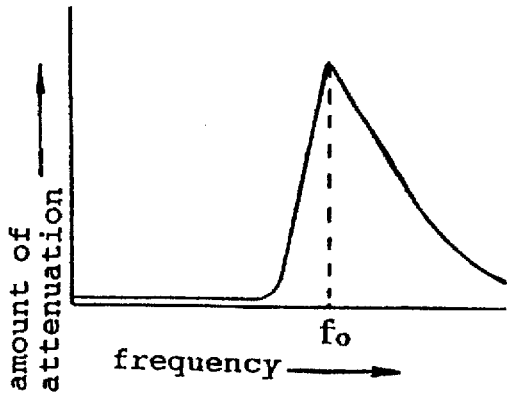
FIG. 110 is a diagram illustrating the transmission characteristics of the resonator shown in FIG. 108.
Figure 113:
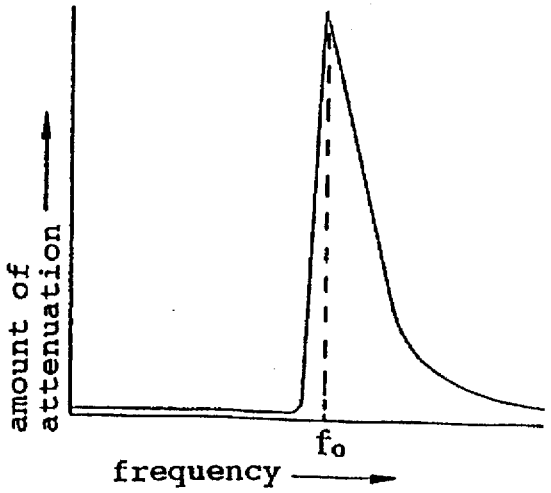
FIG. 113 is a diagram illustrating the transmission characteristics of the resonator shown in FIG. 111.

FIG. 113 where the axis of abscissa and the axis of ordinate are the same as in FIG. 110, is a diagram illustrating the transmission characteristics of the resonator shown in FIG. 111, which is substantially the same as the characteristics shown in FIG. 110.

Figure 114:
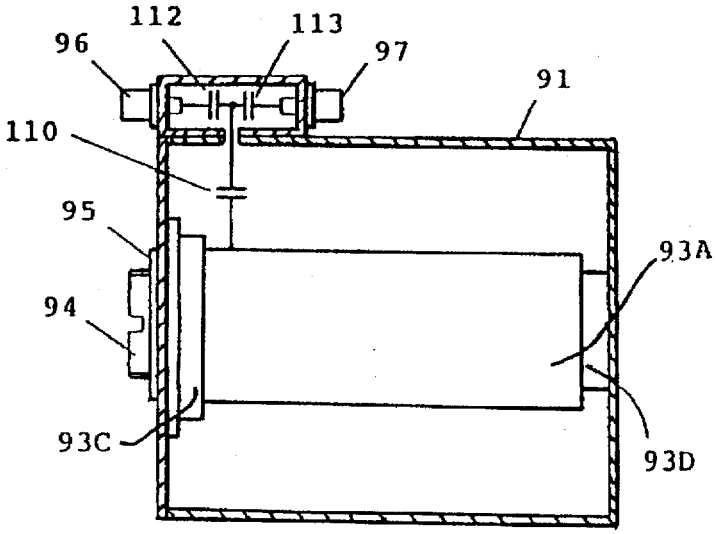
FIG. 114 is a vertical cross section of the resonator in the twenty-third embodiment according to the present invention.

FIG. 114 is a vertical cross section of the resonator of the twenty-third embodiment according to the present invention. This embodiment differs from the twenty-first embodiment shown in FIG. 108 in that the inductance elements 108 and 109 used in the twenty-first embodiment shown in FIG. 108 are replaced with capacity elements 112 and 113. The rest of the structure is the same as in the twenty-first embodiment shown in FIG. 108.

Figure 115:
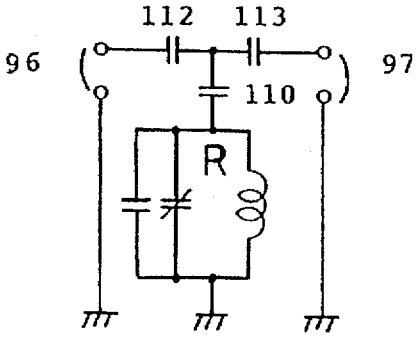
FIG. 115 is an equivalent circuit diagram of the resonator shown in FIG. 114.

FIG. 115 is an equivalent circuit diagram of the resonator shown in FIG. 114. Except for the capacity elements 112 and 113, all of the symbols are the same as in FIG. 109.

Figure 116:
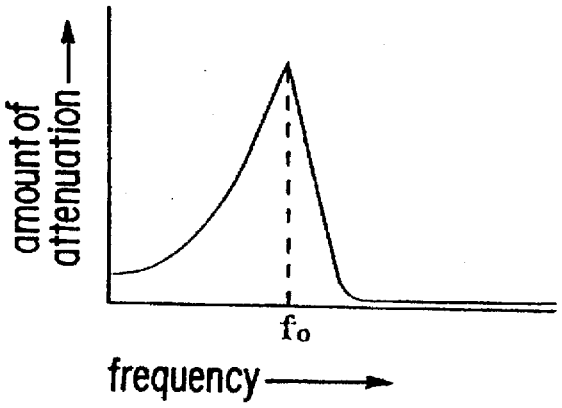
FIG. 116 is a diagram illustrating the transmission characteristics of the resonator shown in FIG. 114.

FIG. 116 where the axis of abscissa and the axis of ordinate are the same as in FIG. 110, is a diagram illustrating the transmission characteristics of the resonator shown in FIG. 114. In this embodiment, the slope of the attenuation characteristic curve in the frequency region lower than the resonance frequency $f_0$ is gentle, while the slope of the attenuation characteristic curve in the frequency region higher than the resonance frequency $f_0$ is steep, and a transmission inhibition band is formed in the frequency region including the resonance frequency $f_0$.

Figure 117:
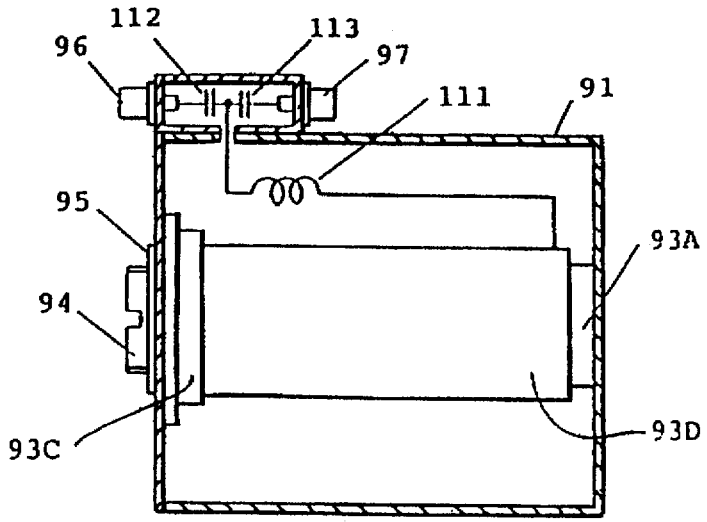
FIG. 117 is a vertical cross section of the resonator of the twenty-fourth embodiment according to the present invention.

FIG. 117 is a vertical cross section of the resonator of the twenty-fourth embodiment according to the present invention.

This embodiment is the same as the twenty-third embodiment shown in FIG. 115 in that the capacity elements 112 and 113 are used as transmission characteristic compensation elements, and is the same as the twenty-second embodiment shown in FIG. 111 in that tap coupling is performed using the inductance element 111 as a coupling element. The rest of the structure is the same as in the twenty-third embodiment shown in FIG. 114.

Figure 118:
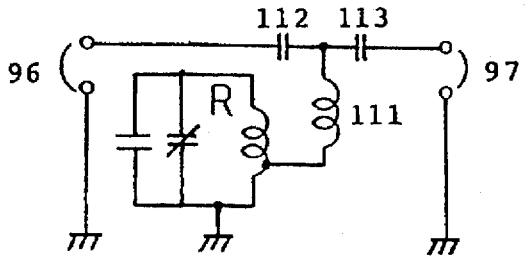
FIG. 118 is an equivalent circuit diagram of the resonator shown in FIG. 117.

FIG. 118 is an equivalent circuit diagram of the resonator shown in FIG. 117. Except for the inductance element 111, all of the symbols are the same as in FIG. 115.

Figure 119:
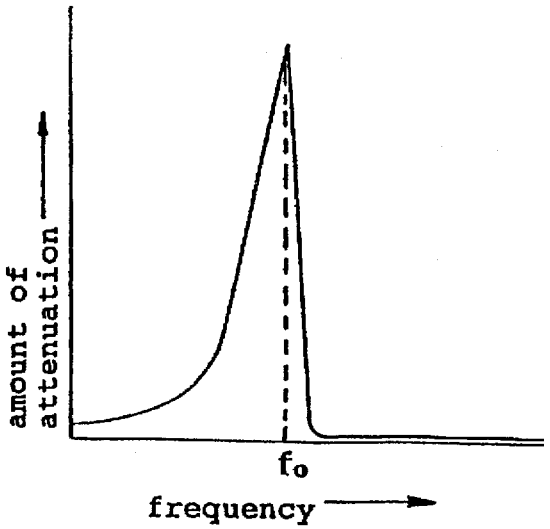
FIG. 119 is a diagram illustrating the transmission characteristics of the resonator shown in FIG. 117.
Figure 120:
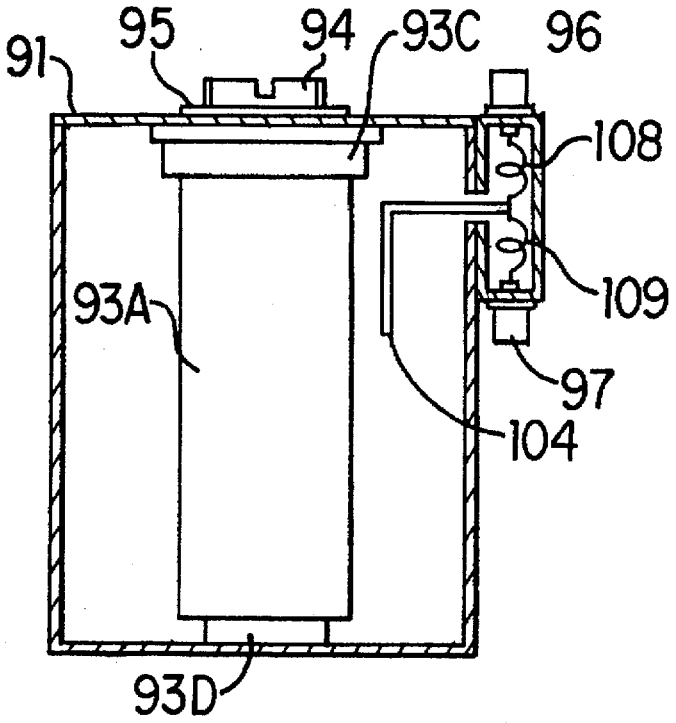
Figure 121:
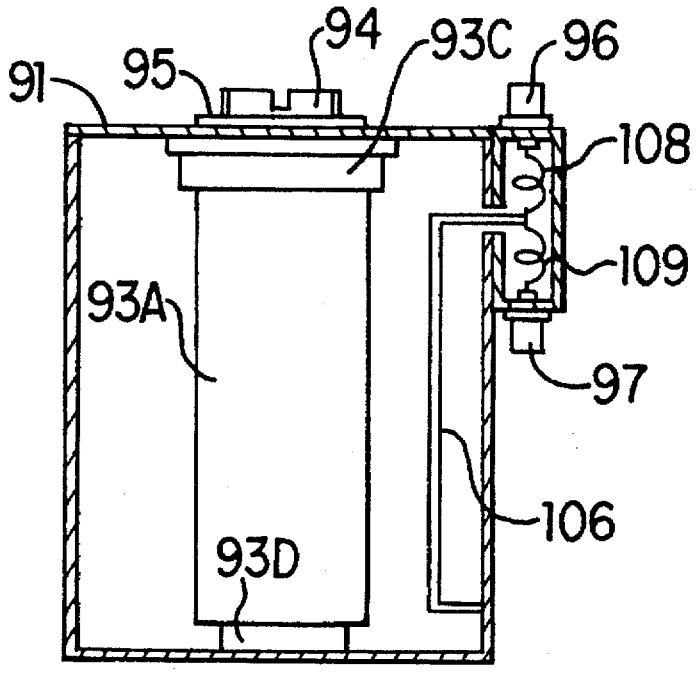
Figure 122:
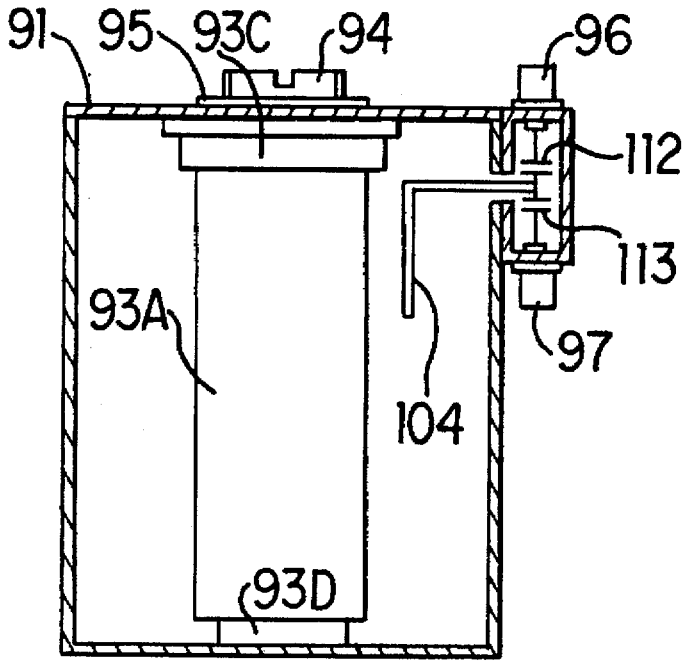
Figure 123:
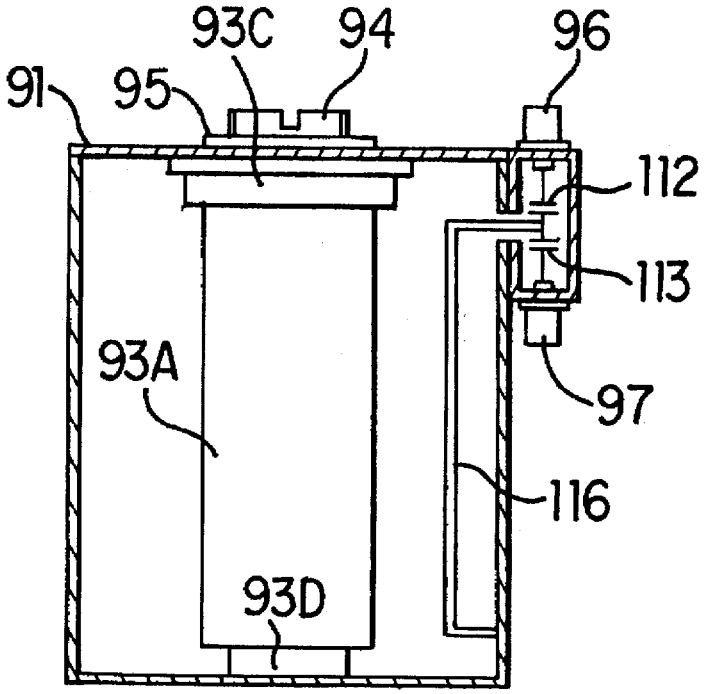

FIG. 119 where the axis of abscissa and the axis of ordinate are the same as in FIG. 116, is a diagram illustrating the transmission characteristics of the resonator shown in FIG. 117, which is substantially the same as the characteristics shown in FIG. 116.

FIGS. 120 through 123 are cross sections illustrating the twenty-fifth through twenty-eighth embodiments of the present invention. The resonator in FIG. 120 has a probe 104 in place of the coupling element 110 shown in FIG. 108; the resonator in FIG. 121 has a loop 106 in place of the coupling element 110 shown in FIG. 108; the resonator in FIG. 122 has a probe 104 in place of the coupling element 110 shown in FIG. 114; and the resonator in FIG. 123 has a loop 106 in place of the coupling element 110 shown in FIG. 114. The rest of the structure in the respective figs. are the same as the structure in FIG. 108 or 114.

FIG. 124 is a vertical cross section of a filter constructed using the resonator shown in FIG. 102, and FIG. 125 is a horizontal cross section thereof.

This filter comprises an external conductor 91C; fixed electrodes $\mathbf{93A_1}$ through $\mathbf{93A_4}$ and $\mathbf{93B_1}$ through $\mathbf{93B_4}$ similar to the fixed electrodes 93A and 93B shown in FIG. 102; solid dielectric hollow cylinders $\mathbf{92_1}$ through $\mathbf{92_4}$ similar to the solid dielectric hollow cylinder 92 shown in FIG. 102; fixing members $\mathbf{93C_1}$ through $\mathbf{93C_4}$ that are used to fix the fixed electrodes $\mathbf{93A_1}$ through $\mathbf{93A_4}$; fixing members $\mathbf{93D_1}$ through $\mathbf{93D_4}$ that are used to fix the fixed electrodes $\mathbf{93B_1}$ through $\mathbf{93B_4}$; variable electrodes $\mathbf{94_1}$ through $\mathbf{94_4}$ that make up the variable resonance capacity element along with the fixed electrodes $\mathbf{93A_1}$ through $\mathbf{93A_4}$ and $\mathbf{93B_1}$ through $\mathbf{93B_4}$ and are similar to the movable electrode 94 shown in FIG. 102; lock nuts $\mathbf{95_1}$ through $\mathbf{95_4}$ that are used to fix the variable electrodes $\mathbf{94_1}$ through $\mathbf{94_4}$; an input terminal 96; an output terminal 97; an input coupling wire 98; an output coupling wire 99; resonance frequency fine-tuning elements $\mathbf{100_1}$ through $\mathbf{100_4}$; and lock nuts $\mathbf{101_1}$ through $\mathbf{101_4}$ that are used to fix the fine-tuning elements $\mathbf{100_1}$ through $\mathbf{100_4}$.

FIG. 126 is an equivalent circuit diagram of the filter shown in FIGS. 124 and 125. Symbols $R_1$ through $R_4$ represent resonance circuits, the symbol $M_{61}$ represents the input magnetic field coupling coefficient, the symbol $M_{47}$ represents the output magnetic field coupling coefficient, and symbols $M_{12}$ through $M_{34}$ represent the interstage magnetic field coupling coefficients.

FIG. 127 is a converted equivalent circuit diagram of the equivalent circuit diagram shown in FIG. 126, and the symbols are the same as in FIG. 126.

Although FIGS. 124 through 127 illustrate a case in which the input/output coupling elements are made of the tap coupling wires 98 and 99, a capacity coupling element made of the capacitors 102 and 103 or the probes 104 and 105 or a magnetic field coupling element made of the loops 106 and 107 shown in FIGS. 105 through 107 may also be used to implement the present invention.

The band-pass filter shown in FIGS. 124 through 127 can be designed in the same manner as the band-pass filter shown in FIGS. 33 through 36.

Figure 128:
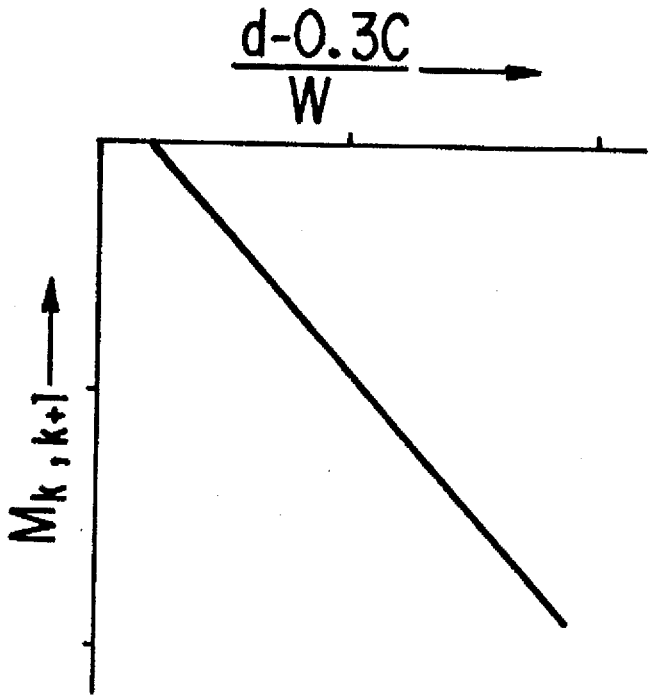

FIG. 128 illustrates an example of the relation between the interstage magnetic field coupling coefficient and the center spacing of adjacent resonance capacity elements, obtained as a result of repeated experimentation with prototypes by the inventor. The axis of abscissa represents (d–0.3C)/W where d is the center spacing of adjacent resonance capacity elements (see FIG. 124), C is the external diameter of the fixed electrodes $\mathbf{93A_1}$ through $\mathbf{93A_4}$ that form the variable resonance capacity element (see FIG. 124), and W is the width of the external conductor 91C (see FIG. 125). The axis of ordinate represent the interstage magnetic field coupling coefficient $M_{k,\ k+1}$.

The transmission loss L of the band-pass filter shown in FIGS. 124 through 127 is expressed by equation (13).

An example of the transmission characteristics of the filter shown in FIGS. 124 through 127 is shown in FIG. 40.

Figure 129:
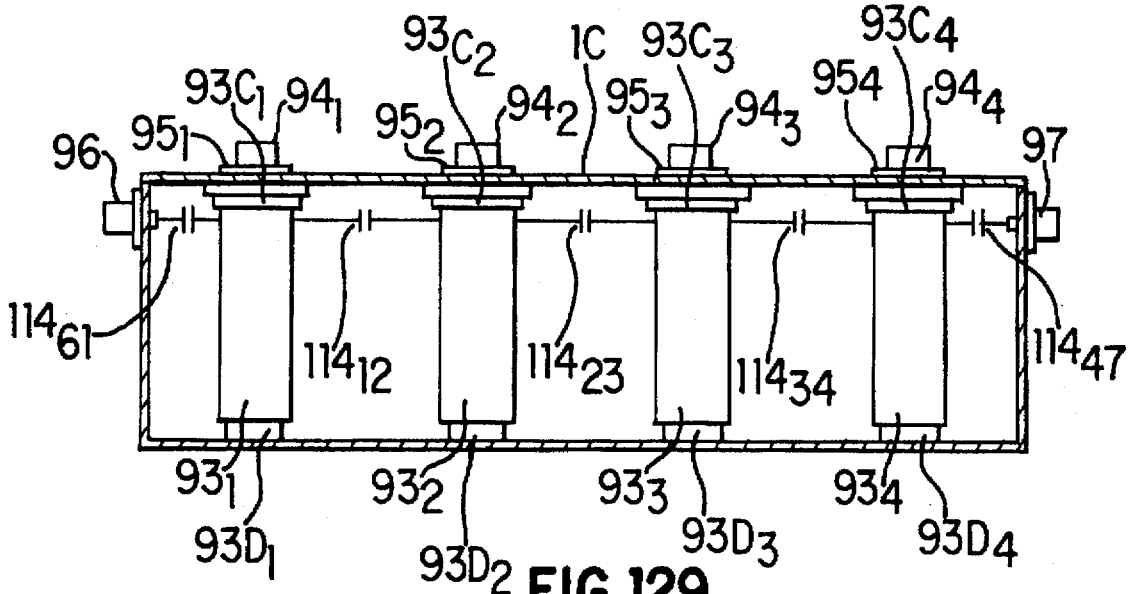

FIG. 129 is a vertical cross section of a band-pass filter in which the interstage coupling consists of capacitive coupling.

This filter comprises an external conductor 91C; fixed electrodes $\mathbf{93A_1}$ through $\mathbf{93A_4}$, solid dielectric hollow cylinders $\mathbf{92_1}$ through $\mathbf{92_4}$ and fixed electrodes $\mathbf{93B_1}$ through $\mathbf{93B_4}$ that are provided concentrically to the interiors of the fixed electrodes $\mathbf{93A_1}$ through $\mathbf{93A_4}$, although not shown in the FIG. 129; fixing members $\mathbf{93C_1}$ through $\mathbf{93C_4}$; fixing members $\mathbf{93D_1}$ through $\mathbf{93D_4}$; lock nuts $\mathbf{95_1}$ through $\mathbf{95_4}$; an input terminal 96; an output terminal 97; an input coupling capacity element $\mathbf{114_{61}}$; interstage coupling capacity elements $\mathbf{114_{12}}$ through $\mathbf{114_{34}}$; and an output coupling capacity element $\mathbf{114_{47}}$.

Figure 130:
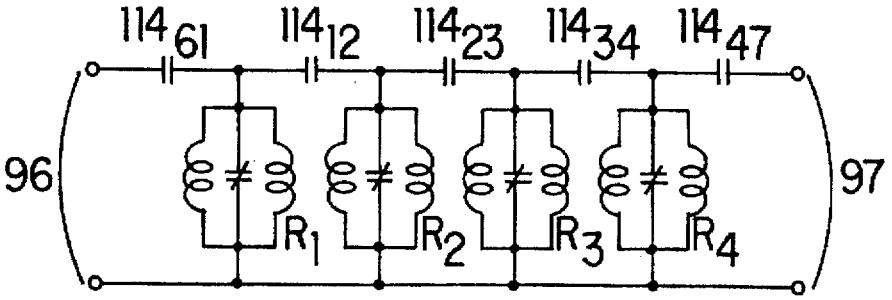

FIG. 130 is an equivalent circuit diagram of the band-pass filter shown in FIG. 129. Symbols $R_1$ through $R_4$ represent resonance circuits, the reference numeral $\mathbf{114_{61}}$ is the input coupling capacity, reference numeral $\mathbf{114_{12}}$ through $\mathbf{114_{34}}$ represent the interstage coupling capacity, and the reference numerals $\mathbf{114_{47}}$ represent the output coupling capacity.

Figure 131:
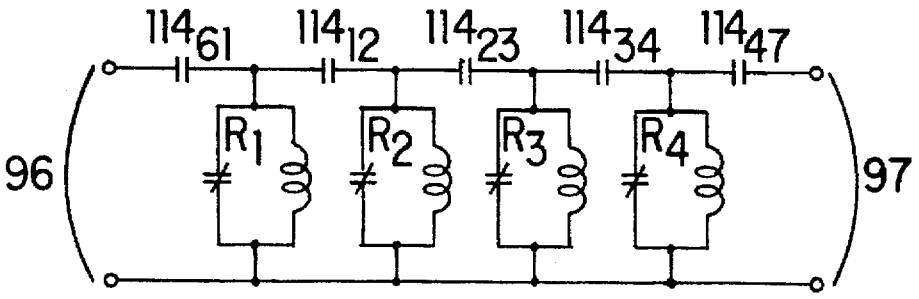

FIG. 131 is a converted equivalent circuit diagram of the equivalent circuit diagram shown in FIG. 130, and the symbols are the same as in FIG. 130.

Although FIG. 129 illustrates an example of a case in which the input/output coupling elements consist of capacity elements, tap coupling wires, probes, loops, or other such high-frequency coupling means may also be used.

An example of the transmission characteristics of the band-pass filter shown in FIG. 129 is shown in FIG. 40.

It is also possible to use the variable resonance capacity element shown in FIG. 102 (comprising the solid dielectric hollow cylinder 92, the fixed electrodes 93A and 93B, the fixing members 93C and 93D, the movable electrode 94, and the lock nut 95) instead of the variable resonance capacity element of the filter in FIG. 76 or 80 (comprising the solid dielectric hollow cylinder 32, the fixed electrode 33, the movable electrode 34, and the lock nut 35 of the resonator shown in FIG. 46). In this case, the transmission characteristics will be the same as the transmission characteristics of the filter in FIG. 76 or 80 except that the usable frequency band will be lower because of the fixed capacity produced by the solid dielectric hollow cylinder 92 and the fixed electrodes 93A and 93B.

In addition, in the embodiments shown in FIGS. 102 through 131, the fixed electrodes 93A and 93B can be constructed from a hollow cylinder made of a metal conductor that has been strengthened by making the walls thicker, and an air layer can be used instead of the hollow cylinder 92 made of a solid dielectric.

What is claimed is:

1. A resonator comprising:

an external conductor having upper and lower walls;

a variable resonance capacity element comprising a hollow dielectric cylinder having inner and outer surfaces and upper and lower end portions facing the upper and lower walls, respectively, of said external conductor a suitable distance away, a first fixed electrode composed of a metal thin layer that adheres around the inner surface of said hollow dielectric cylinder and has a lower end portion electrically connected to the lower wall of said external conductor and an upper end portion separated from the upper wall of said external conductor, a second fixed electrode composed of a metal thin layer that adheres around the outer surface of said hollow dielectric cylinder defining a circumferential space with said external conductor and has an upper end portion electrically connected to the upper wall of said external conductor and an lower end portion separated from the lower wall of said external conductor, and a hollow or solid cylindrical movable electrode that is coaxial with said first and second fixed electrodes and is attached to the upper wall of said external conductor so that an insertion length of said movable electrode into said hollow dielectric cylinder can be varied;

an input terminal having an inner conductor;

an output terminal having an inner conductor; and means provided in said circumferential space for connecting said second fixed electrode to the inner conductor of said input terminal and the inner conductor of said output terminal in a high-frequency fashion.

2. A resonator comprising:

an external conductor having upper and lower walls;

a variable resonance capacity element comprising a hollow dielectric cylinder having inner and outer surfaces and upper and lower end portions facing the upper and lower walls, respectively, of said external conductor a suitable distance away, a first fixed electrode composed of a metal thin layer that adheres around the inner surface of said hollow dielectric cylinder and has a lower end portion electrically connected to the lower wall of said external conductor and an upper end portion separated from the upper wall of said external conductor, a second fixed electrode composed of a metal thin layer that adheres around the outer surface of said hollow dielectric cylinder to define a circumferential space with said external conductor and has an upper end portion electrically connected to the upper wall of said external conductor and an lower end portion separated from the lower wall of said external conductor, and a hollow or solid cylindrical movable electrode that is coaxial with said first and second fixed electrodes and is attached to the upper wall of said external conductor so that an insertion length of said movable electrode into said hollow dielectric cylinder can be varied;

an input terminal having an inner conductor;

an output terminal having an inner conductor;

two inductance elements or two capacity elements connected in series at a connection point between said input terminal and said output terminal for compensation of transmission characteristics; and means provided in said circumferential space for connecting said second fixed electrode to the connection point of said two inductance elements or said two capacity elements in a high-frequency fashion.

3. A filter comprising:

a common external conductor having upper and lower walls;

a plurality of variable resonance capacity elements including top and last resonance capacity elements connected in series in a high-frequency fashion and each comprising:

a hollow dielectric cylinder having inner and outer surfaces and upper and lower end portions facing the upper and lower walls, respectively, of said external conductor a suitable distance away, a first fixed electrode composed of a metal thin layer that adheres around the inner surface of said hollow dielectric cylinder and has a lower end portion electrically connected to the lower wall of said external conductor and an upper end portion separated from the upper wall of said external conductor, a second fixed electrode composed of a metal thin layer that adheres around the outer surface of said hollow dielectric cylinder to define a circumferential space with said external conductor and has an upper end portion electrically connected to the upper wall of said external conductor and an lower end portion separated from the lower wall of said external conductor, and a hollow or solid cylindrical movable electrode that is coaxial with said first and second fixed electrodes and is attached to the upper wall of said external conductor so that an insertion length of said movable electrode into said hollow dielectric cylinder can be varied;

an input terminal having an inner conductor;

an output terminal having an inner conductor; and means provided in said circumferential space for connecting said second fixed electrode to the top resonance capacity element of said plurality of resonance capacity elements to said inner conductor of said input terminal;

means provided in said circumferential space for connecting said second fixed electrode of the last resonance capacity element of said plurality of resonance capacity elements to said inner conductor of said output terminal in a high-frequency fashion.

4. A resonator comprising:

an external conductor having upper and lower walls;

a variable resonance capacity element comprising a first fixed electrode composed of a metal hollow cylinder having a lower end portion fixed to the lower wall of said external conductor and an upper end portion separated from the upper wall of said external conductor, a second fixed electrode composed of a metal hollow cylinder that is provided coaxially with said first fixed electrode to define a gap between them and a circumferential space with said external conductor, and has an upper end portion fixed to the upper wall of said external conductor and an lower end portion separated from the lower wall of said external conductor, and a hollow or solid cylindrical movable electrode that is coaxial with said first and second fixed electrodes and is attached to the upper wall of said external conductor so that an insertion length of said movable electrode into said first metal hollow cylinder can be varied;

an input terminal having an inner conductor;

an output terminal having an inner conductor; and means provided in said circumferential space for connecting said second fixed electrode to the inner conductor of said input terminal and the inner conductor of said output terminal in a high-frequency fashion.

5. A resonator comprising:

an external conductor having upper and lower walls;

a variable resonance capacity element comprising a first fixed electrode composed of a metal hollow cylinder having a lower end portion fixed to the lower wall of said external conductor and an upper end portion separated from the upper wall of said external conductor, a second fixed electrode composed of a metal hollow cylinder that is provided coaxially with said first fixed electrode to define a gap between them and a circumferential space with said external conductor, and has an upper end portion fixed to the upper wall of said external conductor and an lower end portion separated from the lower wall of said external conductor, and a hollow or solid cylindrical movable electrode that is coaxial with said first and second fixed electrodes and is attached to the upper wall of said external conductor so that an insertion length of said movable electrode into said first metal hollow cylinder can be varied;

an input terminal having an inner conductor;

an output terminal having an inner conductor;

two inductance elements or two capacity elements connected in series at a connection point between said input terminal and said output terminal for compensation of transmission characteristics; and means provided in said circumferential space for connecting said second fixed electrode to the connection point of said two inductance elements or said two capacity elements in a high-frequency fashion.

6. A filter that comprising:

a common external conductor having upper and lower walls;

a plurality of variable resonance capacity elements including top and last resonance capacity elements connected in series in a high-frequency fashion, provided at suitable intervals and comprising a first fixed electrode composed of a metal hollow cylinder having a lower end portion fixed to the lower wall of said external conductor and an upper end portion separated from the upper wall of said external conductor, a second fixed electrode composed of a metal hollow cylinder that is provided coaxially with said first fixed electrode to define a gap between them and a circumferential space with said external conductor, and has an upper end portion fixed to the upper wall of said external conductor and an lower end portion separated from the lower wall of said external conductor, and a hollow or solid cylindrical movable electrode that is coaxial with said first and second fixed electrodes and is attached to the upper wall of said external conductor so that an insertion length of said movable electrode into said first metal hollow cylinder can be varied;

an input terminal having an inner conductor;

an output terminal having an inner conductor; and means provided in said circumferential space for connecting said second fixed electrode to the top resonance capacity element of said plurality of resonance capacity elements to said inner conductor of said input terminal;

means provided in said circumferential space for connecting said second fixed electrode of the last resonance capacity element of said plurality of resonance capacity elements to said inner conductor of said output terminal in a high-frequency fashion.

* * * * *